US005087542A

United States Patent [19]

Yamazaki et al.

[11] Patent Number: 5,087,542

[45] Date of Patent: Feb. 11, 1992

[54] ELECTROPHOTOGRAPHIC IMAGE-FORMING METHOD WHEREIN AN AMORPHOUS SILICON LIGHT RECEIVING MEMBER WITH A LATENT IMAGE SUPPORT LAYER AND A DEVELOPED IMAGE SUPPORT LAYER AND FINE PARTICLE INSULATING TONER ARE USED

[75] Inventors: Koji Yamazaki; Toshimitsu Kariya; Tatsuyuki Aoike; Toshiyuki Ehara; Takehito Yoshino; Hirokazu Otoshi, all of Nagahama, Japan

[73] Assignee: Canon Kabushiki Kaisha, Tokyo, Japan

[21] Appl. No.: 455,227

[22] Filed: Dec. 21, 1989

[30] Foreign Application Priority Data

| | | | |
|---|---|---|---|
| Dec. 27, 1988 | [JP] | Japan | 63-329631 |
| Dec. 27, 1988 | [JP] | Japan | 63-329632 |
| Dec. 27, 1988 | [JP] | Japan | 63-329633 |
| Dec. 27, 1988 | [JP] | Japan | 63-329634 |
| Dec. 27, 1988 | [JP] | Japan | 63-329635 |

[51] Int. Cl.[5] ..... G03G 5/14

[52] U.S. Cl. ..... 430/60; 430/66; 430/84; 430/126

[58] Field of Search ..... 430/60, 64, 66, 67, 430/84, 126

[56] References Cited

U.S. PATENT DOCUMENTS

| | | | |
|---|---|---|---|
| 4,775,606 | 10/1988 | Shirai | 430/67 |
| 4,795,691 | 1/1989 | Takei et al. | 430/67 |
| 4,833,055 | 5/1989 | Kazama et al. | 430/67 |
| 4,845,001 | 7/1989 | Takei et al. | 430/66 |
| 4,868,078 | 9/1989 | Sakai et al. | 430/67 |
| 4,882,251 | 11/1989 | Aoike et al. | 430/57 |
| 4,886,723 | 12/1989 | Aoike et al. | 430/57 |

*Primary Examiner*—John Goodrow

*Attorney, Agent, or Firm*—Fitzpatrick, Cella, Harper & Scinto

[57] ABSTRACT

In an electrophotographic image-forming method to be practiced in an electrophotographic image-forming system including a halogen lamp light source, an optical system, a cylindrical photosensitive member, a main corona charger, an electrostatic latent image-forming mechanism, a development mechanism containing magnetic toner, a transfer sheet feeding mechanism, a transfer charger, a separating charger, a transfer sheet conveying mechanism, a cleaning mechanism and a charge-removing light source which is capable of adjusting an image-forming process speed, the improvement comprises: using an amorphous silicon light receiving member which comprises a substrate and a light receiving layer disposed on said substrate, said light receiving layer comprising a first layer capable of exhibiting a photoconductivity, a second layer capable of supporting a latent image and a third layer capable of supporting a developed image being laminated in this order on said substrate, said first layer being formed of an amorphous material containing silicon atoms as a matrix, and at least one kind of atoms selected from the group consisting of hydrogen atoms and halogen atoms, said second layer being formed of an amorphous material containing silicon atoms as a matrix, carbon atoms, atoms of an element belonging to Group III of the Periodic Table, and at least one kind of atoms selected from the group consisting of hydrogen atoms and halogen atoms, and said third layer being formed of an amorphous material containing silicon atoms as a matrix, carbon atoms and at least one kind of atoms selected from the group consisting of hydrogen atoms and halogen atoms; and using a fine particle insulating toner having a volume average particle size in the range of 4.5 to 9 μm.

13 Claims, 63 Drawing Sheets

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

| | THE SURFACE TEMPERATURE OF THE LIGHT RECEIVING MEMBER (°C) |
|---|---|
| ○ | 5 |
| △ | 10 |
| □ | 25 |
| + | 40 |
| ▽ | 50 |

ELECTROPHOTOGRAPHIC IMAGE-FORMING METHOD WHEREIN AN AMORPHOUS SILICON LIGHT RECEIVING MEMBER WITH A LATENT IMAGE SUPPORT LAYER AND A DEVELOPED IMAGE SUPPORT LAYER AND FINE PARTICLE INSULATING TONER ARE USED

FIELD OF THE INVENTION

The present invention relates to an improved electrophotographic image-forming method which stably and repeatedly provides high quality images excelling in resolution and tone reproduction. More particularly, the present invention relates to an improved electrophotographic image-forming method using (i) an amorphous silicon light receiving member having a photoconductive layer, a latent image support layer and a developed image support layer and (ii) fine particle insulating toner of 4.5 to 9 μm in volume average particle size which makes it possible to stably and repeatedly provide high quality images excelling in resolution and tone reproduction at high speed.

BACKGROUND OF THE INVENTION

There have been proposed a number of amorphous silicon system light receiving members. They have been evaluated as being suitable as electrophotographic light receiving members for use not only in high speed electrophotographic copying machines but also in laser beam printers since they are high in surface hardness, highly sensitive to a long wavelength light such as semiconductor laser beam (770 nm–800nm), and hardly deteriorated even upon repeated use for a long period of time.

FIG. 3 is a schematic cross section view of a typical configuration of such amorphous silicon system light receiving member, which comprises an electroconductive substrate 301 made of a proper material such as aluminum and a light receiving layer comprising a charge injection inhibition layer 302 capable of preventing injection of a charge from the side of the substrate 301, a photoconductive layer 303 exhibiting photoconductivity and a surface protective layer 304.

The image formation using said light receiving member is carried out, for example, in the following manner by using an appropriate electrophotographic copying machine as shown in FIG. 4.

FIG. 4 is a schematic explanatory view of the constitution of a conventional electrophotographic copying machine. As shown in FIG. 4, near a cylindrical light receiving member 401 having the configuration shown in FIG. 3 which rotates in the direction indicated by an arrow, there are provided a main corona charger 402, an electrostatic latent image-forming mechanism 403, a development mechanism 404, a transfer sheet feeding mechanism 405, a transfer charger 406(*a*), a separating charger 406(*b*), a cleaning mechanism 407, a transfer sheet conveying mechanism 408 and a charge-removing lamp 409.

The cylindrical light receiving member 401 is maintained at a predetermined temperature by a heater 423. The cylindrical light receiving member 401 is uniformly charged by the main corona charger 402 to which a predetermined voltage is impressed. Then, an original 412 to be copied which is placed on a contact glass 411 is irradiated with a light from a light source 410 such as a halogen lamp or fluorescent lamp through the contact glass 411, and the resulting reflected light is projected through mirrors 413, 414 and 415, a lens system 417 containing a filter 418, and a mirror 416 onto the surface of the cylindrical light receiving member 401 to form an electrostatic latent image corresponding to the original 412.

This electrostatic latent image is developed with toner supplied by the development mechanism 404 to provide a toner image. A transfer sheet P is supplied through the transfer sheet feeding mechanism 405 comprising a transfer sheet guide 419 and a pair of feed timing rollers 422 so that the transfer sheet P is brought into contact with the surface of the cylindrical light receiving member 401, and corona charging is effected with the polarity different to that of the toner from the rear of the transfer sheet P by the transfer charger 406(*a*) to which a predetermined voltage is applied in order to transfer the toner image onto the transfer sheet P. The transfer sheet P having the toner image transferred thereon is electrostatically removed from the cylindrical light receiving member 401 by the charge-removing action of the separating corona charger 406(*b*) where a predetermined AC voltage is impressed and is then conveyed by the transfer sheet conveying mechanism 408 to a fixing zone (not shown). The residual toner on the surface of the cylindrical light receiving member 401 is removed by a cleaning blade 421 upon arrival at the cleaning mechanism 407 and the removed toner is discharged by way of waste toner discharging means (feed-screw) 423. Thereafter, the thus cleaned cylindrical light receiving member 401 is entirely exposed to light by the charge-removing lamp 409 to erase the residual charge and is recycled.

The amorphous silicon system light receiving member to be used in the image-forming process as above described has such advantages as above mentioned, for example, it exhibits a high sensitivity against a long wavelength light (sensitivity peak near 680 nm and sensitivity region of 400 to 800 nm), and it is practically satisfactory since practically acceptable images without accompaniment of crushed line image or slim line image can be reproduced as long as ordinary documents are copied. However, it is not sufficient enough to meet a recently increased demand to provide a high quality image equivalent to a printed image obtained by a printing machine.

That is, when an original containing superfine lines of 100 μm or less in width is reproduced by the foregoing image-forming method using such amorphous silicon system light receiving member as above mentioned, there often appear undesirably fattened lines or undesirably slimmed lines on the resulting copied lines. Likewise, when an original containing complicated Chinese characters (KANZI in Japanese) of 2 mm or less in size is reproduced by the foregoing image-forming method, the resulting copied chinese characters often have crushed line images or slim line images which can not be easily distinguished.

Therefore, it is generally recognized that the foregoing image-forming method using an amorphous silicon system light receiving member is not suitable for reproducing such originals as above mentioned, for example, catalogs or manuals of articles for sale, etc., mainly because of insufficient resolution.

The foregoing problem is apparently caused when the image-forming method is practiced under high humid environment. In order to eliminate this problem, there has been proposed a method of heating the amorphous silicon system light receiving member. However, it is still difficult to obtain desirable copied images from such originals containing superfine lines or complicated Chinese characters.

Independently from what above described, there is another disadvantage for the foregoing image-forming method using an amorphous silicon system light receiving member that a certain quantity of ozone or reaction products (such as nitrogen oxides, etc.) caused by ozone is generated because of corona charging. The quantity of ozone to be generated is in proportion to the amount of electric current to be applied onto the charger. And the quantity of ozone to be generated in the case of negative charge is 5 to 10 folds greater over that in the case of positive charge.

In order to prevent leakage of ozone to be generated into the outside of the system, the system is provided with an activated carbon filter (not shown in the figure), by which the ozone is adsorbed or decomposed so that the air exhausted from the system contains 0.1 ppm or less of ozone.

However, there is an increased social demand to further decrease the ozone content in the air exhausted from the system because of the spread of electrophotographic copying machine not only in offices but also in private houses.

The ozone generated in the electrophotographic copying machine is a problem for an amorphous silicon system light receiving member installed therein because the ozone and the reaction products caused as a result of reacting with air are adsorbed on the surface of the light receiving member. As a result chemical reactions among the ozone, the reaction products and the constituent materials of said surface occur and the characteristics of the light receiving member are undesirably changed. This leads particularly to reducing the resolution. This situation is significant in the case of practicing the image-forming method using an amorphous silicon system light receiving member which has been repeatedly used under highly humid environment.

SUMMARY OF THE INVENTION

The present invention is aimed at eliminating the foregoing disadvantages which are found on the aforementioned known image-forming method and developing an improved image-forming method which makes it possible to reproduce desirable high quality images even from originals containing superfine lines or/and complicated minute chinese characters at high speed by using an amorphous silicon light receiving member and which meets the above-mentioned demands.

Another object of the present invention is to provide an improved high speed image-forming method which makes it possible to reproduce superfine lines and minute dots contained in an original in a state equivalent to the original and to provide very high quality images.

The present invention which attains the above objects includes the following embodiments.

The first embodiment of the present invention is to provide an improved image-forming method to be practiced in an electrophotographic copying system, characterized by using in combination (i) a light receiving member which comprises a substrate and a light receiving layer disposed on said substrate, said light receiving layer comprising (a) a first layer exhibiting photoconductivity (hereinafter referred to as "photoconductive layer") which is formed of an amorphous material containing silicon atoms (Si) as a matrix, and at least hydrogen atoms (H) and/or halogen atoms (X) (this amorphous material will be hereinafter referred to as "a-Si(H,X)"), (b) a second layer capable of supporting a latent image (hereinafter referred to as "latent image support layer") which is formed of an amorphous material containing silicon atoms (Si) as a matrix, carbon atoms (C) and atoms of an element belonging to Group III of the Periodic Table (hereinafter referred to as "Group III element"), and hydrogen atoms (H) and/or halogen atoms (X)(this amorphous material will be hereinafter referred to as "a-SiC:M(H,X)", where M stands for atoms of Group III element) and (c) a third layer capable of supporting a developed image (hereinafter referred to as "developed image support layer") which is formed of an amorphous material containing silicon atoms (Si) as a matrix, carbon atoms (C), and hydrogen atoms (H) and/or halogen atoms (X)(this amorphous material will be hereinafter referred to as "a-SiC (H,X)", said three layers (a) to (c) being laminated in this order from the side of said substrate, and (ii) fine particle insulating toner of 4.5 to 9.0 μm in volume average particle size as a developer.

The second embodiment of the present invention is to provide an improved image-forming method to be practiced in an electrophotographic copying system, characterized by using in combination (i) a light receiving member which comprises a substrate and a light receiving layer disposed on said substrate, said light receiving layer comprising (a) a photoconductive layer formed of a-Si(H,X), (b) a latent image support layer formed of a-SiC:M(H,X) and (c) a 3000 to 10000 Å thick developed image support layer formed of a-SiC (H,X) being laminated in this order from the side of said substrate, and (ii) fine particle insulating toner of 4.5 to 9.0 μm in volume average particle size.

The third embodiment of the present invention is to provide an improved image-forming method to be practiced in an electrophotographic copying system, characterized by using in combination (i) a light receiving member which comprises a substrate and a light receiving layer disposed on said substrate, said light receiving layer comprising (a) a photoconductive layer formed of a-Si(H,X), (b) a latent image support layer formed of a-SiC:M(H,X) and (c) a developed image support layer having a specific resistance of $10^{12}$ to $10^{16}$ Ω.cm formed of a-SiC(H,X) being laminated in this order from the side of said substrate, and (ii) fine particle insulating toner of 4.5 to 9.0 μm in volume average particle size.

The fourth embodiment of the present invention is to provide an improved image-forming method to be practiced in an electrophotographic copying system, characterized by using in combination (i) a light receiving member which comprises a substrate and a light receiving layer disposed on said substrate, said light receiving layer comprising (a) a photoconductive layer formed of a-Si(H,X), (b) a latent image support layer formed of a-SiC:M(H,X) and (c) a developed image support layer formed of a-SiC(H,X), and (ii) fine particle insulating toner of 4.5 to 9.0 μm in volume average particle size, and carrying out image-formation while maintaining the surface of said light receiving member (i) at a temperature of 10 to 40° C.

BRIEF DESCRIPTION OF THE DRAWINGS

FIG. 10a through FIG. 36b show graphs respectively illustrating the interrelations between the volume average particle sizes of toner and the resolutions obtained in the Experiments which will be later described.

FIG. 37a through FIG. 63b show graphs respectively illustrating the interrelations between the volume average particle sizes of toner and the tone reproductions obtained in the Experiments which will be later described.

DETAILED DESCRIPTION OF THE INVENTION

Figure 1A:
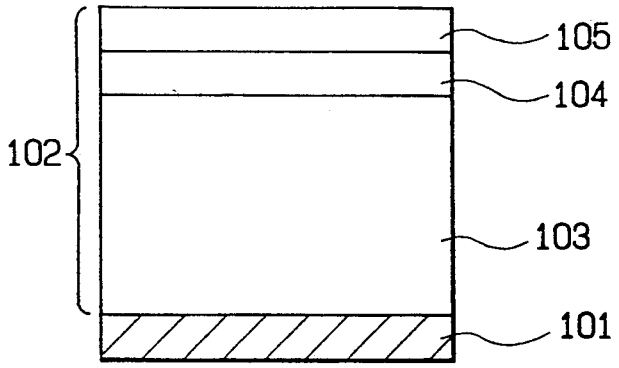
FIG. 1(A) through FIG.1(C) are schematic views respectively illustrating the typical layer constitution of a representative amorphous silicon light receiving member to be used in the present invention.

The present inventors have conducted extensive studies through experiments in order to eliminate the foregoing disadvantages which are found on the known image-forming method and in order to attain the objects of the invention, and as a result, have found that when a specific amorphous silicon light receiving member and a specific fine particle insulating toner are used in combination, the objects of the invention can be effectively attained. Specifically, the present invention has been accomplished based on the findings obtained through the undermentioned experiments.

The electrophotographic image-forming method according to the present invention includes the foregoing four embodiments and makes it possible to stably and repeatedly provide high quality copied images excelling in resolution and tone reproduction at high speed under any environmental condition.

The reason which these significant effects are provided by the combined use of a specific amorphous silicon light receiving layer and a specific fine particle insulating toner are not clear. But as can be recognized from the results of the undermentioned experiments, it is presumed due to the synergism of the following factors: since the amorphous silicon light receiving member is provided with the latent image support layer under the developed image support layer, a desirable latent image is effectively formed without having negative influences due to changes in environmental condition; since the latent image is developed through the developed image support layer with the use of the specific fine particle insulating toner, a coulomb force works between the latent image and the fine particle insulating toner; since the thickness of the developed image support layer is controlled to be in the range of 3000 to 10000 Å, the durability of the light receiving member is improved; since the developed image support layer is controlled to have a specific resistance of $10^{12}$ to $10^{16}$ Å.cm, the characteristics of the light receiving member are not negatively affected by changes in environmental condition; and since the surface of the light receiving member is maintained at a temperature of 10 to 40° C. upon practicing the image-forming process, the insulating toner is prevented from being blocked in the cleaning mechanism and thus, the electrophotographic image-forming system is stably maintained.

The electrophotographic image-forming method according to the present invention further includes the use of a metal oxide system ozone-removing filter having a heater which is capable of effectively removing ozone generated by the charger and reaction products caused by the ozone. In this case, the characteristics of the light receiving member, the characteristics of the insulating toner are stably maintained, and those characteristics are further desirably exhibited during the image-forming process.

Explanation will be made about the present invention is more detail with reference to the drawings.

Light Receiving Member

Figure 1B:
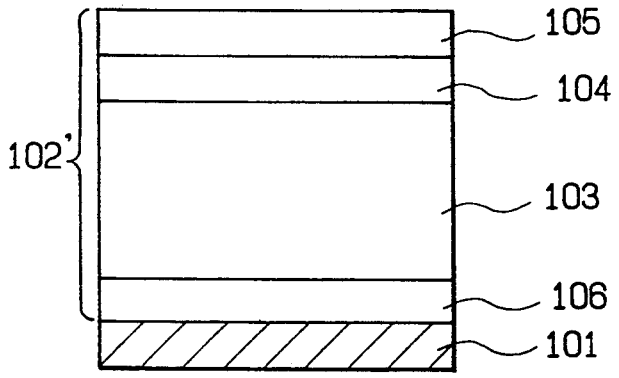
Figure 1C:
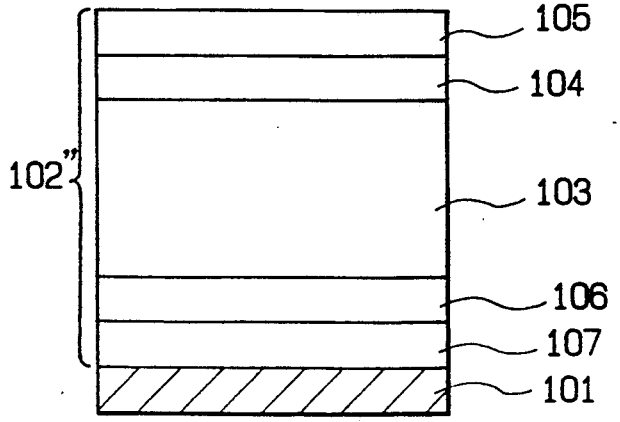

FIGS. 1(A), 1(B) and 1(C) are schematic cross-sectional views respectively illustrating the layer constitution of the light receiving member to be used in the present invention.

FIG. 1(A) shows the most typical layer constitution of the light receiving member to be used in the present invention which comprises an electroconductive substrate 101 made of an electroconductive material such as aluminum and a light receiving layer 102 disposed on the substrate 1, the light receiving layer 102 comprising a photoconductive layer 103 formed of a-Si(H,X), a latent image support layer 104 formed of a-SiC:M(H,X) and a developed image support layer 105 formed of a-SiC(H,X) being laminated in this order from the side of the substrate 101.

FIG. 1(B) shows another layer constitution of the light receiving member to be used in the present invention which comprises the foregoing substrate 101 and a light receiving layer 102' disposed on the substrate 101, said light receiving layer 102' comprising a charge injection inhibition layer 106 formed of an amorphous material containing silicon atoms (Si) as a matrix, hydrogen atoms (H) and/or halogen atoms (X), and at least one kind of atoms selected from the group consisting of carbon atoms (C), atoms of Group III element, atoms of Group V element (excluding N) and atoms of Group VI element (excluding O) and further optionally, at least one kind of atoms selected from the group consisting of nitrogen atoms (N) and oxygen atoms (O) [this amorphous material will be referred to as "a-Si(H,X)(C,M')(N,O)", where M' stands for atoms of Group III element, V element (excluding N) or VI element excluding O], a photoconductive layer 103 formed of a-Si (H,X), a latent image support layer 104 formed of a-SiC:M (H,X) and a developed image support layer 105 formed of a-SiC(H,X) being laminated in this order from the side of the substrate 101.

FIG. 1(C) shows a further layer constitution of the light receiving member to be used in the present invention which comprises the foregoing substrate 101 and a light receiving layer 102" disposed on the substrate 101, the light receiving layer 102" comprising a long wavelength light absorptive layer (this layer will be hereinafter referred to as "IR absorptive layer") 107 formed of an amorphous material containing silicon atoms (Si) as a matrix, hydrogen atoms (H) or/and halogen atoms (X), germanium atoms (Ge) or/and tin atoms (Sn), and optionally at least one kind of atoms selected from the group consisting of carbon atoms, atoms of Group III element, atoms of Group V element (excluding N) and atoms of Group VI element (excluding O) and further optionally, at least one kind of atoms selected from the group consisting of nitrogen atoms (N) and oxygen atoms (O) [this amorphous material will be hereinafter referred to as "a-Si(Ge,Sn)(H,X)(C,M')(N,O)", where M' stands for atoms of Group III element, V element (excluding N) or VI element (excluding O), a charge injection inhibition layer 106 formed of a-Si(H,X)(C,M')(N,O), a photoconductive layer 103 formed of a-Si(H,X), a latent image support layer 104 formed of a-SiC:M(H,X) and a developed image support layer 105 formed of a-SiC(H,X) being laminated in this order from the side of the substrate 101. In this case, it is possible to dispose the IR absorptive layer 107 between the substrate 101 and the photoconductive layer 103 without disposing the charge injection inhibition layer 106.

The photoconductive layer 103 is basically formed of a-Si(H,X) as described above, but it may contain at least one kind of atoms selected from the group consisting of carbon atoms (C), nitrogen atoms (N), oxygen atoms (O), germanium atoms (Ge), tin atoms (Sn), atoms of Group III element, atoms of Group V element (excluding N) and atoms of Group V element (excluding O) in case where necessary.

As for the hydrogen atoms (H) and/or the halogen atoms (X) to be contained in the photoconductive layer 103, the amount of the hydrogen atoms (H), the amount of the halogen atoms (X), or the sum of the amounts of the hydrogen atoms (H) and the halogen atoms (H+X) is desired to be in the range of 0.1 to 40 atomic %.

In the case where the photoconductive layer 103 contains atoms of Group III element, the amount of the atoms is desired to be controlled to an amount corresponding one fifth of the amount of the atoms of Group III element contained in the latent image support layer 104.

The photoconductive layer 103 is desired to be 1 to 100 μm thick.

The latent image support layer 104 is basically formed of a-SiC:M(H,X), but it may contain at least one kind of atoms selected from the group consisting of germanium atoms (Ge), tin atoms (Sn), nitrogen atoms (N), oxygen atoms (O), atoms of Group V element (excluding N) and atoms of Group VI element (excluding O) in case where necessary.

The amount of the carbon atoms (C) to be contained in the latent image support layer 104 is desired to be in the range of 1 to 90 atomic %. As for the atoms of Group III element to be contained in the latent image support layer 104, it is desired to be in the range of 1 to $5\times10^4$ atomic ppm. Further, is for the hydrogen atoms (H) and/or the halogen atoms (X) to be contained in the latent image support layer 104, the amount of hydrogen atoms (H), the amount of halogen atoms (X) or the sum of the amounts of the hydrogen atoms and the halogen atoms (H+X) is desired to be in the range of 0.1 to 70 atomic %.

The latent image support layer 104 is desired to be 0.003 to 30 μm thick.

The developed image support layer 105 is basically formed of a-SiC(H,X), but it may contain at least one kind of atoms selected from the group consisting of germanium atoms (Ge), tin atoms (Sn), atoms of Group III element, nitrogen atoms (N), oxygen atoms (O), atoms of Group V element (excluding N) and atoms of Group VI element (excluding O) in case where necessary.

The amount of the carbon atoms (C) to be contained in the developed image support layer 105 is desired to be in the range of 1 to 90 atomic %. And in a most preferred embodiment in this respect, the amount of the carbon atoms (C) is desired to be greater than that contained in the latent image support layer 104.

As for the hydrogen atoms (H) and/or the halogen atoms (X) to be contained in the developed image support layer 105, the amount of the hydrogen atoms (H), the amount of the halogen atoms (X), or the sum of the amounts of the hydrogen atoms and the halogen atoms (H+X) is desired to be in the range of 0.1 to 70 atomic %. Further, in the case where the developed image support layer 105 contains atoms of Group III element, the amount of the atoms is desired to be controlled to an amount corresponding to one tenth of the amount of atoms of Group III element contained in the latent image support layer 104.

As for the developed image support layer 105, it is particularly important to be so designed to have a specific resistance of $10^{12}$ to $10^{16}$ Ω.cm in order to prevent the light receiving member from being negatively affected by changes in environmental condition and stably maintaining the electrophotographic characteristics so as to always provide high quality copied images. To control the specific resistance of the developed image support layer 105 to be in the above range can be carried out by adjusting the composite ratio of the constituents thereof to a predetermined value by controlling the flow ratio of the film-forming raw materials upon formation thereof.

The charge injection inhibition layer 106 is formed of a-Si(H,X)(C,M')(N,O) as described above, and it is desired to be 0.03 to 15 μm thick.

The IR absorptive layer 107 is formed of a-Si(Ge,Sn)(H,X)(C,M')(N,O) as described above, and it is desired to be 0.05 to 25 μm thick.

In any of the above cases, the halogen atoms (X) can include fluorine, chlorine, bromine and iodine. Among these halogen atoms, fluorine and chlorine are particularly desirable. Likewise, the foregoing Group III element can include B (boron), Al (aluminum), Ga (gallium), In (indium) and Tl (thallium). Among these elements, B, Al and Ga are particularly preferred. The foregoing Group V element can include P (phosphorus), As (arsenic), Sb (antimony) and Bi (bismuth). Among these elements, P and As are particularly preferred. Then, the foregoing Group VI element can include S (sulfur), Se (selenium), Te (tellurium) and Po (polonium). Among these elements, S and Se are particularly preferred.

The method of preparing the light receiving member to be used in the present invention will be explained.

Each of the foregoing layers to constitute the light receiving layer 102, 102' or 102" of the light receiving member may be properly formed by any of the known vacuum deposition methods wherein film-forming parameters are properly designed. Specifically, there can be mentioned glow discharge method such as AC glow discharge PCVD method i.e. low frequency PCVD method, high frequency PCVD method and microwave PCVD method and DC glow discharge PCVD method; ECR PCVD method; reactive sputtering method; thermal induced CVD method; ion plating method; and light induced CVD method. Other than these methods, there can be also mentioned HR-CVD method (Hydrogen-Radical Assisted Chemical Vapor Deposition method) and OF-CVD method (Fluorine-Oxidation chemical vapor deposition method).

The HR-CVD method denotes a method that an active species (A) formed from a raw material gas such as hydrogen gas and another active species (B) reactive with said active species (A) which is formed from a film-forming raw material gas are separately introduced into a film forming space and said active species (B) is reacted with said active species (A) to thereby deposit a film on a substrate being maintained at a desired temperature. The OF-CVD method denotes a method that a film forming raw material gas and a halogen gas capable of oxidizing said film forming raw material gas are separately introduced into a film forming space and said film forming raw material gas is reacted with said halogen gas to thereby deposit a film on a substrate being maintained at a desired temperature.

These film forming methods may be selectively employed depending on the factors such as the manufacturing conditions, the installation cost required, production scale and properties required for the light receiving member to be prepared. The glow discharge method, reactive sputtering method, ion plating method, HR-CVD method and FO-CVD method are suitable since the controls in the conditions upon forming the layers having desired properties are relatively easy, and hydrogen atoms, halogen atoms and other atoms can be easily introduced together with silicon atoms into a film to be deposited. And these film forming methods may be used together in one identical system.

In the following, explanation will be made for the case of preparing the light receiving member to be used in the present invention by means of a high frequency PCVD method (that is, RF-PCVD method).

Figure 5:
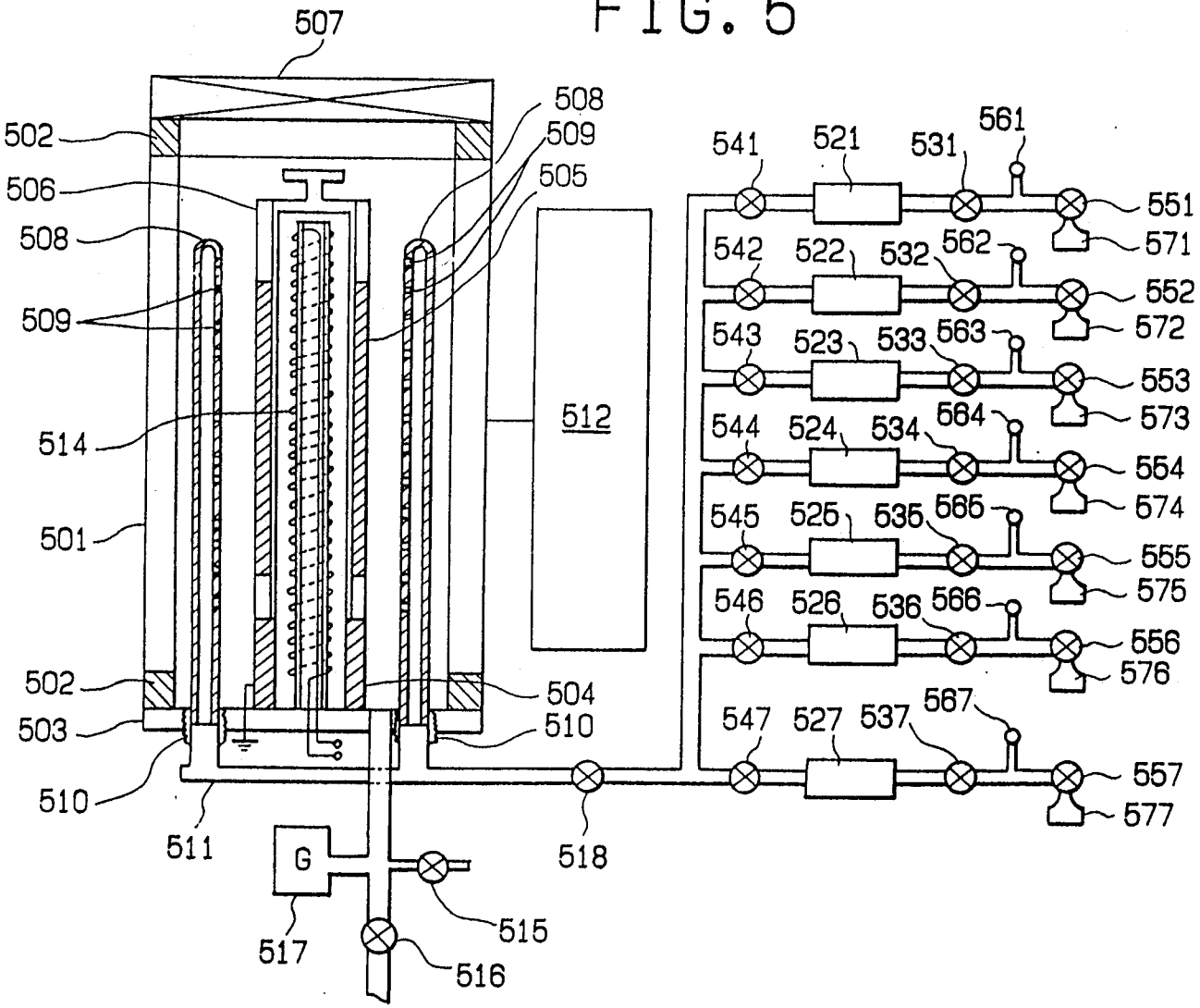
FIG. 5 is a schematic explanatory view of a fabrication apparatus for preparing an amorphous silicon light receiving member to be used in the present invention.

For practicing the RF-PCVD method, there can be used an appropriate RF-PCVD apparatus having the constitution as shown in FIG. 5.

Referring FIG. 5, gas reservoirs 571, 572, 573, 574, 575, 576 and 577 are charged with gaseous starting materials for forming the respective layers to constitute the light receiving layer 102, 102' or 102" of the light receiving member to be used in the present invention, that is, for instance, $SiH_4$ gas in the reservoir 571, $H_2$ gas in the reservoir 572, $CH_4$ gas in the reservoir 573, $PH_3$ gas diluted with $H_2$ gas (hereinafter referred to as "$PH_3/H_2$ gas") in the reservoir 574, $B_2H_6$ gas diluted with $H_2$ gas (hereinafter referred to as "$B_2H_6/H_2$ gas") in the reservoir 575, NO gas in the reservoir 576 and Ar gas in the reservoir 577.

Numeral references 561, 562, 563, 564, 565, 566 and 567 stand for pressure gauges for the respective gases in the pipe ways from the reservoirs 571 through 577.

Prior to the entrance of these gases into a film forming chamber 501, it is confirmed that valves 551 through 557 for the gas reservoirs 571 through 577 and a leak valve 515 are closed and that inlet valves 531 through 537, exit valves 541 through 547, and a sub-valve 518 are opened. Then, a main valve 516 is at first opened to evacuate the inside of the film forming chamber 501 and the insides of gas pipe ways by a vacuum pump (not shown).

Then, upon observing that the reading on a vacuum gage 517 becomes a predetermined vacuum degree, the sub-valve 518 and the exit valves 541 through 547 are closed.

Now, in the film forming chamber 501, a cylindrical substrate 505 on which a film is to be formed is placed on a rotatable cylindrical substrate holder 506 having an electric heater 514 therein. Further, in the film forming chamber 501, there are longitudinally installed a plurality of gas feed pipes 508 each provided with a plurality of gas liberation holes 509 capable of uniformly supplying a film forming raw material gas toward the cylindrical substrate 505. Each of the gas feed pipes 508 is connected through a detachable sealing means 510 provided with a bottom wall 503 of the film forming chamber 501 to a gas supply pipe 511 connected to each of the gas reservoirs 571 through 577.

The film forming chamber 501 is so designed that the circumferential wall can serve as a cathode. Likewise, the cylindrical substrate holder 506 having the cylindrical substrate 505 being placed thereon is so designed that it can serve as an anode. For this purpose, the circumferential wall of the film forming chamber 501 is electrically insulated by an insulator 502. Numeral reference 512 stands for a matching box connected to a RF power source (not shown). When the RF power source is switched on to generate a RF power, the RF power is applied through the matching box 512 between the circumferential wall (cathode) of the film forming chamber 501 and the cylindrical substrate holder 506 having the cylindrical substrate 505 thereon (anode) to thereby cause RF glow discharge in the film forming chamber 501.

Prior to starting film formation, the exit valve 547 and the sub-valve 518 are gradually opened to supply Ar gas into the film forming chamber 501 through the gas liberation holes 509 of the gas feed pipes 508. The flow rate of Ar gas is controlled to a predetermined value by means of a mass flow controller 527. The gaseous pressure (inner pressure) of the film forming chamber 501 is adjusted to a predetermined value by regulating the vacuum pump and the main valve 516 while observing the reading on the vacuum gauge 517. Then, the cylindrical substrate 506 starts rotating and it is heated to and maintained at a predetermined temperature by actuating the electric heater 514. Thereafter, the supply of Ar gas into the film forming chamber 501 is terminated by closing the exit valve 547 and the sub-valve 518.

After this, the formation of a constituent layer of the light receiving layer 102, 102' or 102" of the light receiving member is carried out, for example, in the following way. That is, one or more kinds of raw material gases are introduced into the film forming chamber 501 by opening the correspondents of the exit valves 541 through 547 and the sub-valve 518, and the respective flow rates of the raw material gases are adjusted as desired by the correspondents of mass flow controllers 521 through 527 in the same manner as in the above case of Ar gas.

The gaseous pressure (inner pressure) of the film forming chamber 501 is adjusted as desired by regulating the vacuum pump and the main valve 516 while observing the reading on the vacuum gauge 517.

After all the flow rates of raw material gases and the inner pressure become stable, a predetermined RF power is applied through the matching box 512 into the film forming chamber 512 to cause RF glow discharge, whereby a deposited film is formed on the cylindrical substrate 505 being maintained at a desired temperature.

When the constituent layer of a desired thickness is formed, the exit valves and the sub-valve are closed. A successive constituent layer is formed by repeating the above procedures. In any case, when the constituent layer is formed, the respective flow rates of the raw material gases are controlled by using a microcomputer or the like so that the gaseous pressure of the film forming chamber can be stabilized to ensure stable film forming conditions.

All of the exit valves other than those required for upon forming the respective layers are of course closed. Further, upon forming the respective layers, the inside of the system is once evacuated to a high vacuum degree as required by closing the exit valves 541 through 547 while opening the sub-valve 518 and fully opening the main valve 516 in order to avoid leaving the gases used for the previous layer in the film forming chamber 501 and also in the gas pipe ways.

In order to form a desirable layer of uniform thickness on the cylindrical substrate 505, it is possible to rotate the cylindrical substrate 505 during the layer formation by rotating the cylindrical substrate holder 506 by a motor (not shown).

Developer (insulating toner)

In the present invention, there is used a fine particle insulating toner of 4.5 to 9.0 μm in volume average particle size as the developer.

The fine particle insulating toner to be used in the present invention contains an appropriate binder resin.

Usable as the binder resin are, for example, homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrenc-vinyl ethyl ether copolymer, styrene-vinyl methyl ketone copolymer, styrene-butadiene copolymer, styrene-isoprene copolymer, and styrene-acrylonitrileindene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

The fine particle insulating toner to be used in the present invention may be either magnetic or non-magnetic. The magnetic fine particle insulating toner can be properly produeed by blending one or more necessary components and magnetic powder in the foregoing binder resin by a conventional toner producing method. As the magnetic powder, there can be mentioned, for example, magnetic powders of non-oxidized iron, iron having a oxidized surface, ferrite, nickel, copper, rare earth metals, alloys of two or more these metals or oxides of these metals.

Basically, the fine particle insulating toner to be used in the present invention is produced by blending a proper colorant in the foregoing binder resin. As the colorant, a known dye and/or pigment may be used. Usable as the dye are, for example, basic dyes, oil soluble dyes, etc. Usable as the pigment are, for example, diazo-yellow compounds, insoluble azo compounds, copper phthalocyanines, etc.

Other than these colorants, any of the above-mentioned magnetic powders which are capable of functioning as the colorant can be selectively used also as the colorant.

Specific examples of the usable dye to be contained in the fine particle insulating toner which is used in the present invention are C.I. Solvent Red 49, C.I. Solvent Red 52, C.I. Solvent Red 109, C.I. Basic Red 12, C.I. Basic Red 1, and C.I. Basic Red 36.

Specific examples as the usable pigment to be contained in the fine particle insulating toner to be used in the present invention are C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red, 6, C.I. Pigment Red 7, C.I. Pigment Blue 15, and C.I. Pigment Blue 16.

Specific examples of the copper phthalocyanine are copper phthalocyanine Ba salts having 2 or 3 carboxybenzamidomethyl group substituents on the phthalocyanine nucleus which are represented by the following structural formula.

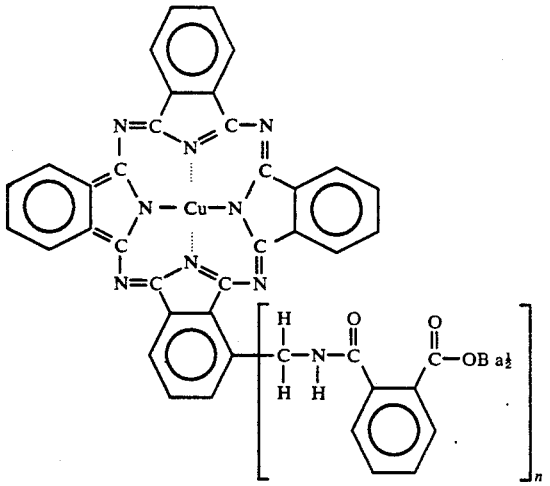

n = 2~3

The fine particle insulating toner to be used in the present invention may contain one or more optional additives such as charging state controlling agent, lubricant, abrasive, flowability improver, etc.

The fine particle insulating toner to be used in the present invention may be properly produced by a conventional toner producing method wherein a proper mixture from which the fine particle insulating toner is obtained is prepared, and the mixture is subjected to grinding granulation. The foregoing mixture may be properly prepared also by a conventional method, for example, a method wherein components are dispersed in a binder resin solution and the resulting liquid is spray-dried or a method wherein an emulsion containing monomers capable of forming a binder resin and components required is firstly prepared, the emulsion is subjected to polymerization and the resulting is spray-dried. Other than these method, the fine particle insulating toner to be used in the present invention can be also prepared by a method wherein toner microcapsules each comprising a core material and a shell material are prepared, they are spray-dried, followed by classification.

In the following, examples for producing the fine particle insulating toner will be described.

The following examples are provided for illustrative purposes only and are not intended to limit the scope of the present invention.

Unless otherwise indicated, parts and % signify parts by weight and % by weight respectively.

Toner Production Example 1

| | |
|---|---|
| Styrene/2-ethylhexyl acrylate/ divinyl benzene copolymer powder | 100 parts |
| Magnetite powder (as the colorant and also as the magnetic powder) | 60 parts |
| Nigrosine (as the charging state controlling agent) | 2 parts |
| Polypropylene (as the lubricant) | 3 parts |

The above ingredients were well blended in a Henschel mixer to obtain a mixture.

The mixture was melt-kneaded at 160° C. by means of a roll mill. The kneaded product was cooled, coarsely crushed to about 1 to 2 mm particle size by means of a hammer mill, then finely pulverized to about 0.1 to 50 μm particle size by means of a pulverizer using jet air stream and classified by using a MICROPLEX 400 MP classifier (product of ALPINE Co., Ltd.) wherein the system was so adjusted that particles of exceeding 9 μm in particle size were cut off. The classified fine particles obtained by the above first classification were again classified by using a MICROPLEX 132 MP classifier (product of ALPINE Co., Ltd.) wherein the system was so adjusted that particles of less than 4.5 μm in particle size were cut off, whereby toner fine particles of 4.5 to 9 μm in volume average particle size were obtained.

Toner Production Example 2

Toner fine particles of 4.5 to 9 μm in volume average particle size were obtained by repeating the procedures of Toner Production Example 1, except that a composition composed of 100 part of styrene-butadiene copolyer (as the binding resin), 65 parts of magnetite (as the colorant and also as the magnetic powder) and 2 parts of Cr salicylate complex (as the charging state controlling agent) was used, and it was melt-kneaded at 180° C. by means of an extruder.

Toner Production Example 3

The procedures of Toner Production Example 1 were repeated, except that 100 parts of polyethylene wax (as the binder resin) and 60 parts of magnetite powder (as the colorant and also as the magnetic powder) were well blended to obtain a mixture, to thereby obtain toner fine particles of 4.5 to 9 μm in volume average particle size.

The toner fine particles thus obtained were used as the core materials, and they were dispersed in a solution of styrene-acryl copolymer in toluene to obtain a microcapsule dispersion containing 10 % of the core materials. The microcapsule dispersion was introduced into a niroatomizer having two nozzles (product by Ashizawa Tekkojo Kabushiki Kaisha), wherein it was spray-dried by using a hot air of 100° C. and at a pressure of 4 kg/cm$^2$ to obtain toner microcapsules. The particle sizes of the toner microcapsules thus obtained were measured by a coulter counter of 100 μm in aperture size and as a result, it was found that they were in the range of 0.1 to some hundreds μm. The toner microcapsules were classified by the foregoing MICROPLEX 400 MP classifier then the foregoing MICROPLEX 132 MP classifier in the same manner as in Toner Production Example 1, to thereby obtain toner fine particles of 4.5 to 9 μm in volume average particle size.

Image-forming Method

Figure 2:
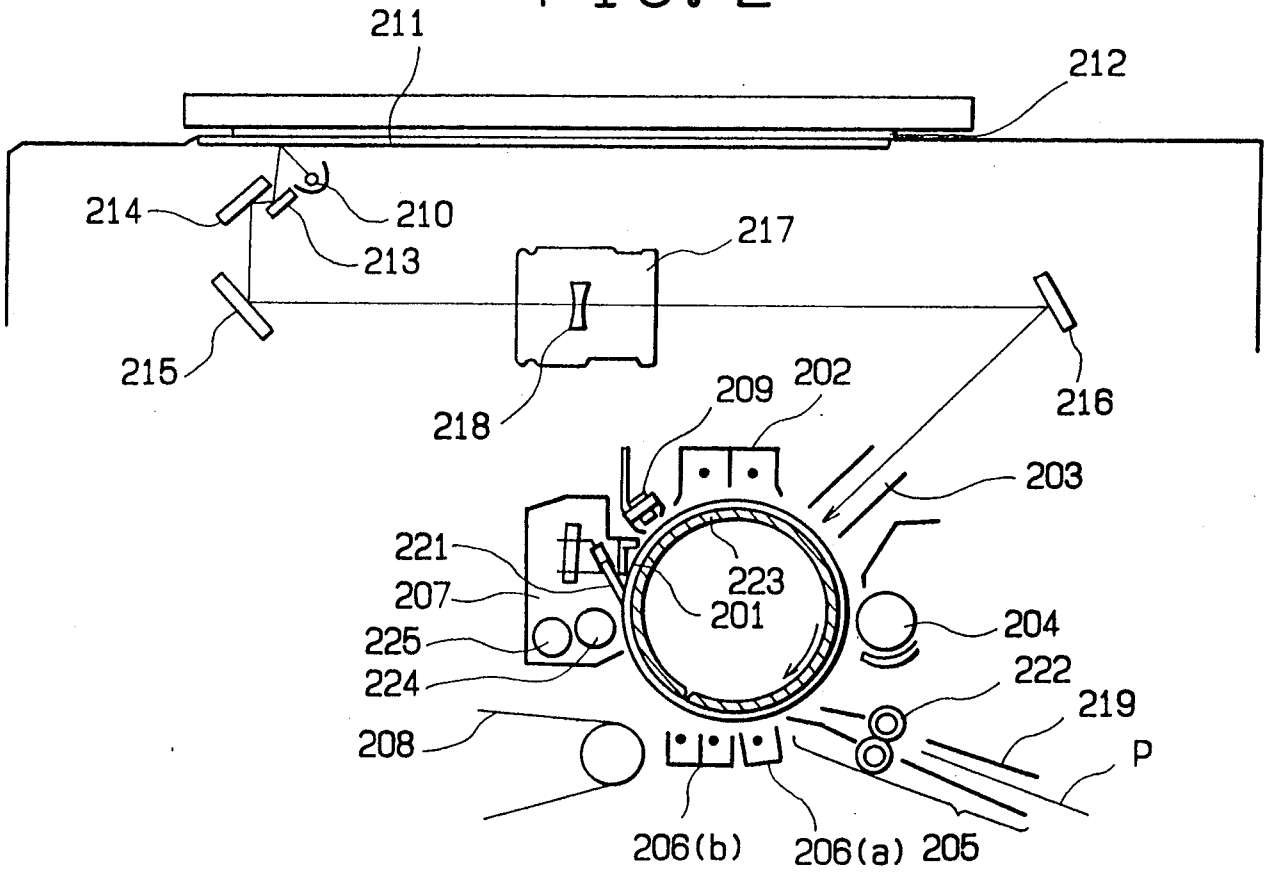
FIG. 2 is a schematic explanatory view illustrating the constitution of an electrophotographic copying system which is suitable for practicing the image-forming method according to each of the first to fourth embodiments of the present invention.

The electrophotographic image-forming method according to the present invention can be practiced in an appropriate electrophotographic copying system having the constitution, for example, as shown in FIG. 2.

Figure 4:
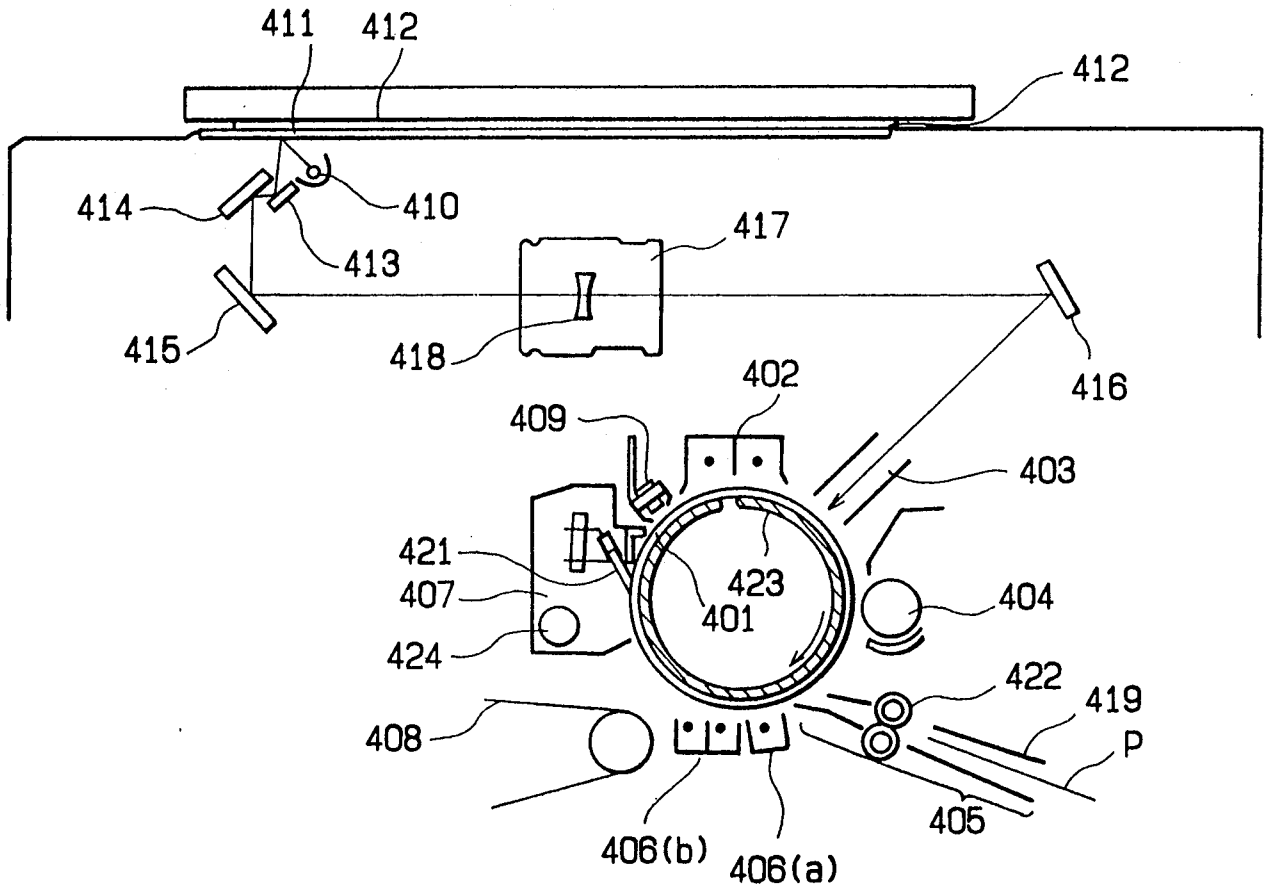
FIG. 4 is a schematic explanatory view illustrating the constitution of a conventional electrophotographic copying system.

The constitution of the electrophotographic copying system shown in FIG. 2 is the same as that of the electrophotographic copying system shown in FIG. 4, except that the former is provided with a magnetic roller 221 in the cleaning mechanism, a specific amorphous silicon light receiving member 201 according to the present invention and a development mechanism 204 charged with a specific fine particle insulating toner according to the present invention.

Anyway, as shown in FIG. 2, near the cylindrical amorphous silicon light receiving member 201 having the configuration as shown FIG. 1 which rotates in the direction indicated by an arrow, there are provided a main corona charger 202, an electrostatic latent image-forming mechanism 203, the development mechanism 204 charged with the fine particle insulating toner of 4.5 to 9 μm in volume average particle size, a transfer sheet feeding mechanism 205, a transfer charger 206(*a*), a separating charger 206(*b*), a cleaning mechanism 207, a transfer sheet conveying mechanism 208 and a charge-removing lamp 209.

The foregoing cylindrical amorphous silicon light receiving member 201 is maintained at a predetermined temperature by a heater 223. The cylindrical amorphous silicon light receiving member 201 is uniformly charged by the main corona charger 202 to which a predetermined voltage is impressed. Then, an original 212 to be copied which is placed on a contact glass 211 is irradiated with a light from a halogen lamp 210 through the contact glass 211 and the resulting reflected light is projected through mirrors 213, 214 and 215, a lens system 217 containing a filter 218, and a mirror 216 onto the surface of the cylindrical amorphous silicon light receiving member 201 to form an electrostatic latent image corresponding to the original 212.

This electrostatic latent image is developed with the foregoing fine particle insulating toner supplied by the development mechanism 204 to provide a toner image. A transfer sheet P is supplied through the transfer sheet feeding mechanism 205 comprising a transfer sheet guide 219 and a pair of feed timing rollers 222 so that the transfer sheet P is brought into contact with the surface of the cylindrical amorphous silicon light receiving member 201, and corona charging is effected with the polarity different to that of the said toner from the rear of the transfer sheet P by the transfer charger 206(*a*) to which a predetermined voltage is applied in order to transfer the toner image onto the transfer sheet P. The transfer sheet P having the toner image transferred thereon is electrostatically removed from the cylindrical amorphous silicon light receiving member 201 by the charge-removing action of the separating corona charger 206(*b*) where a predetermined AC voltage is impressed, then conveyed by the transfer sheet conveying mechanism 208 to a fixing zone (not shown) where the toner image on the transfer sheet P is fixed, and taken out from the system.

The cylindrical amorphous silicon light receiving member 201 arrives at the cleaning mechanism 207 comprising a cleaning blade 221, the magnetic roller 224 and a feed-screw 225, where magnetic particles contained in the residual toner on said light receiving member are firstly removed by the action of the toner brush formed on the magnetic roller 224, then said light receiving member is polished by the cleaning blade 221 to thereby remove other remaining materials on the surface thereof without the surface layer of the cylindrical amorphous silicon light receiving member 201 being worn.

The thus removed magnetic materials and other materials are discharged through the feedscrew 225.

Thereafter, the cylindrical amorphous silicon light receiving member 201 thus cleaned with its surface is entirely exposed to light by the charge-removing lamp 209 to erase the residual charge and is recycled.

The above magnetic roller 224 to be provided in the cleaning mechanism 207 comprises a spindle made of a metal such as aluminum, the surface of which being coated with magnetic ferrite materials by a conventional method or being coated a composition composed of a binder resin and magnetic ferrite powder by applying an emulsion containing said binder resin and magnetic ferrite powder onto said surface by means of an injection moulder. The magnetic force at the surface of the magnetic roller is desired to be 900 to 1000 Gauss.

In the electrophotographic copying system in which the electrophotographic image-forming method of the present invention is to be practiced, it is possible to provide a metal oxide catalyst system ozone-removing filter behind the main charger (202 in FIG. 2).

Figure 6:
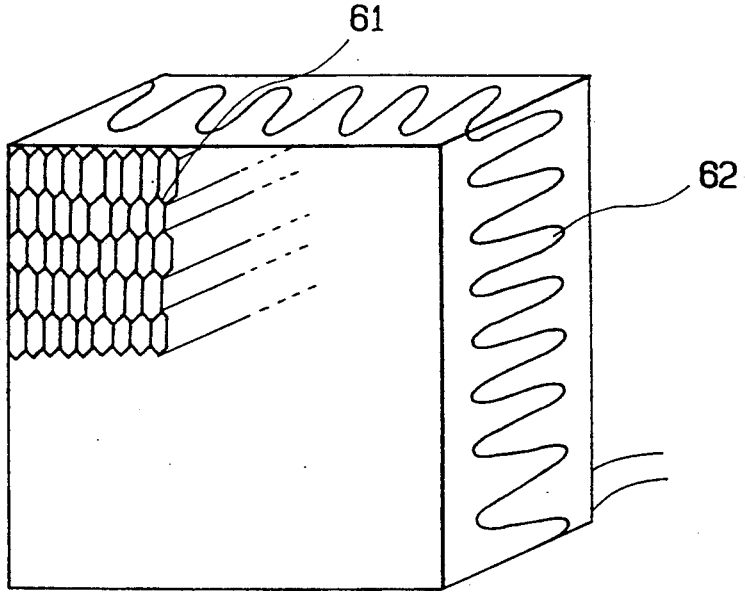
FIG. 6 is a schematic view illustrating the constitution of a honeycomb structured ozone-removing filter to be used in the present invention.
Figure 7:
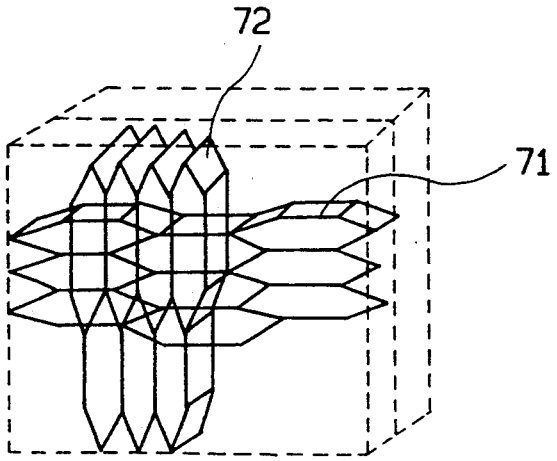
FIG. 7 is a schematic view illustrating the constitution of another honeycomb structured ozone-removing filter to be used in the present invention.
Figure 8:
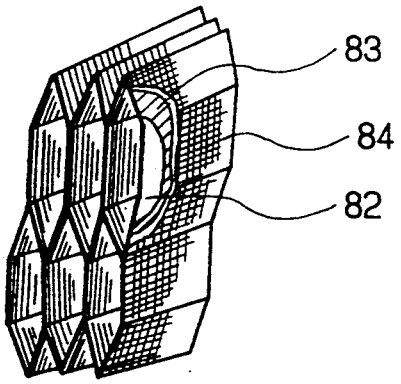
FIG. 8 is a schematic explanatory view of the typical honeycomb structure for the ozone-removing filter to be used in the present invention.
Figure 9:
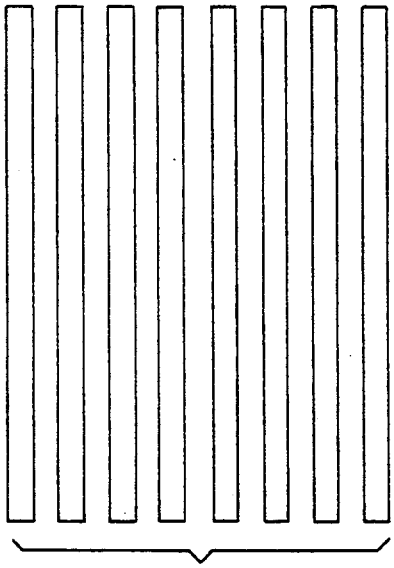
FIG. 9 is a schematic explanatory view of a resolution evaluating chart which is used in the experiments which will be later described.

As such metal oxide catalyst system ozone-removing filter, there can be mentioned, for example, those shown in FIGS. 6 through 8.

The ozone-removing filter shown in FIG. 6 comprises a honeycomb structured filter body 61 formed of a metal sheet coated with a catalyst, which is coiled by a ribbon-like electric heater 62 to activate the heneycomb structured filter body.

The honeycomb structured filter body 61 may be produced, for example, by forming a honeycomb structure of 70 mm (width)× 70 mm (length)×15 mm (depth) containing a plurality of cells made of an aluminum sheet, each of said cells comprising a hexagonal cell having a 1.5 mm side and of 15 mm in depth which is formed by compressing an equilateral hexagonal cylinder of 1.5 mm in side size and 15 mm in depth to one third for the distance between the two opposed sides, and dipping it in a dispersion containing a binder resin and a catalyst to thereby coat the surface of each of the cells with the catalyst. The honeycomb structured filter body thus obtained has an apertured proportion of about 75% and a surface area of about 20 $cm^2$ capable of contacting with air containing ozone per 1 $cm^3$. And the pressure loss when air containing ozone is passed through at a flow velocity of 2 m/sec. is 1.5 mm Aq, which is surpasses any of the known ozone-removing filters made of a paper or ceramics, the pressure loss of each of them being 3.5 mm Aq and 1.8 mm Aq, respectively.

In a further preferred embodiment, the homeycomb structured filter body is so designed as shown in FIG. 7. The honeycomb structured filter body shown in FIG. 7 comprises (i) a plurality of the foregoing hexagonal cells 72 being arranged in the lengthwise direction and (ii) a plurality of the foregoing hexagonal cells 71 being arranged in the cross direction, the hexagonal cells (i) and the hexagonal cells (ii) being crossed with each other so as to form a angle of around 90° between the two crossed orientation faces. In this case, as the honeycomb structured filter body has a sufficient self-supporting strength by itself, it is not necessary to be provided with a supporting frame.

And the honeycomb structured filter body shown in FIG. 7 is further advantageous in removing ozone.

FIG. 8 is a schematic explanatory view for detailing a portion comprising a plurality of the foregoing hexagonal cells for the above honeycomb structured filter body, wherein numeral reference 82 stands for a base member comprising an aluminum sheet which constitutes each of the hexagonal cells, and numeral reference 83 stands for an undercoat resin layer capable of preventing a metal oxide catalyst layer 84 formed thereon from peeling off because of vibration or thermal distortion.

As the resin to constitute the undercoat layer 83, a resin which is heat-resistant, capable of being well adhered to the aluminum base member 82 and well compatible with the metal oxide catalyst layer 84 such as acrylic resins is desirable. As the metal oxide catalyst to constitute the metal oxide catalyst layer 84, there can be mentioned, for example, oxides of Cu, Mn, Ti, Si, etc. In order to form the metal oxide catalyst layer 84, at least one of the foregoing metal oxides is dispersed in a solution of binder resin such as acrylic resin to prepare a coating liquid, which is then applied onto the previously formed undercoat layer.

The ozone-removing filter thus prepared maintains the catalytic activity at a temperature up to about 200° C.

When the ozone-removing filter is used in the electrophotographic image-forming method of the present invention, heated air containing ozone ($O_3$) generated near the charger is passed through the ozone-removing filter while heating it to activate the metal oxide catalyst where said ozone is contacted with said activated metal oxide catalyst to decompose into oxygen ($O_2$) which is successively exhausted.

The effects of the present invention will be made apparent by the following experiments.

EXPERIMENT 1

There were prepared twelve cylindrical light receiving member samples (Samples Nos. 1 to 12) of the type shown in FIG. 1(B) which comprises a cylindrical substrate 101 and a light receiving layer 102', said light receiving layer comprising a charge injection inhibition layer 106, a photoconductive layer 103, a latent image support layer 104 and a developed image support layer 105 being laminated in this order on the cylindrical substrate, in accordance with the foregoing layer forming manner by using the RF plasma CVD apparatus shown in FIG. 5 under the film forming conditions shown in Table 1, wherein the conditions for forming the developed image support layer were changed as shown in Table 1 and the conditions for forming the developed image support layer were varied as shown in Table 2. In each case, as the cylindrical substrate 101, there was used an aluminum cylinder of 108 mm in outer diameter, 358 mm in length and 5 mm in thickness.

Separately, there were prepared a plurality of fine particle insulating toners each having a different volume average particle size at an interval of 1.5 μm in the range of about 3 μm to about 12 μm by repeating the procedures of Tonor Production Example 1.

The electrophotographic image-forming method was carried out by setting each of the resultant cylindrical light receiving member samples (Samples Nos. 1 to 12) to a modification of a commercially available CANON NP-7550 Electrophotographic Copying Machine for use in experimental purposes which has basically the same constitution as that shown in FIG. 2 and wherein the development mechanism being charged with each of the resultant fine particle insulating toners, and repeating the foregoing image-forming procedures in the case of the electrophotographic image-forming system shown in FIG. 2. In each case, the surface temperature of the cylindrical light receiving member sample was changed in the range of about 5° C. to about 50° C.

In each case, images were reproduced to evaluate the resolution and tone reproduction in the interrelations among the cylindrical light receiving member sample used, its surface temperature upon image formation and the fine particle insulating toner used.

In the evaluation of the resolution, there was used a test chart having a plurality of black color portions of a regular width a and a plurality of white color portions of a regular width a being arranged alternately and regularly as shown in FIG. 6. Each width a of the white color portion between each pair of the black color portions on the test chart was narrowed and the test chart was subjected to reproduction, to thereby evaluate its minimum width a which can be resolved. That is, when each width a of the white color portion between each pair of the black color portions on the test chart is narrowed to a certain width or less and the test chart is subjected to reproduction, the resulting image contains minute unfocused images of the profiles of the adjacent black color proportions being overlapped. This case is meant to show that the resolution is practically impossible. For this reason, the width a of the white color portion when it makes impossible to resolve the image was made to be a value for the resolution.

In the evaluation of the tone reproduction, there was used a test chart on which three black solid circles respectively of 0.3, 0.5 and 1.1 in optical density are arranged. The test chart was subjected to reproduction such that a black solid circle image of 0.3 optical density and a black solid circle image of 1.1 optical density respectively corresponding to the original black solid circle of 0.3 optical density and the original black solid circle of 1.1 optical density were obtained.

And the evaluation of the tone reproduction was made based on the resultant image reproduced from the remaining original black solid circle of 0.5 optical density. That is, the absolute value of a difference of optical density difference between the optical density of 0.5 for the original black solid circle and the optical density of the black solid circle image reproduced therefrom was made to be a value for the tone reproduction.

The evaluated results as obtained with respect to the resolution for each of the cylindrical light receiving member samples (Samples Nos. 1 to 12) were collectively shown respectively in FIGS. 10a to 21b.

Figures 37A, 37B:
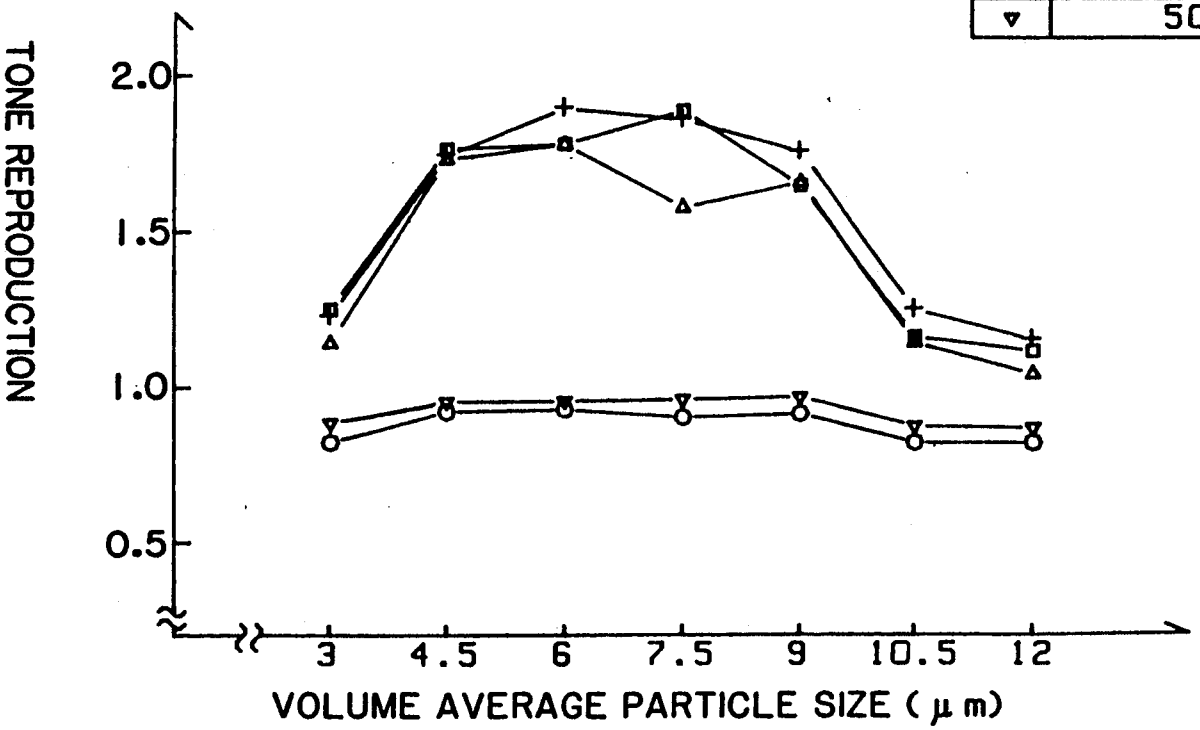
Figures 38A, 38B:
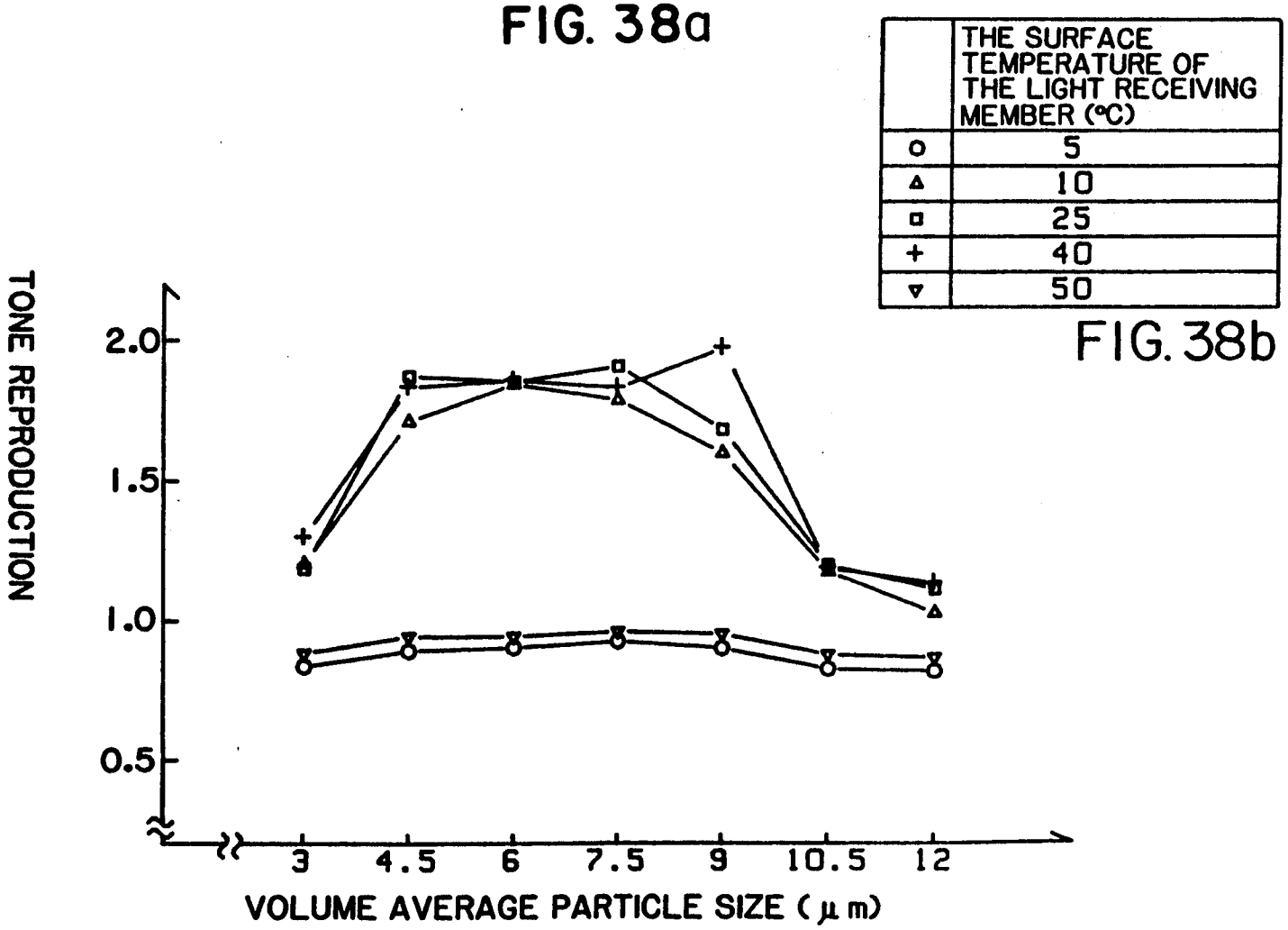
Figures 39A, 39B:
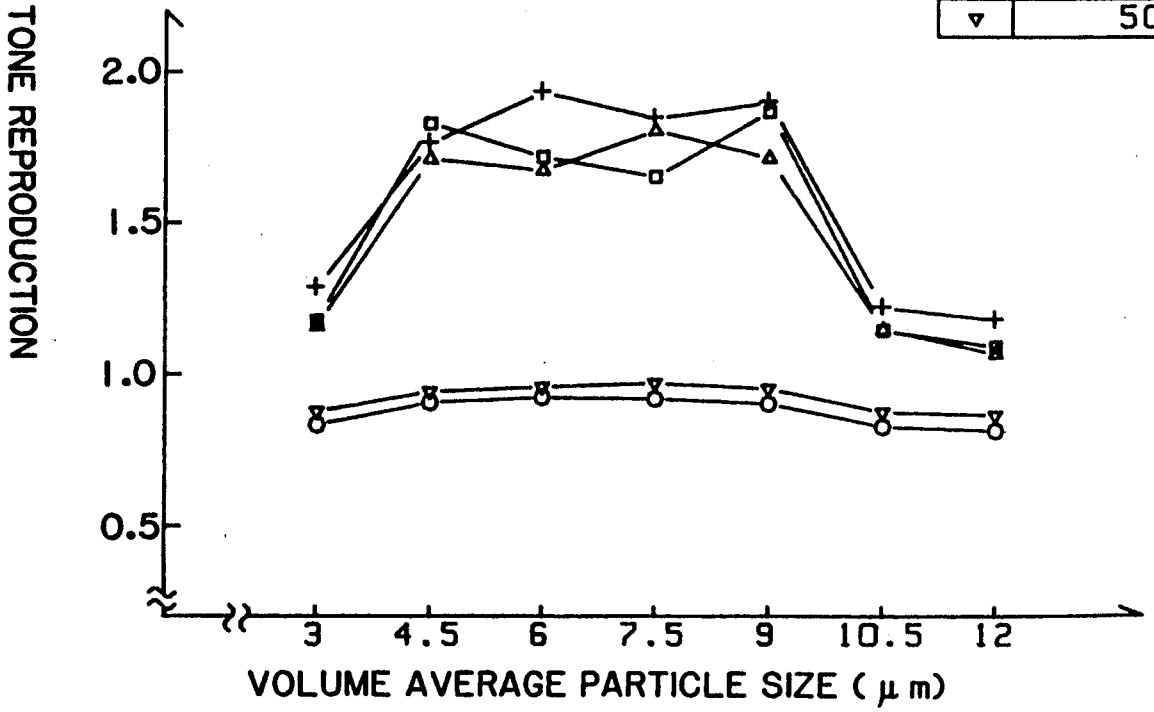
Figures 40A, 40B:
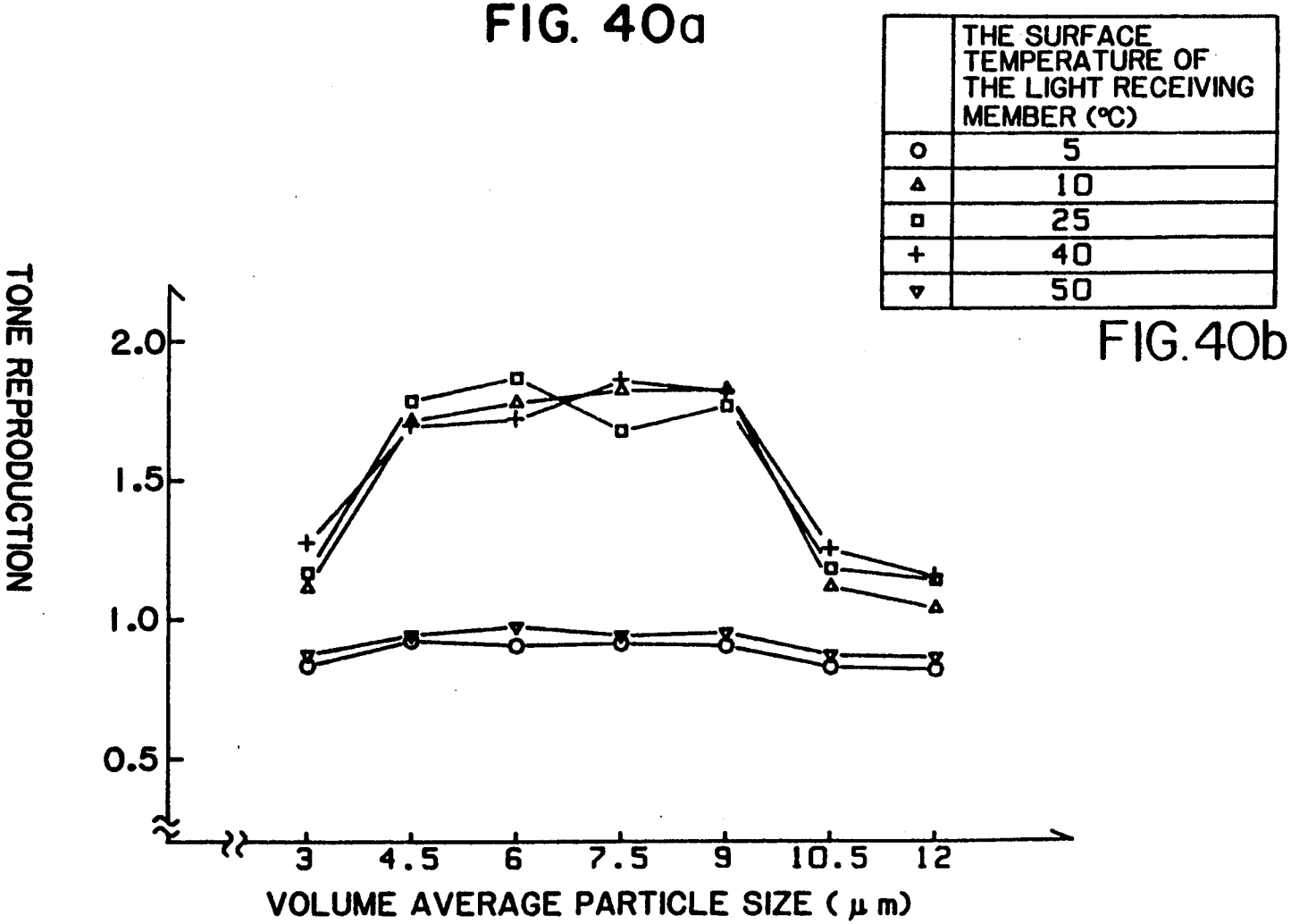
Figures 41A, 41B:
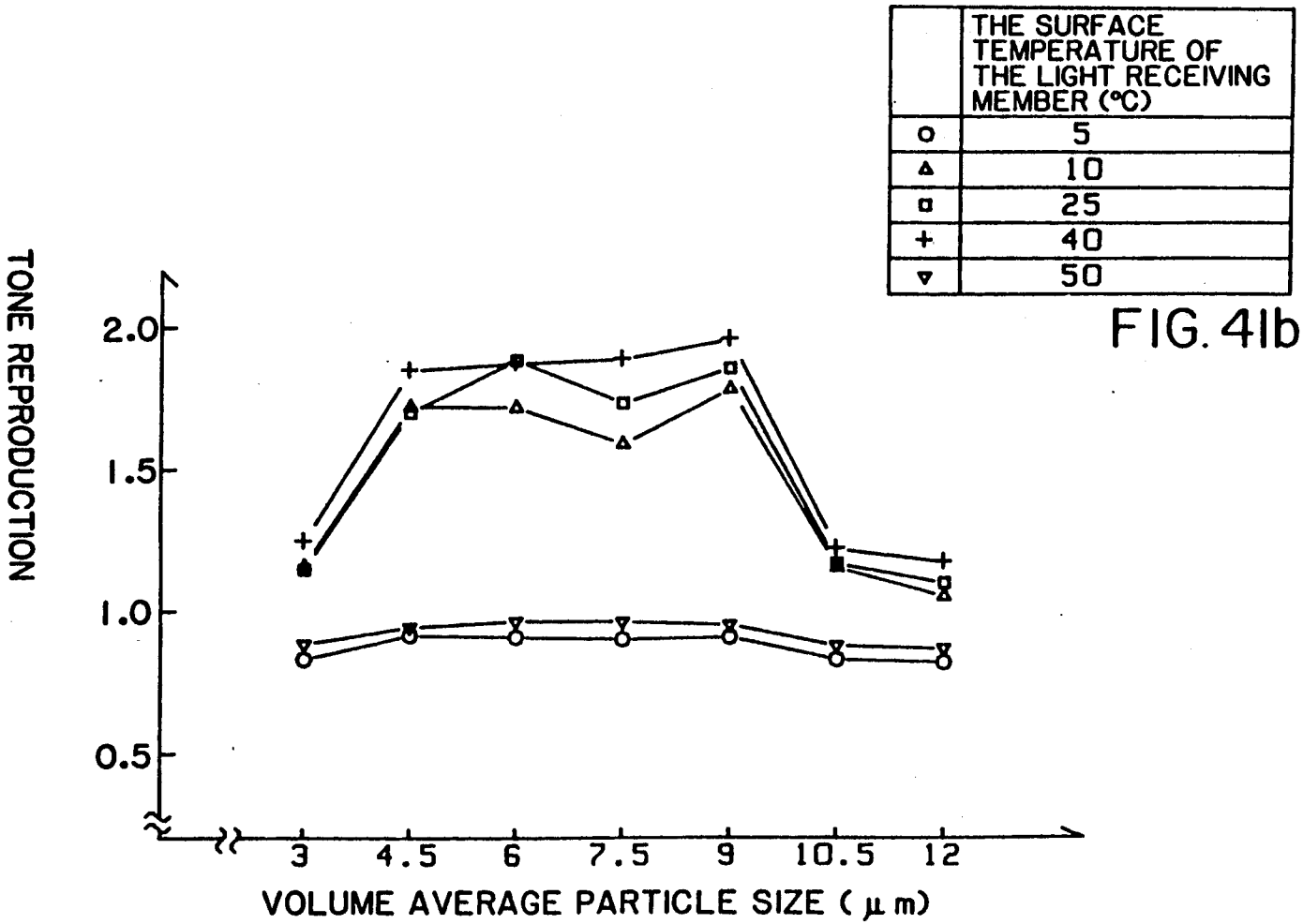
Figures 42A, 42B:
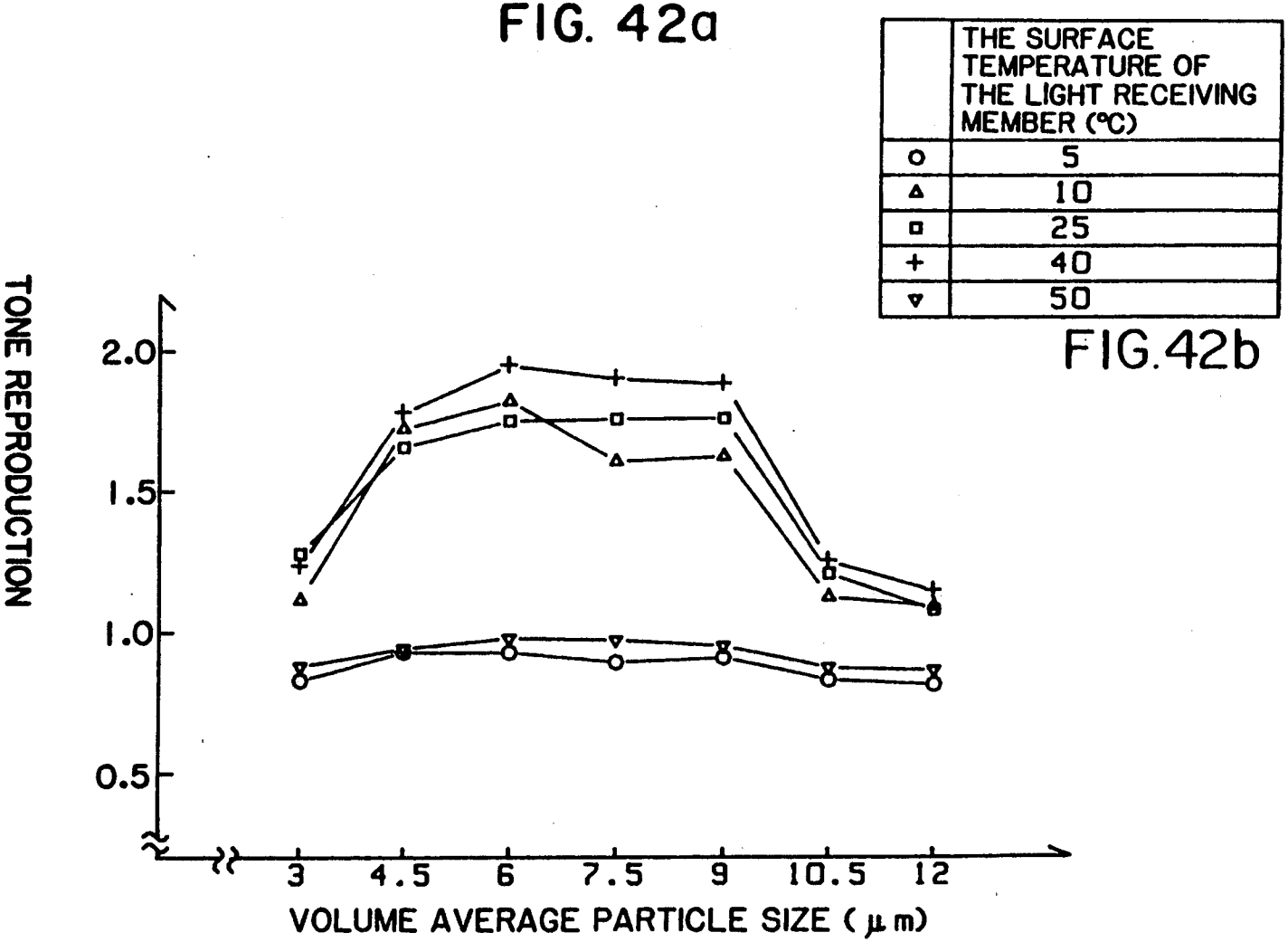
Figures 43A, 43B:
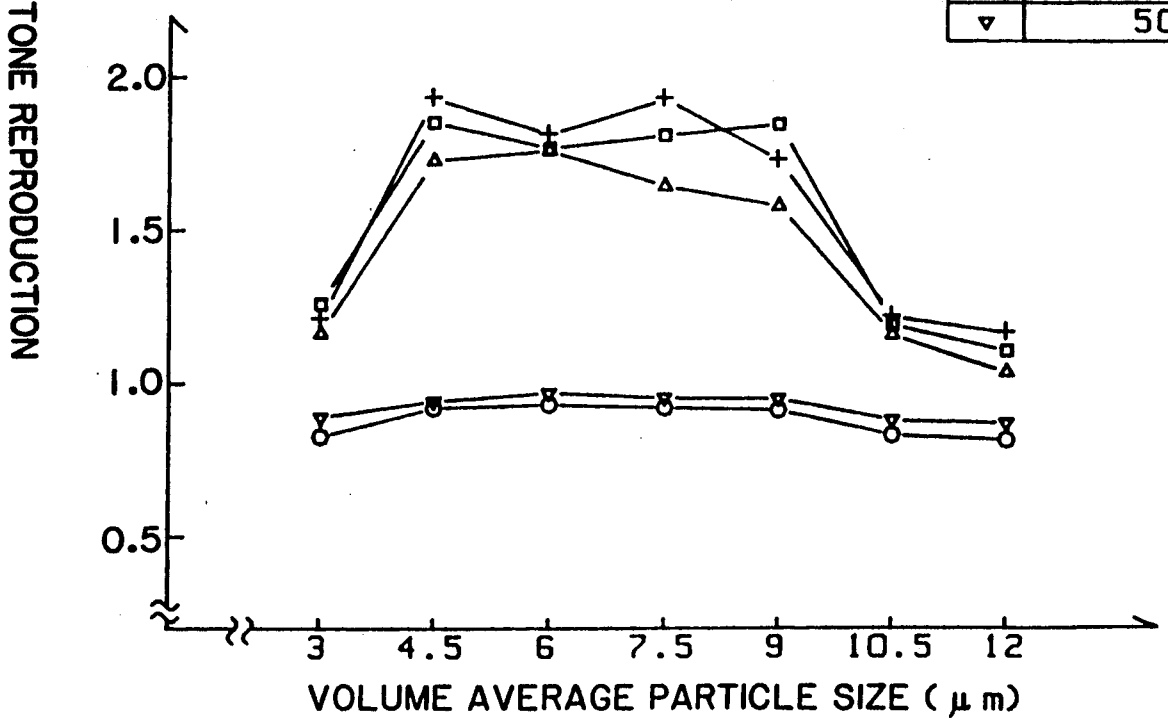
Figures 44A, 44B:
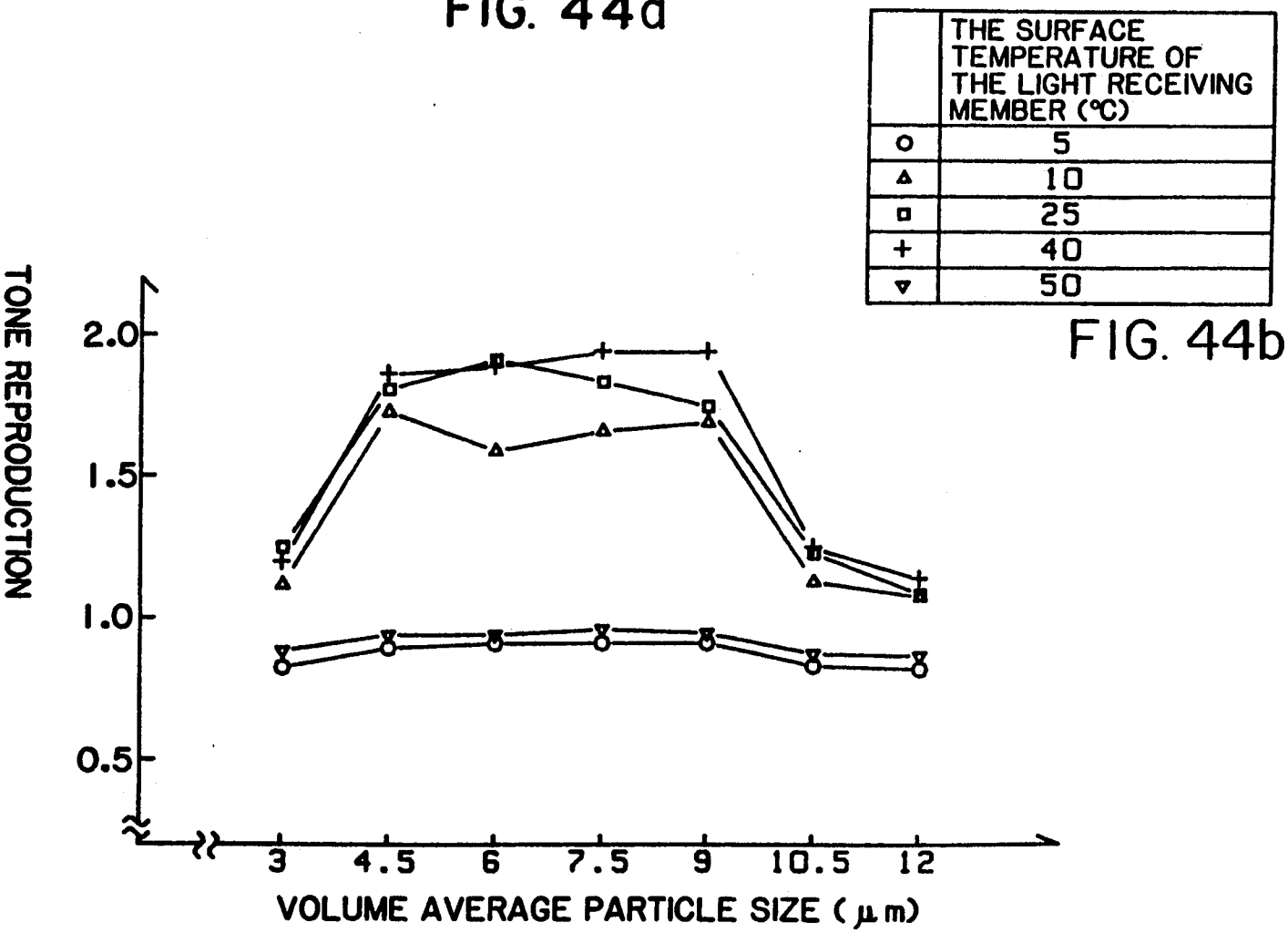
Figures 45A, 45B:
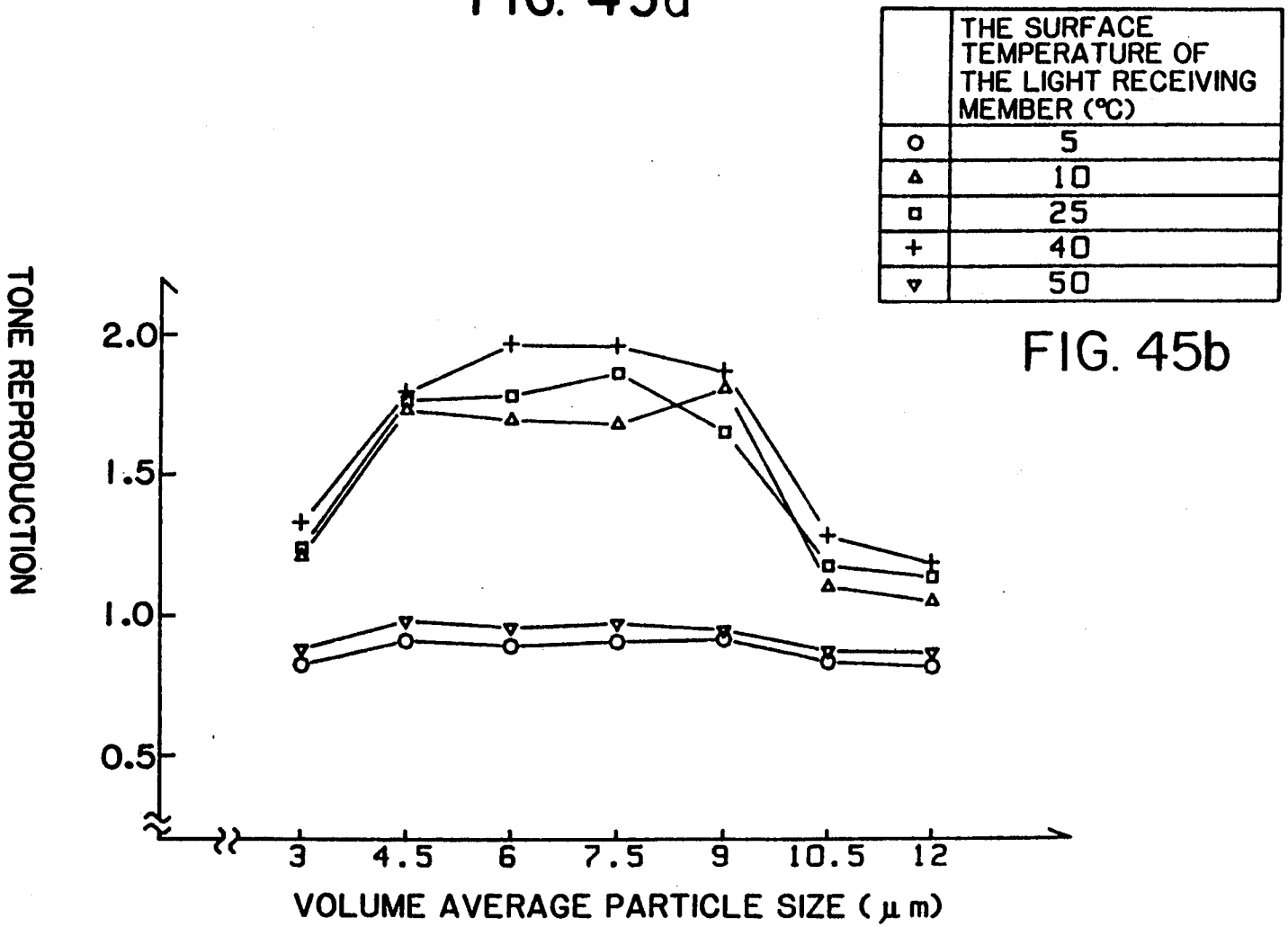
Figures 46A, 46B:
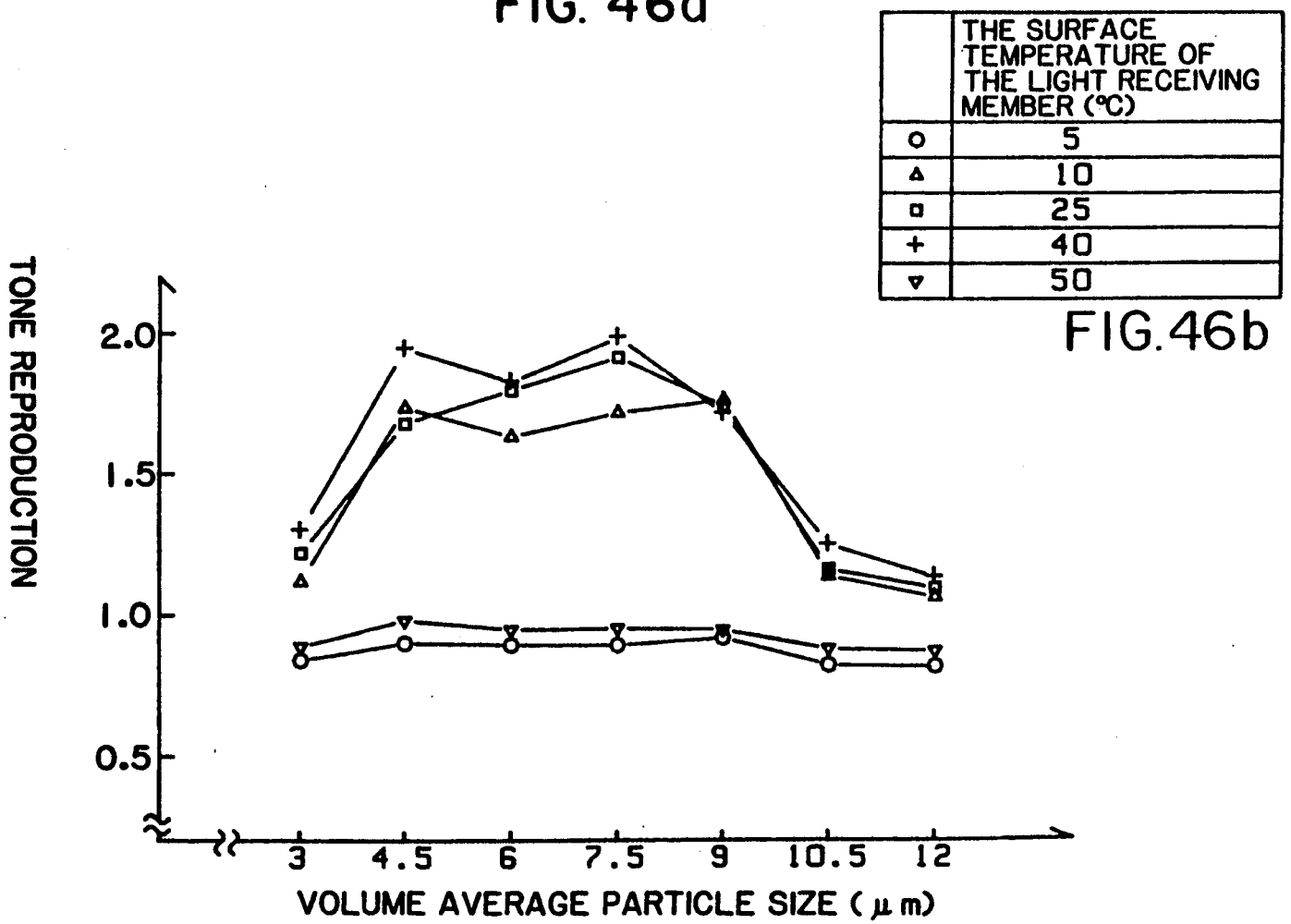
Figures 47A, 47B:
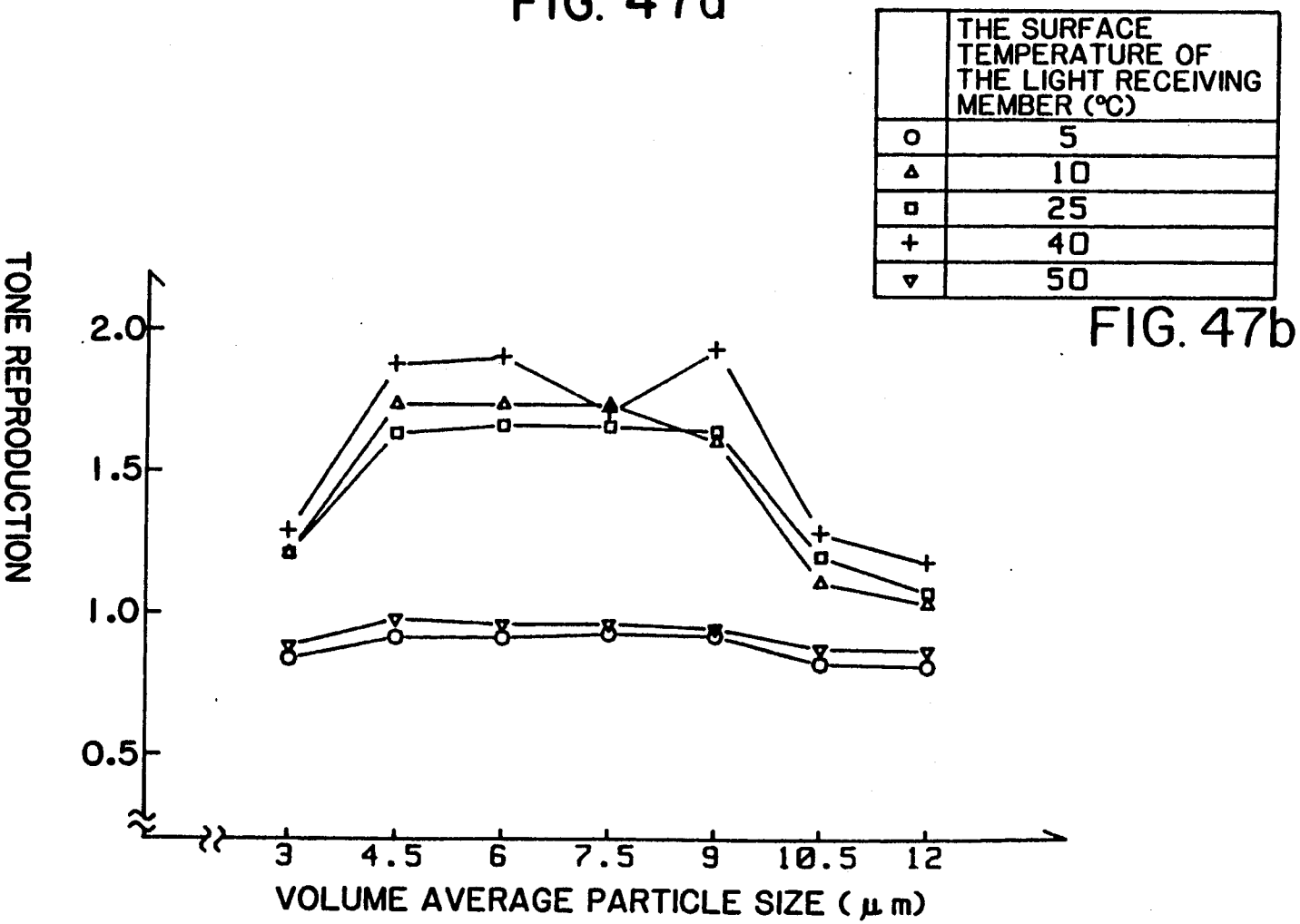
Figures 48A, 48B:
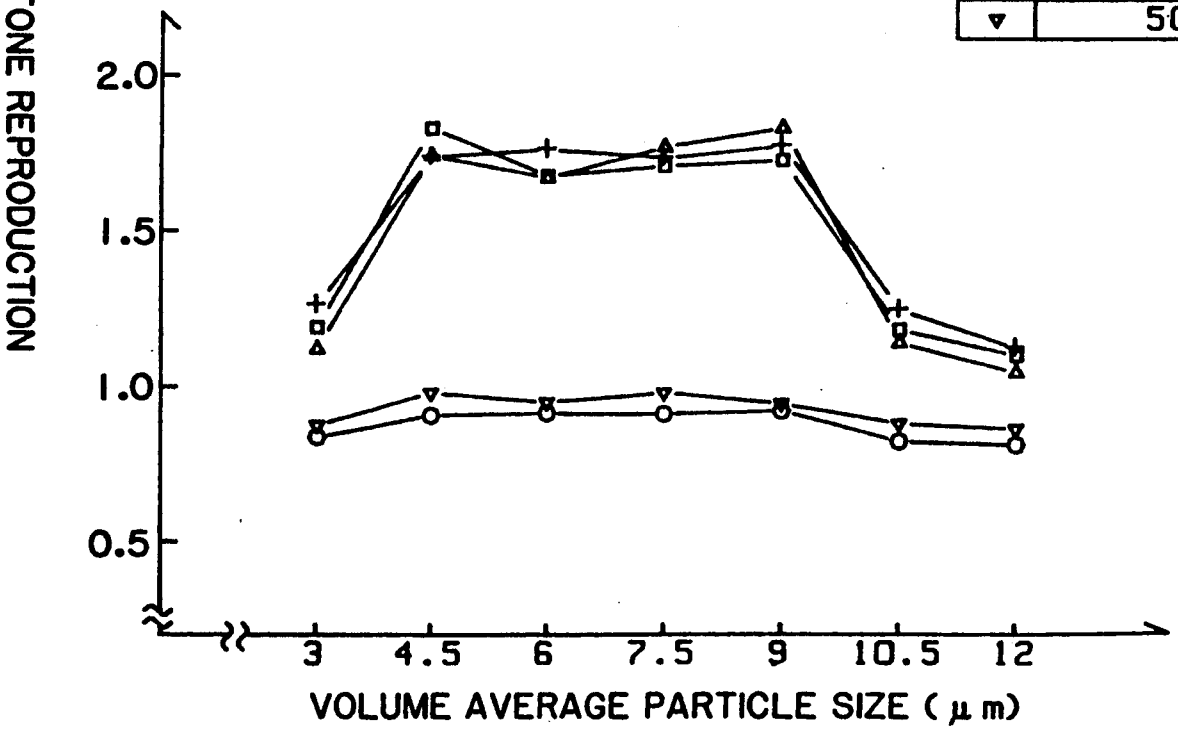

The evaluated results as obtained with respect to the tone reproduction for each of the cylindrical light receiving member samples (Samples Nos. 1 to 12) were collectively shown respectively in FIGS. 37a 48b.

All the values plotted in each of FIGS. 10 to 21 and also in each of FIGS. 37a to 48b are relative values obtained when the value for the resolution and the value for the tone reproduction obtained in the undermentioned Comparative Example 1 when the fine particle insulating toner of about 12 μm in volume average particle size was used and the surface temperature of the comparative cylindrical light receiving member sample (Comparative Sample No. 1) was maintained at 25° C. were respectively made to be 1 (that is the control).

COMPARATIVE EXPERIMENT 1

Figure 3:
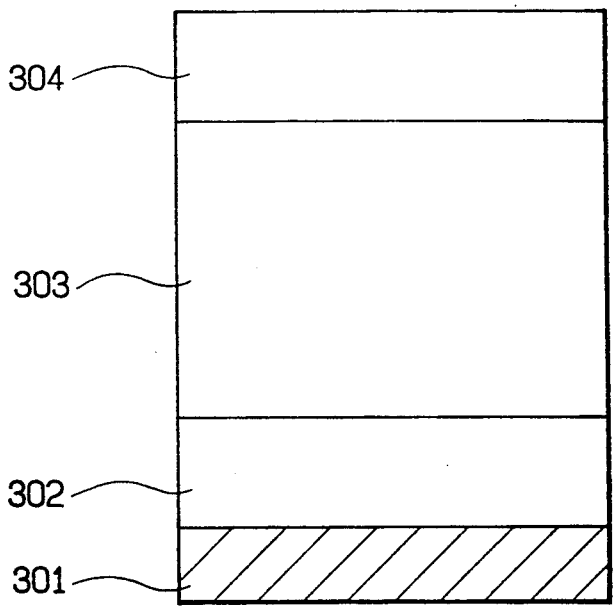
FIG. 3 is a schematic view illustrating the layer constitution of a conventional light receiving member.

There was prepared a conventional cylindrical light receiving member sample of the configuration shown in FIG. 3 for comparative purposes (hereinafter referred to as "a comparative light receiving member" or "Comparative Sample No. 1") which comprises a cylindrical substrate 301 and a light receiving layer comprising a charge injection inhibition layer 302, a photoconductive layer 303 and a surface layer 304 in accordance with the layer forming manner using the RF plasma CVD apparatus shown in FIG. 5 under the film forming conditions shown in Table 3. As the cylindrical substrate 301, there was used an aluminum cylinder of 108 mm in outer diameter, 358 mm in length and 5 mm in thickness.

Using the comparative light receiving member sample (Comparative Sample No. 1) thus obtained, the electrophotographic image-forming process was carried out in the same manner as in Experiment 1. And evaluations of the resolution and tone reproduction were conducted in the same manner as in Experiment 1.

Figures 22A, 22B:
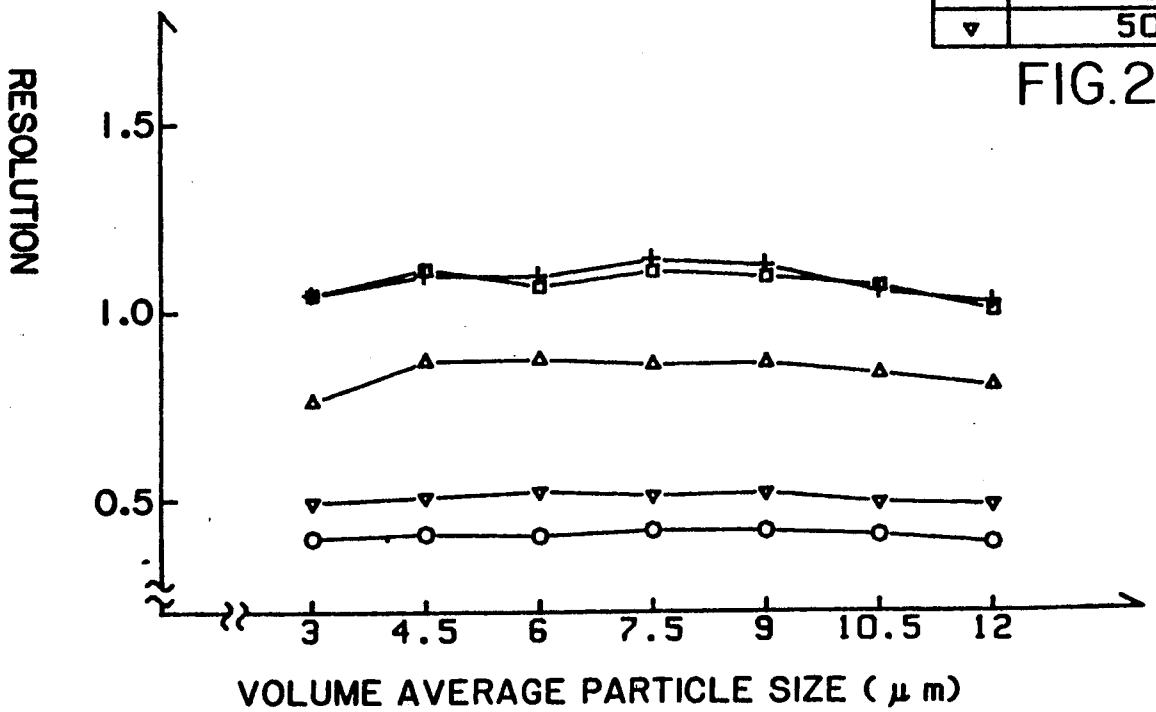
Figures 23A, 23B:
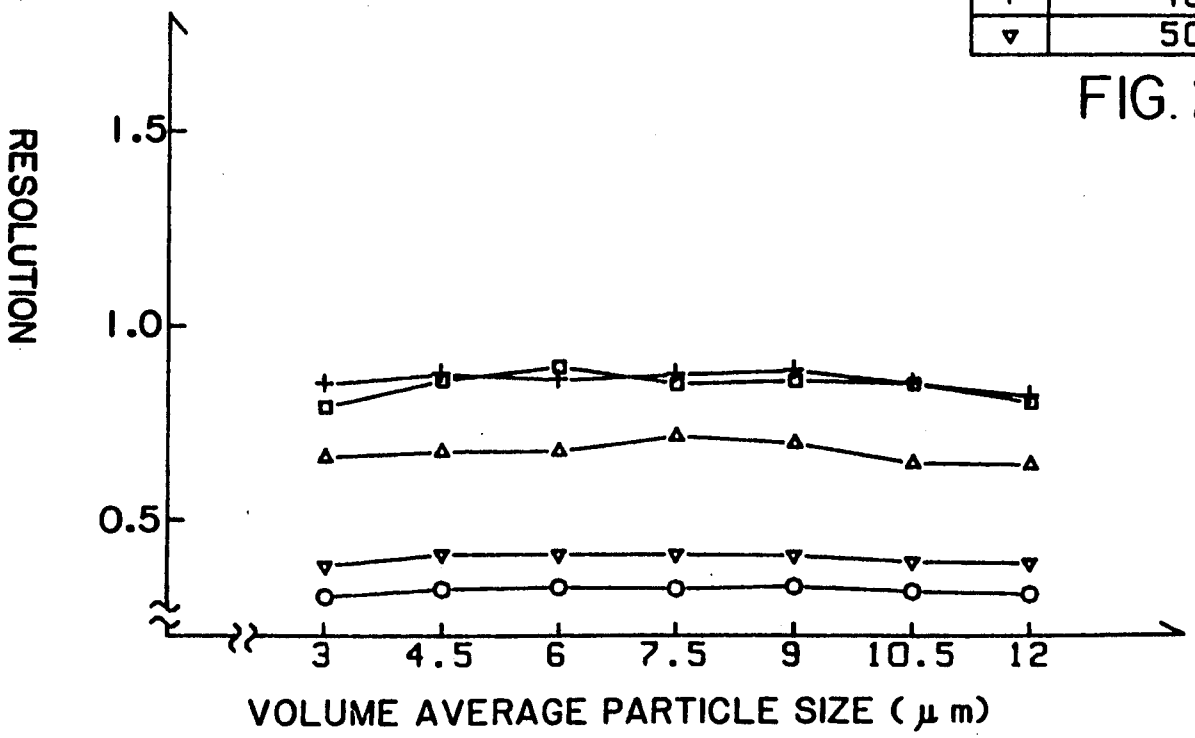
Figures 24A, 24B:
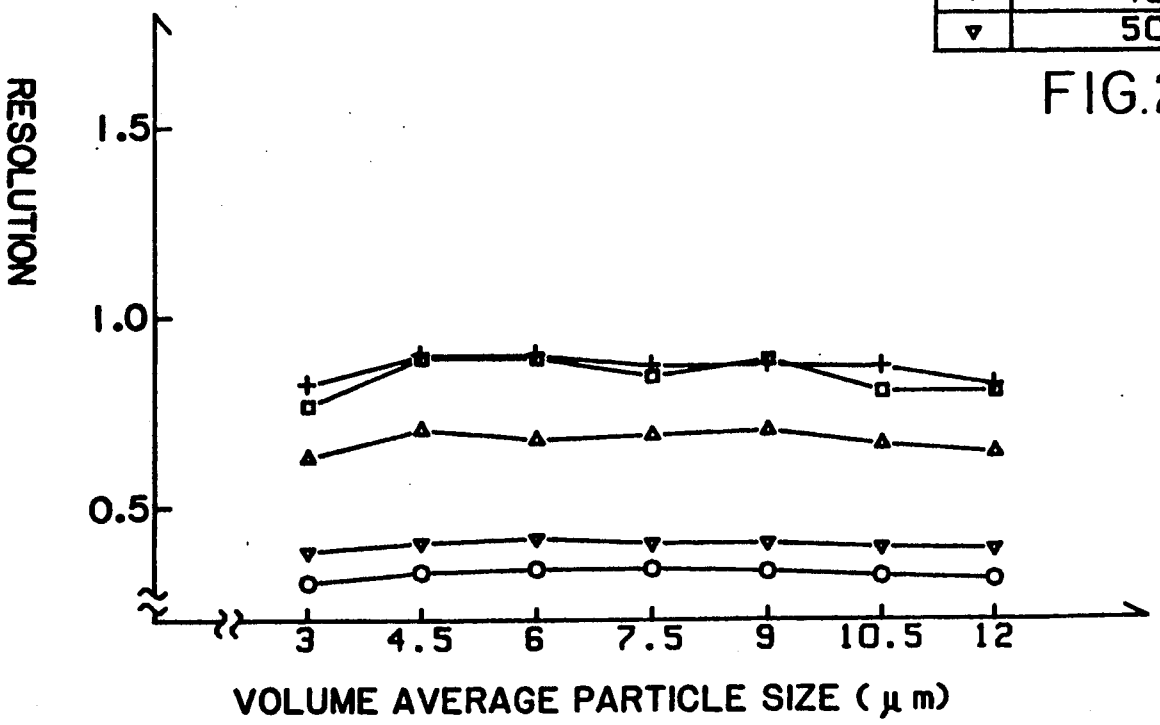
Figures 25A, 25B:
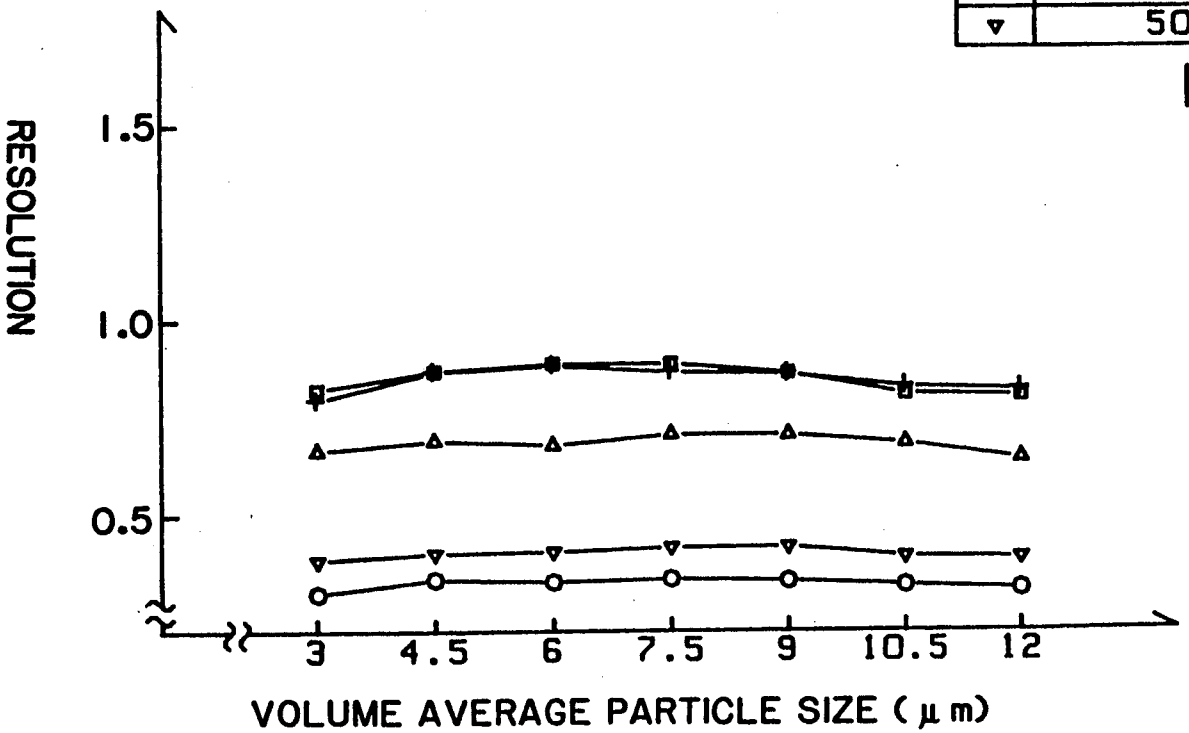
Figures 26A, 26B:
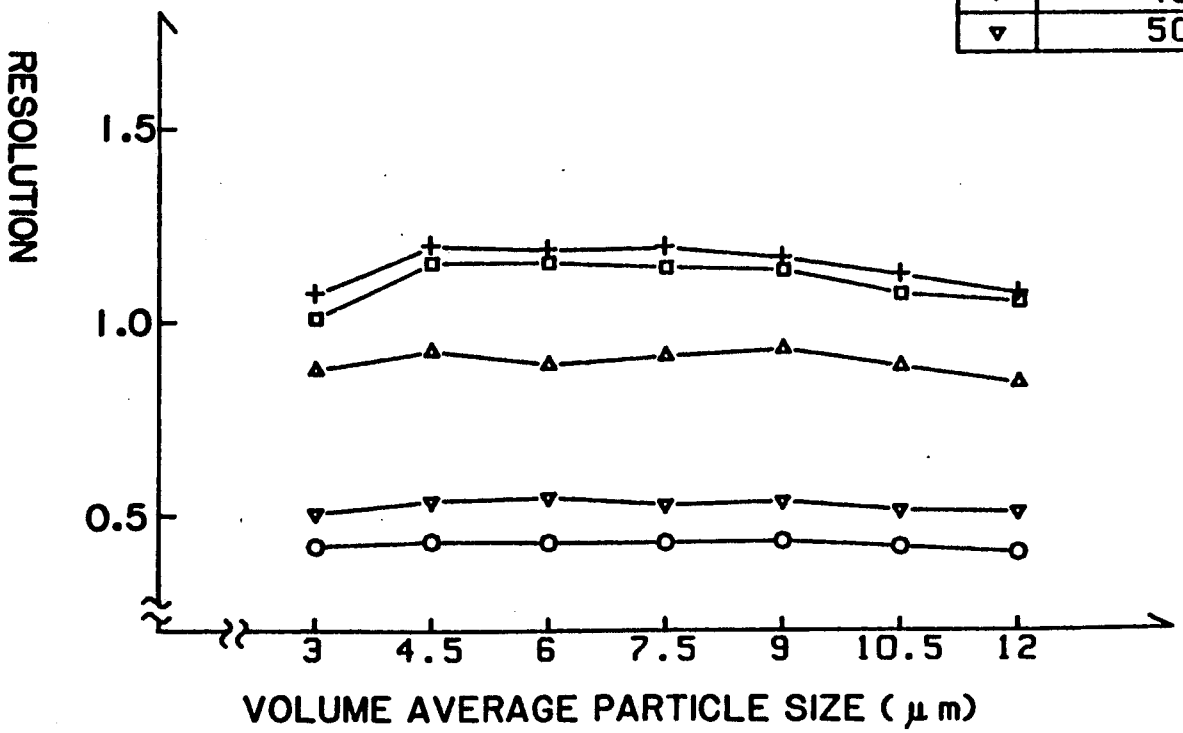
Figures 27A, 27B:
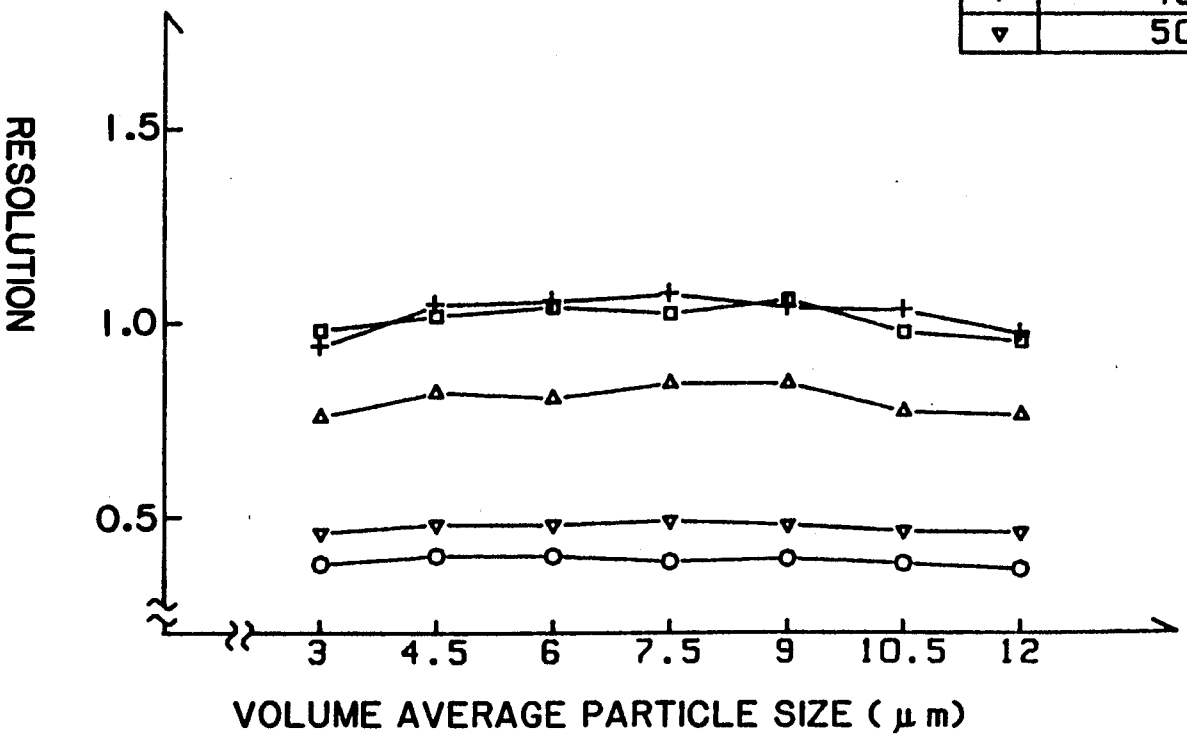
Figures 28A, 28B:
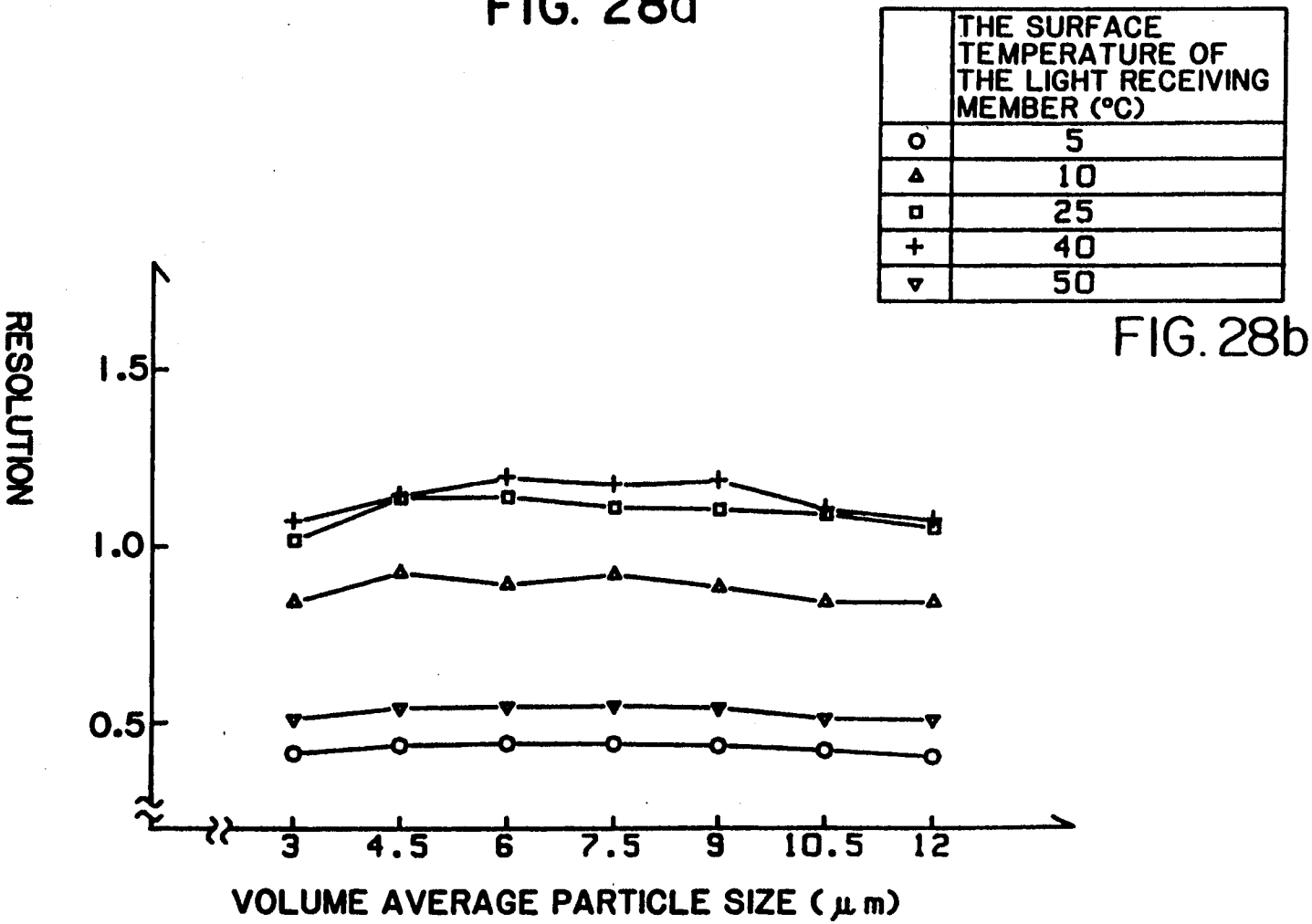
Figures 29A, 29B:
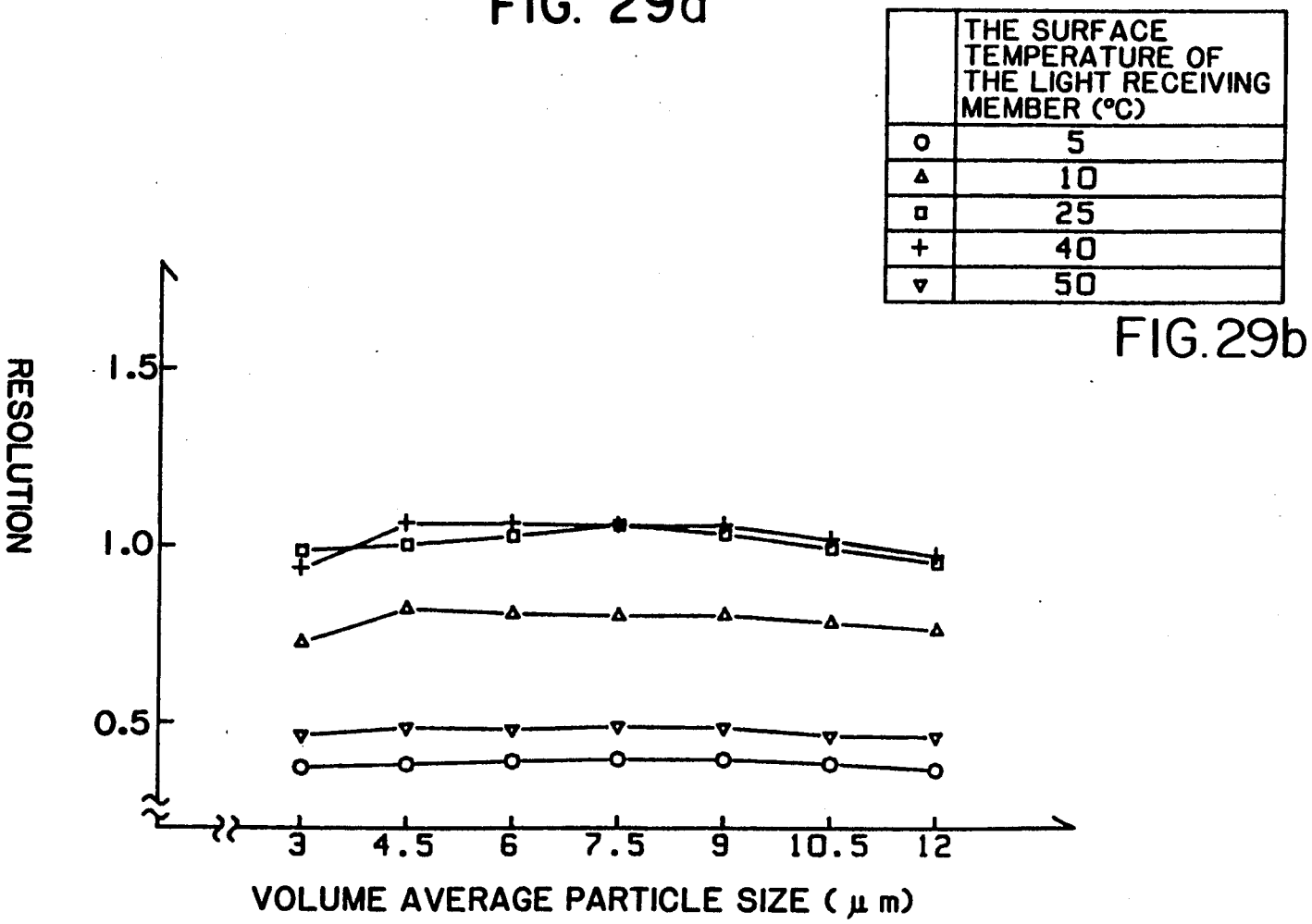
Figures 30A, 30B:
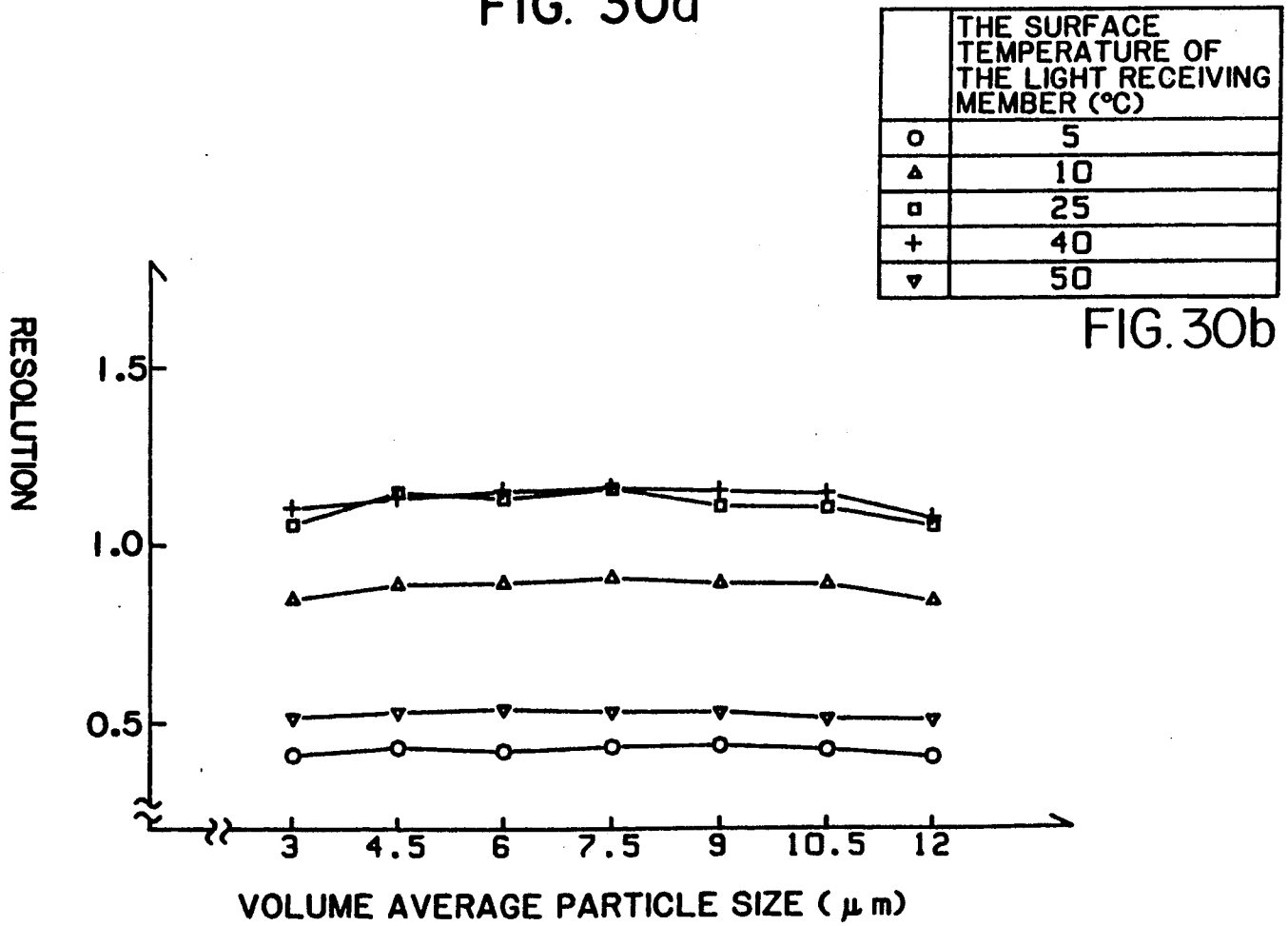
Figures 31A, 31B:
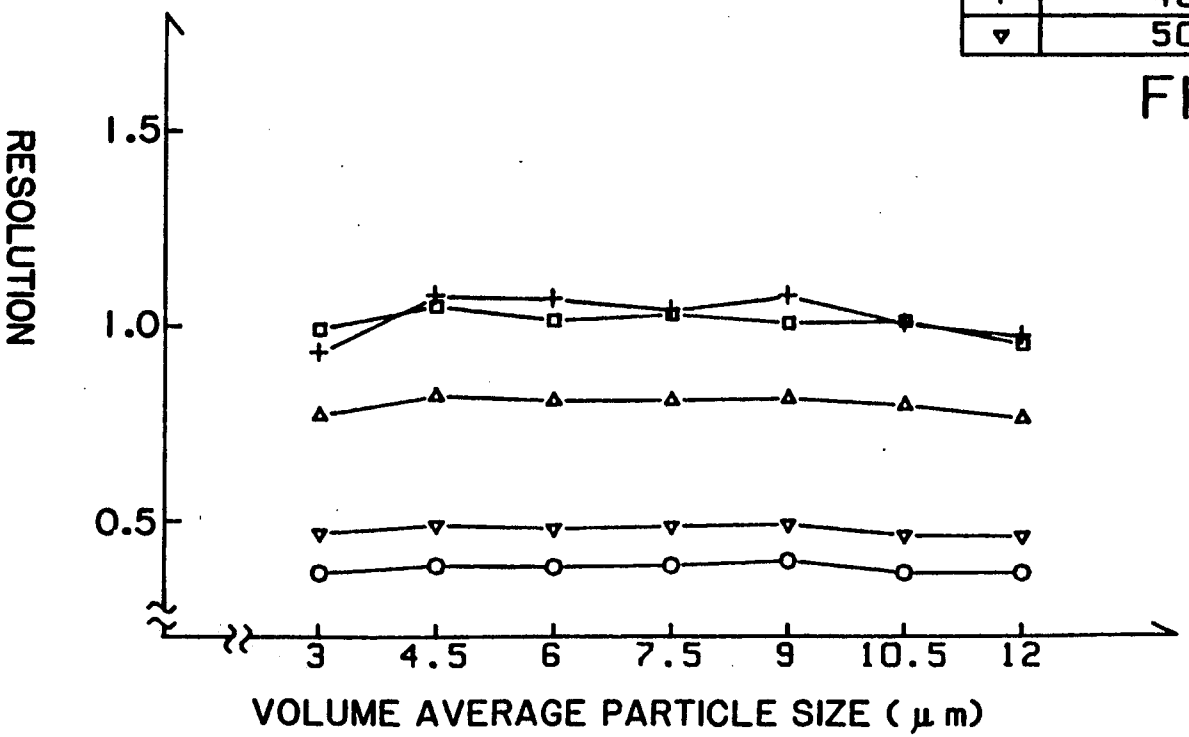
Figures 32A, 32B:
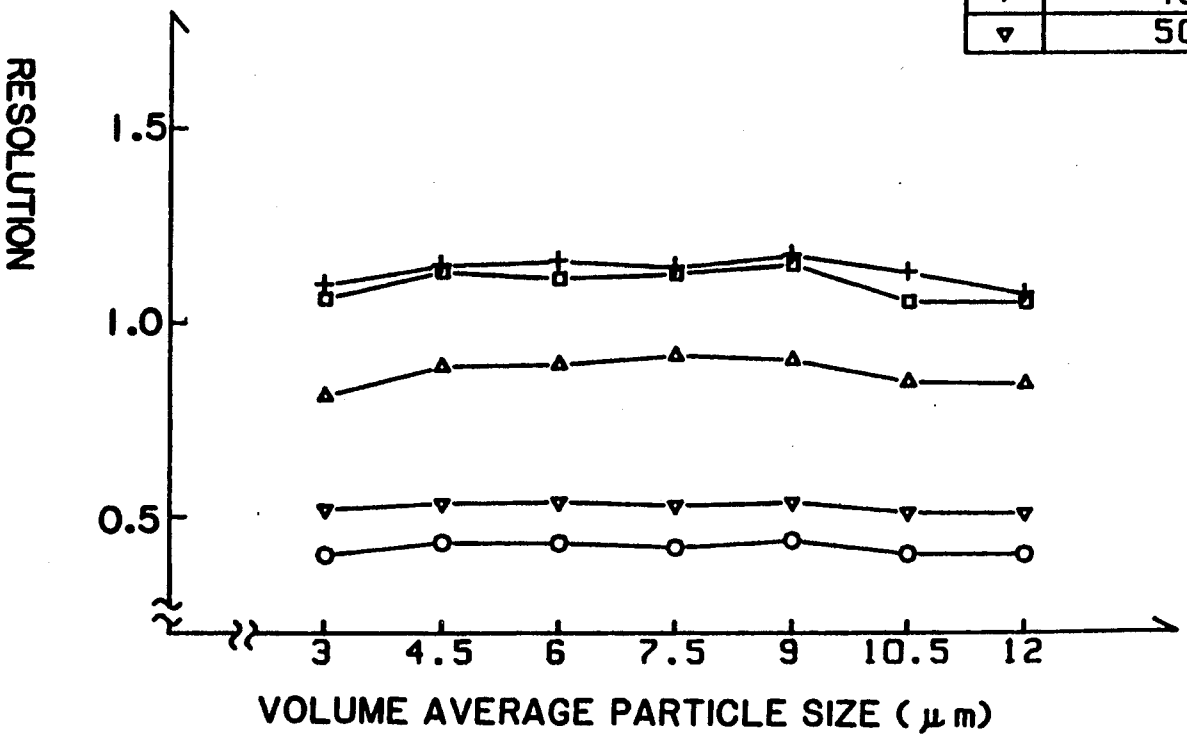
Figures 33A, 33B:
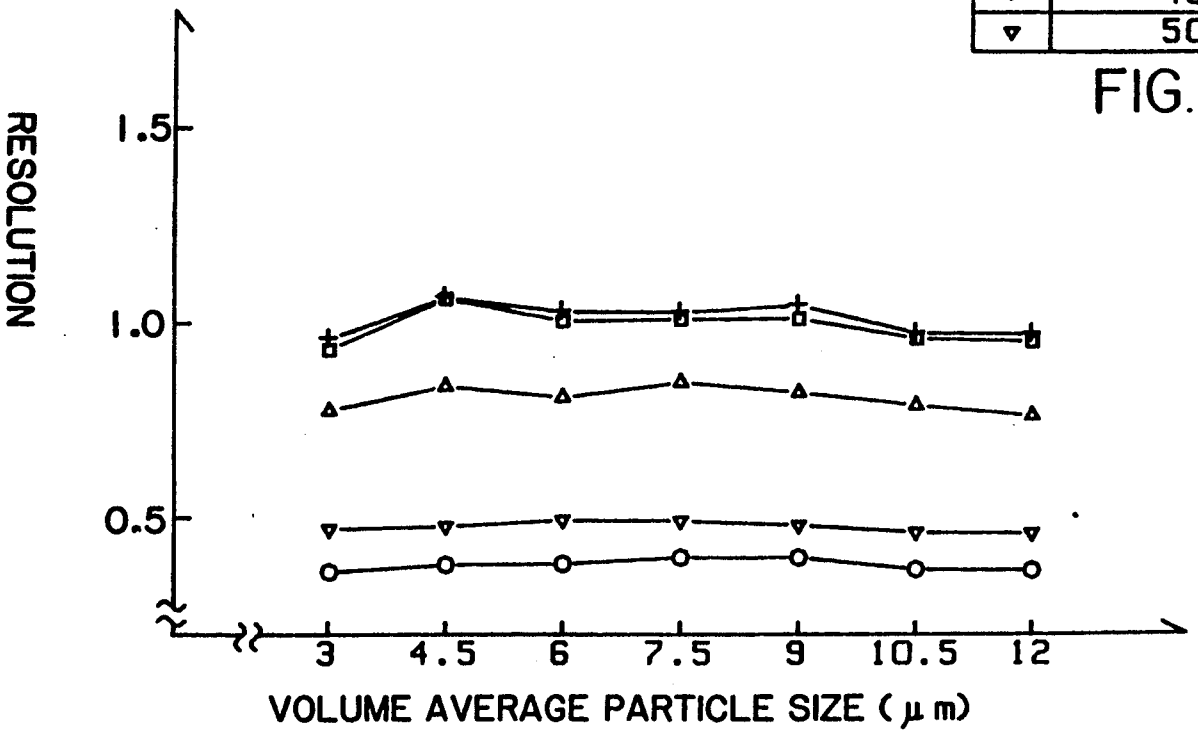
Figures 34A, 34B:
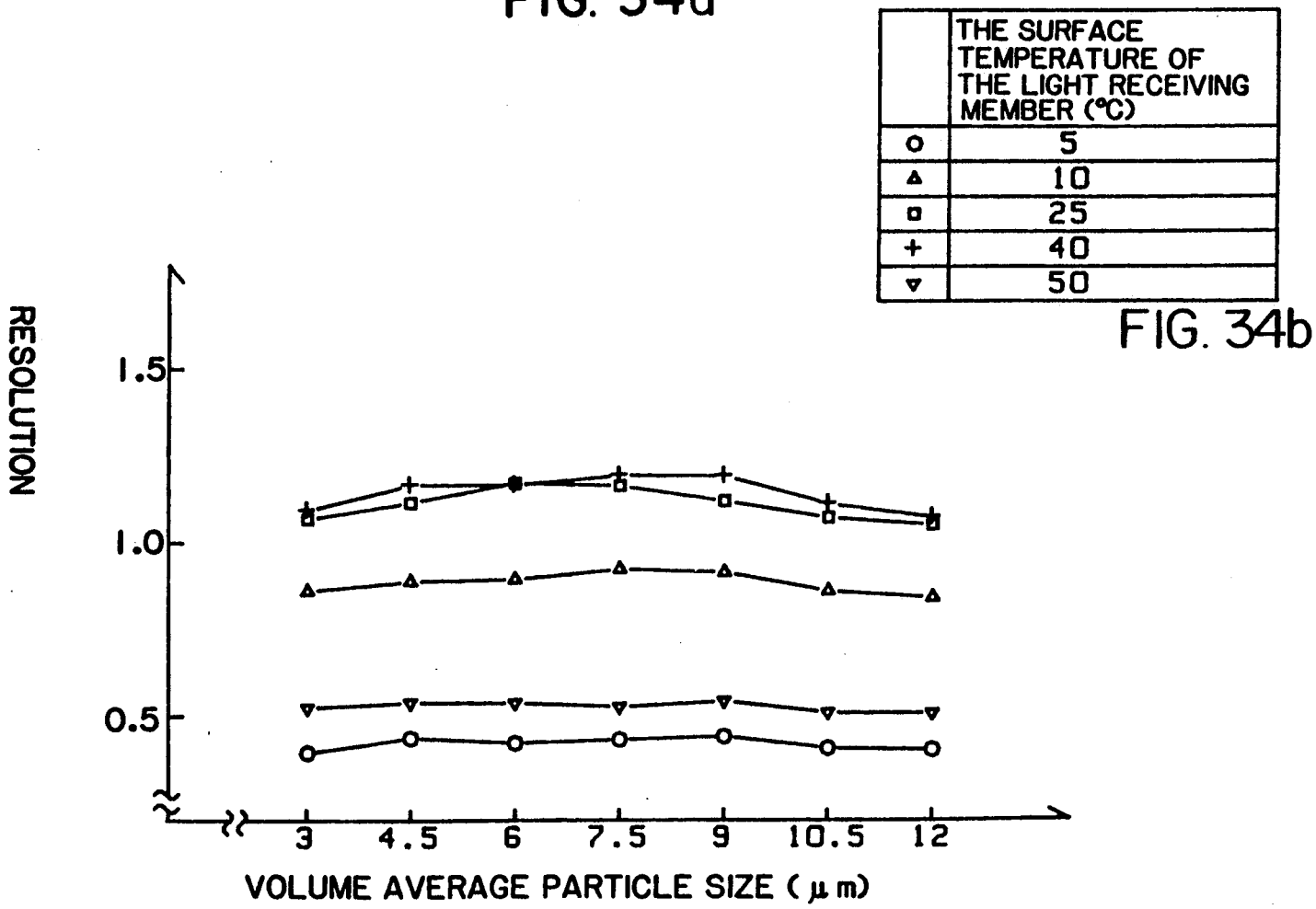
Figures 35A, 35B:
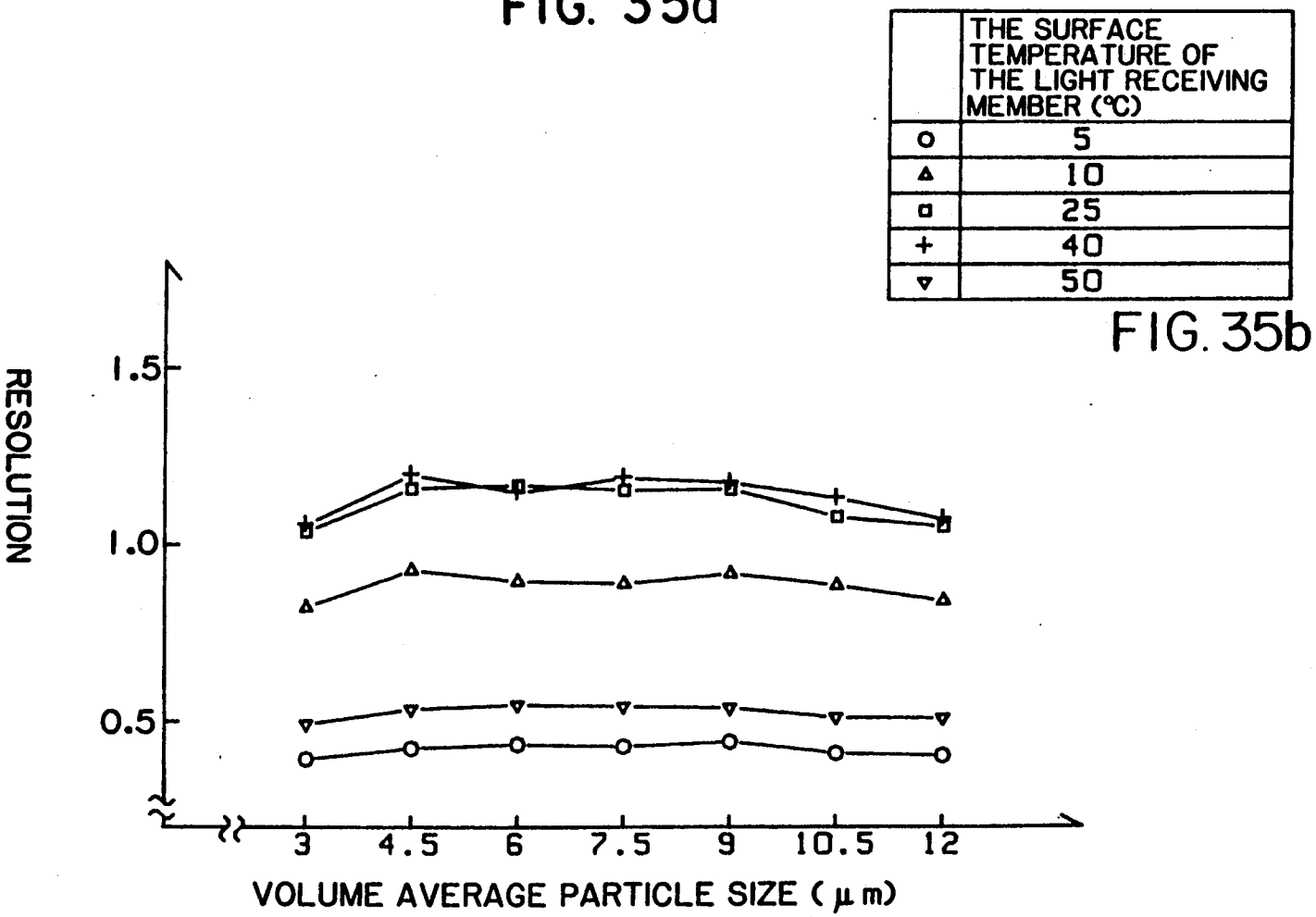
Figures 36A, 36B:
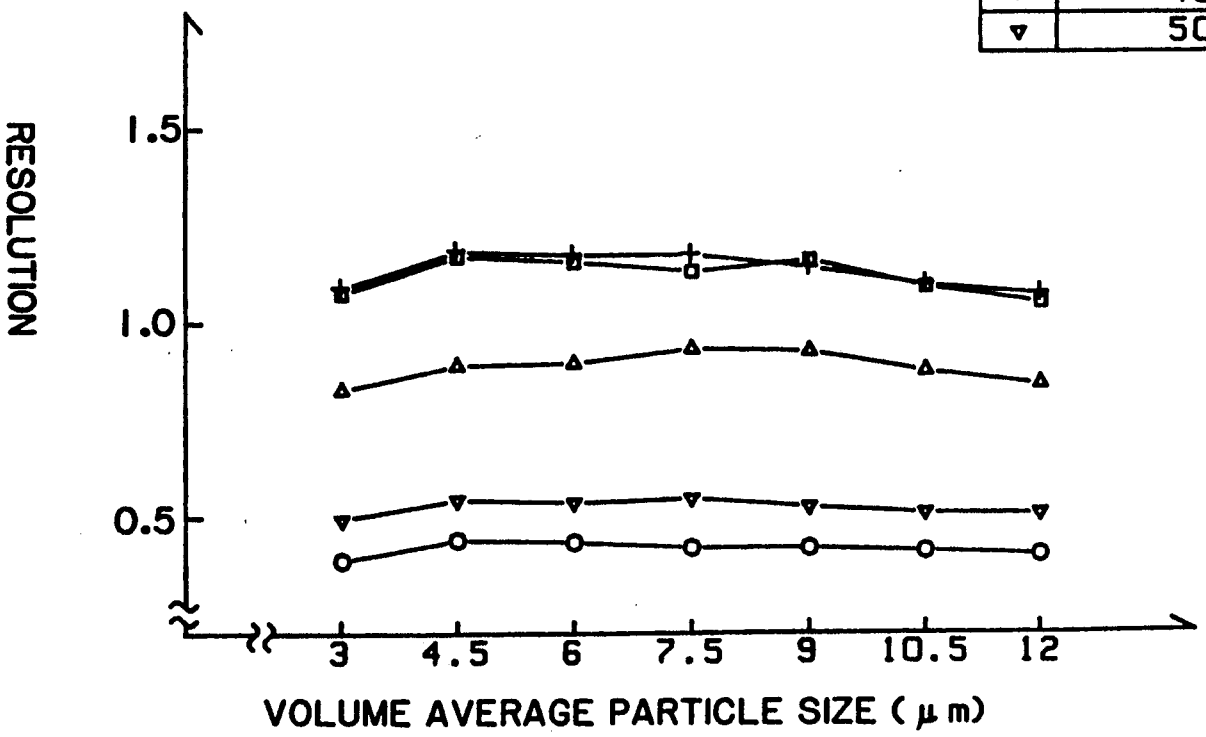
Figures 49A, 49B:
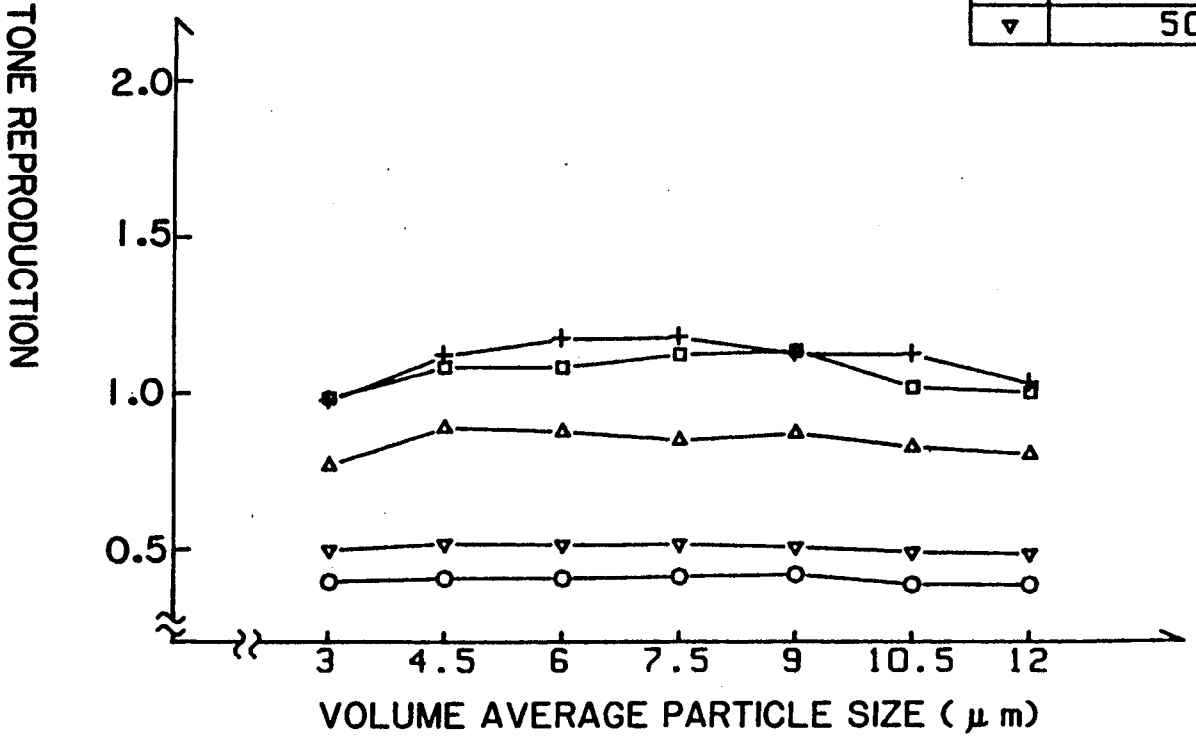

The evaluated results obtained were collectively shown in FIGS. 22a and (with respect to the resolution) and FIGS. 49a and 49b (with respect to the tone reproduction).

COMPARATIVE EXPERIMENT 2

There were prepared fourteen comparative cylindrical light receiving members (Comparative Samples Nos. 2 to 15) by repeating the procedures of Experiment 1 except for changing the film forming conditions to those shown in Table 4.

Each of the comparative cylindrical light receiving member samples (Comparative Samples No. 2 to 15) was evaluated in the same manner as in Experiment 1.

Figures 50A, 50B:
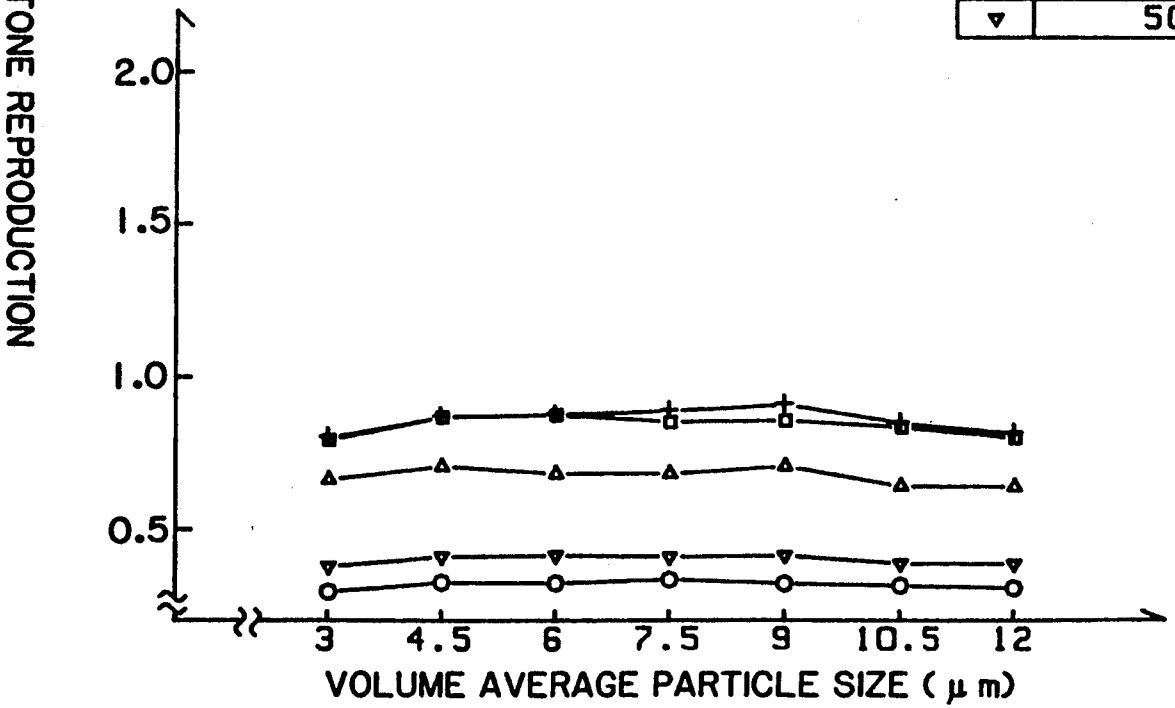
Figures 51A, 51B:
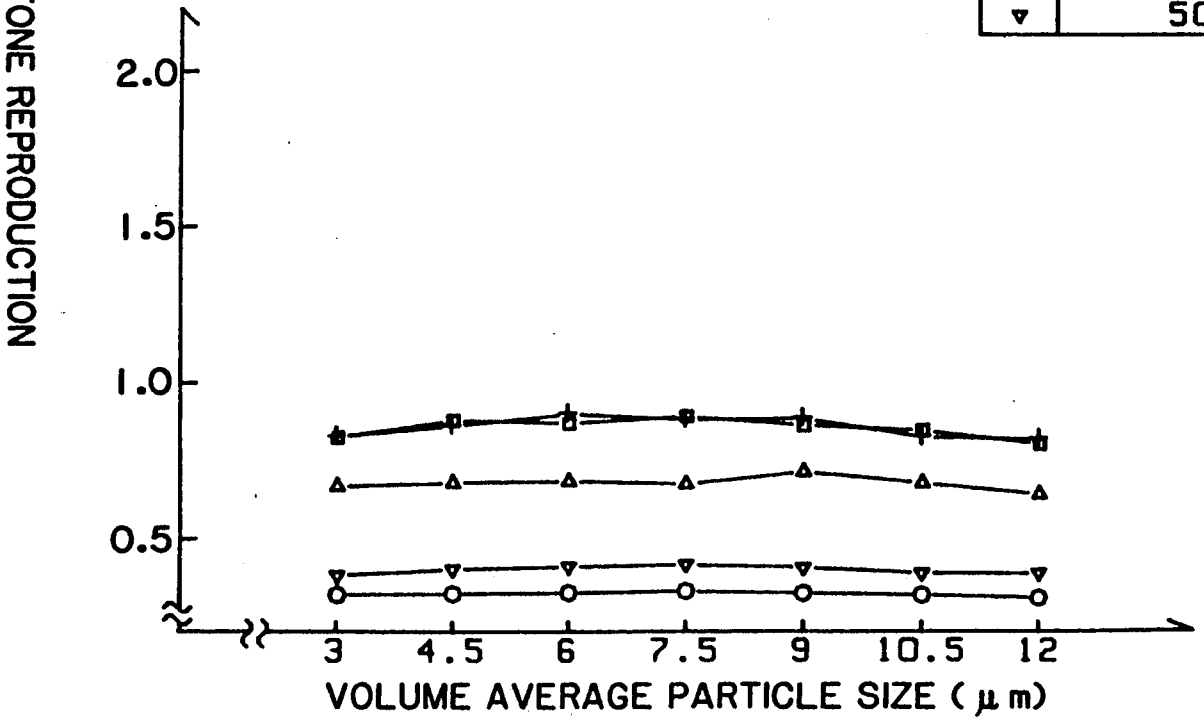
Figures 52A, 52B:
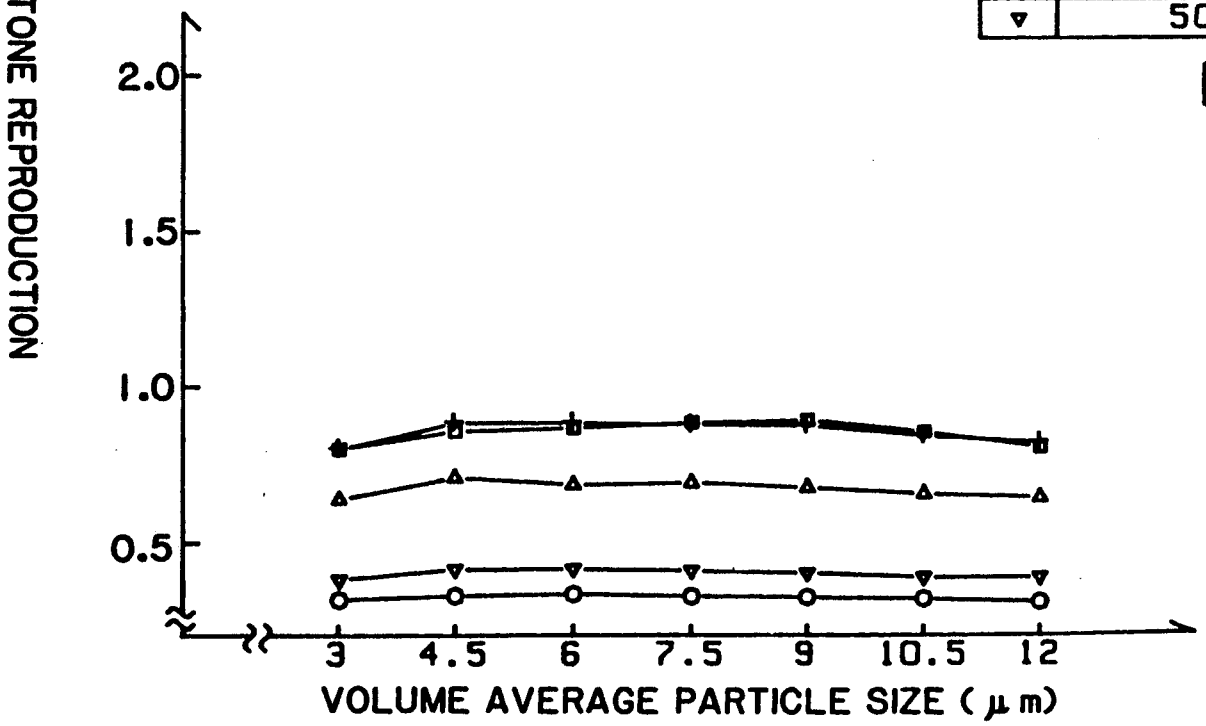
Figures 53A, 53B:
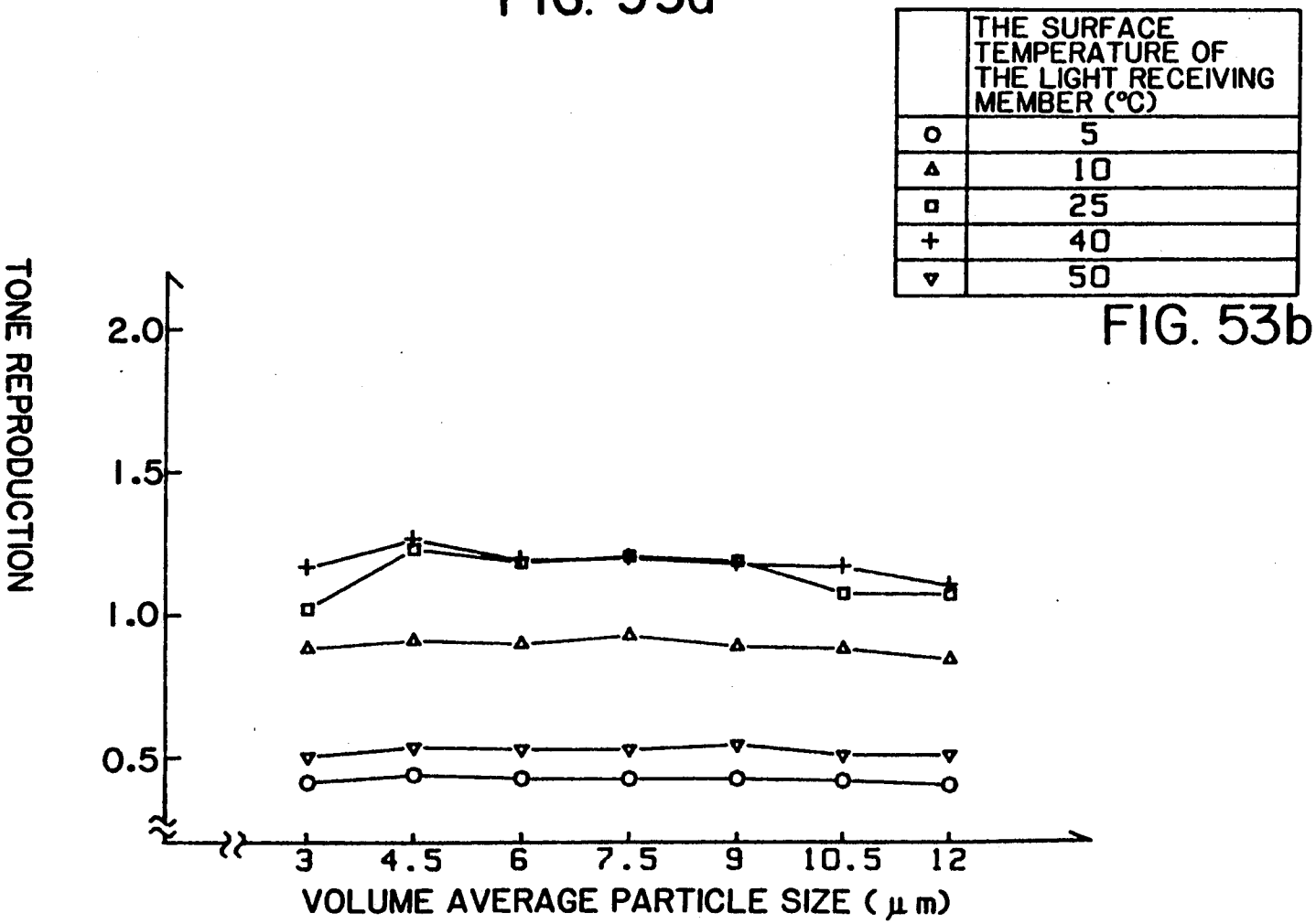
Figures 54A, 54B:
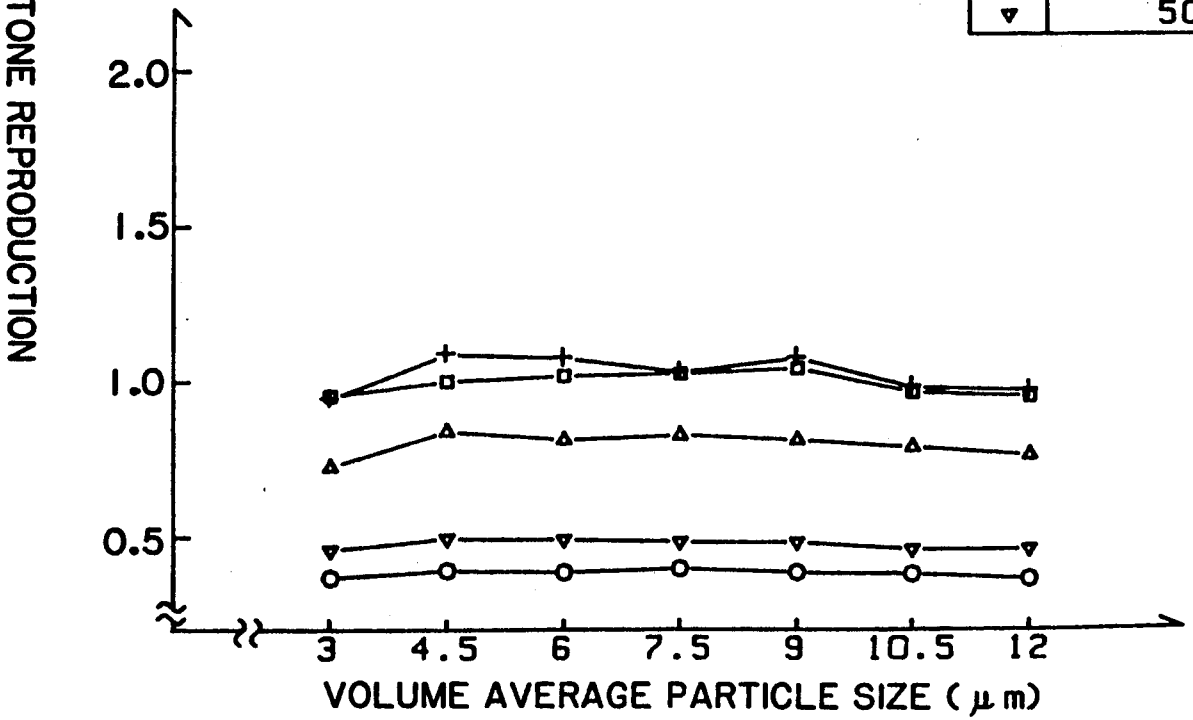
Figures 55A, 55B:
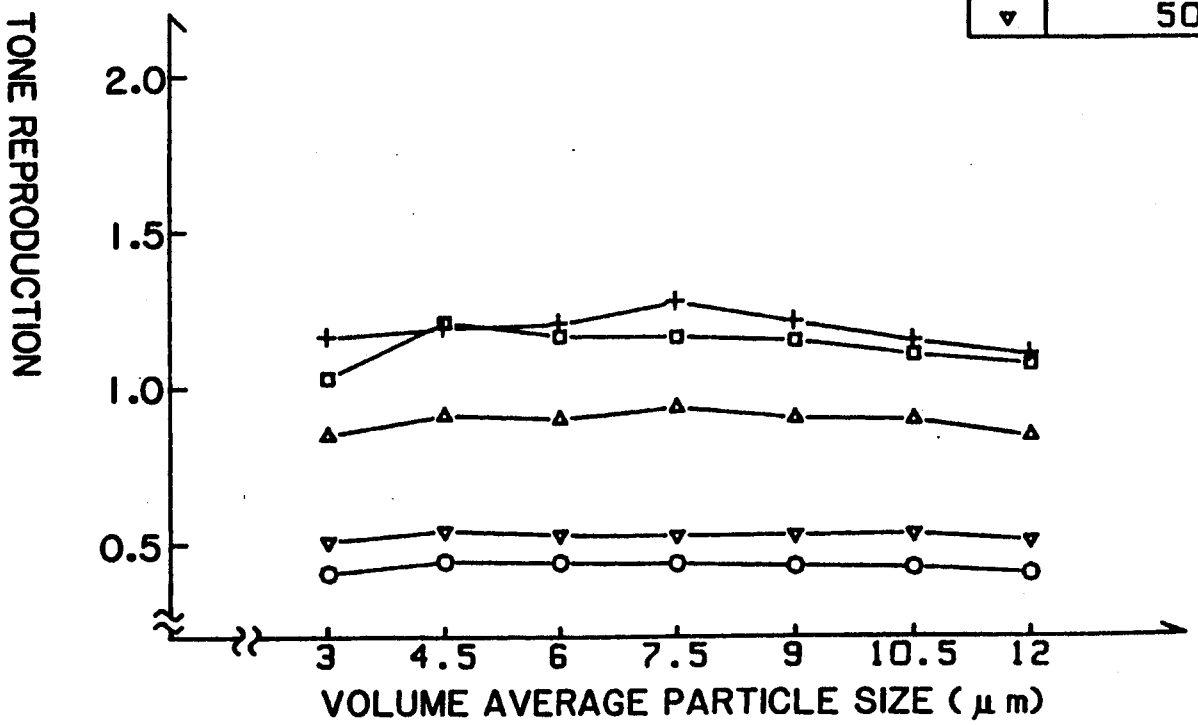
Figures 56A, 56B:
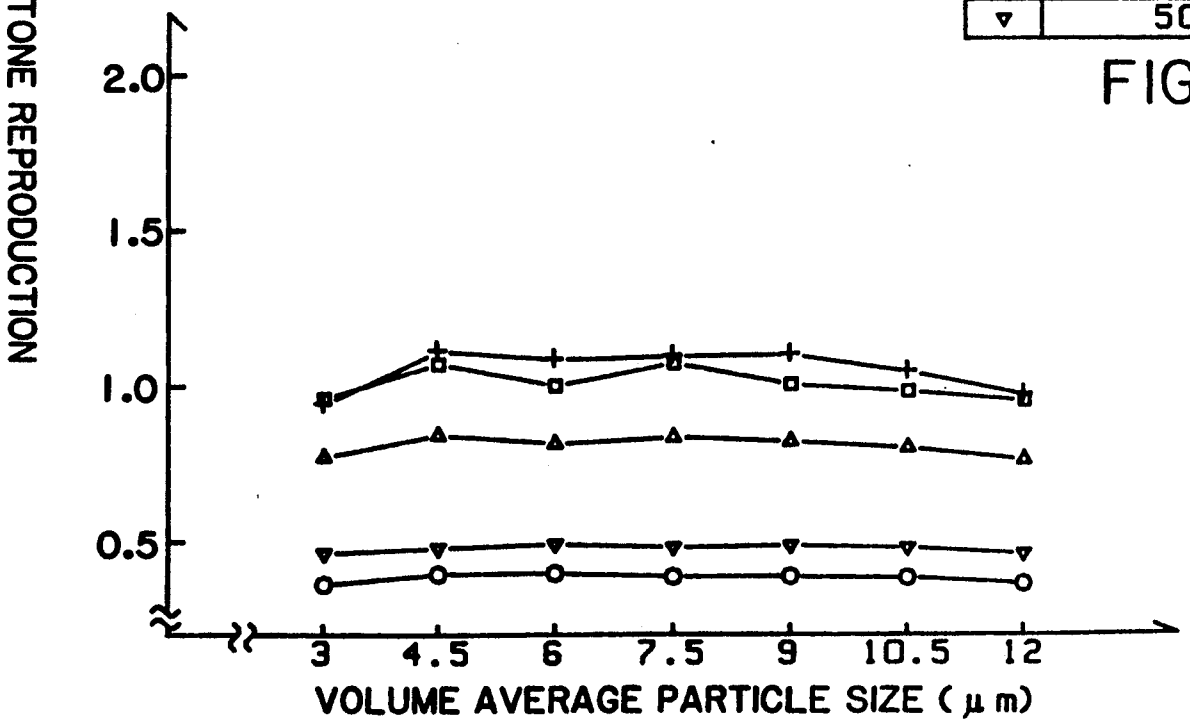
Figures 57A, 57B:
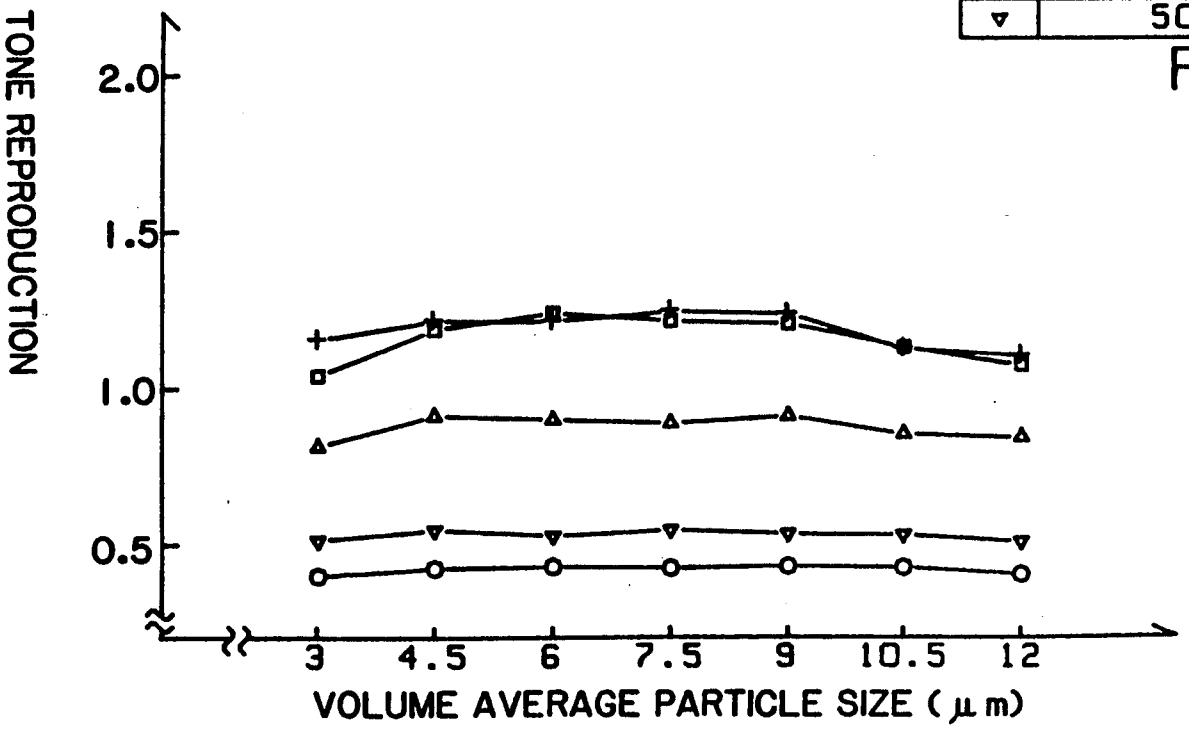
Figures 58A, 58B:
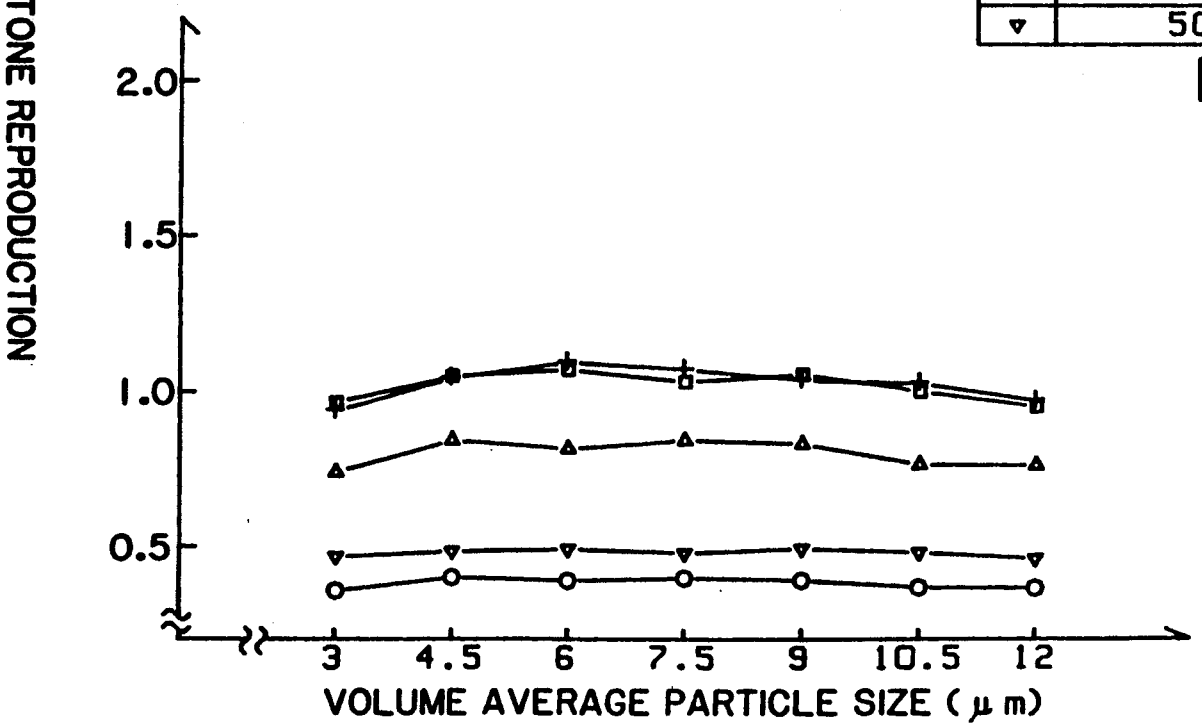
Figures 59A, 59B:
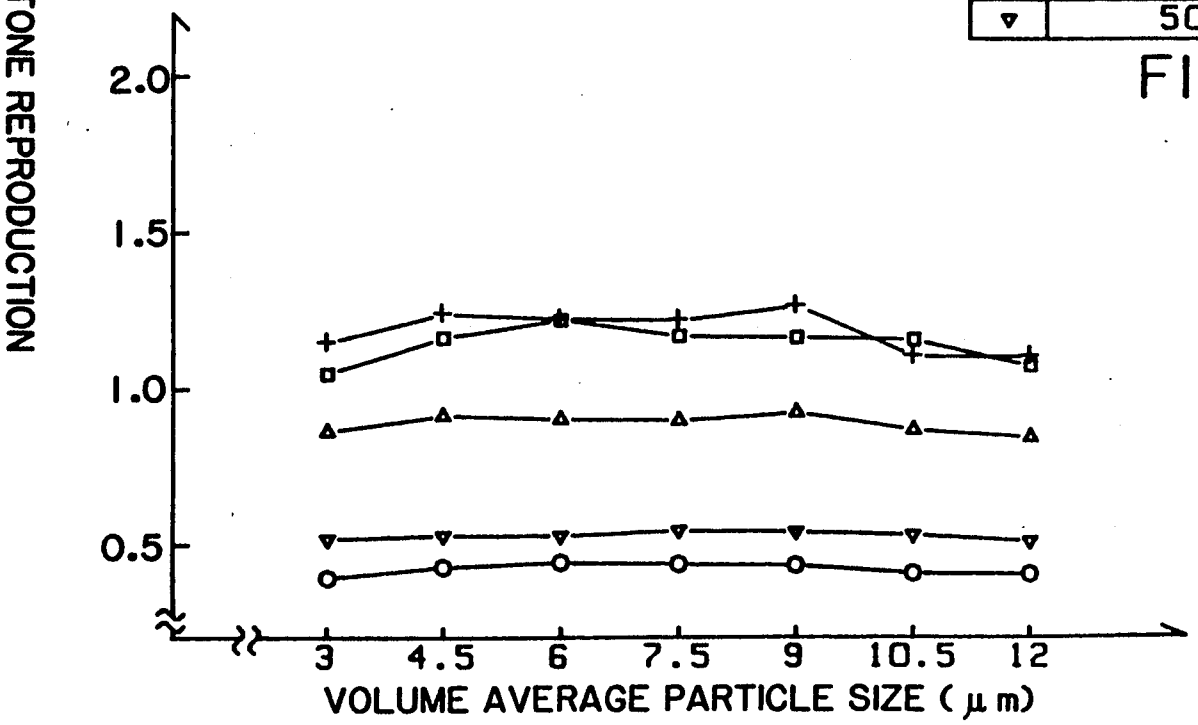
Figures 60A, 60B:
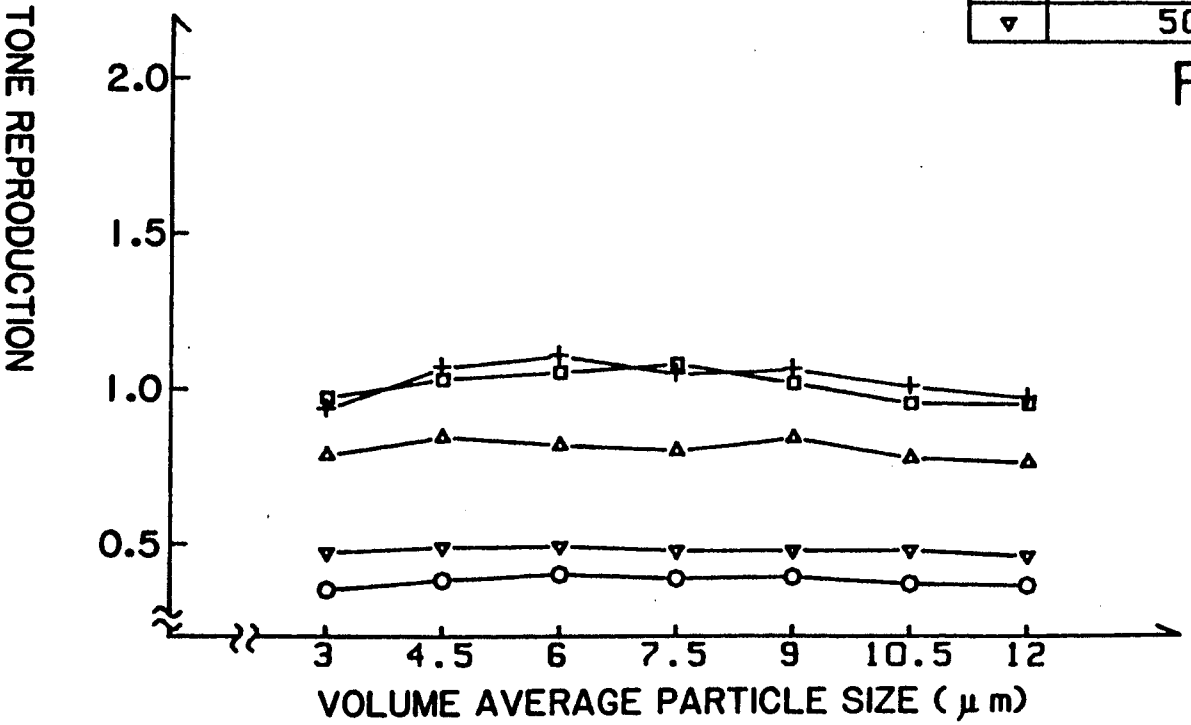
Figures 61A, 61B:
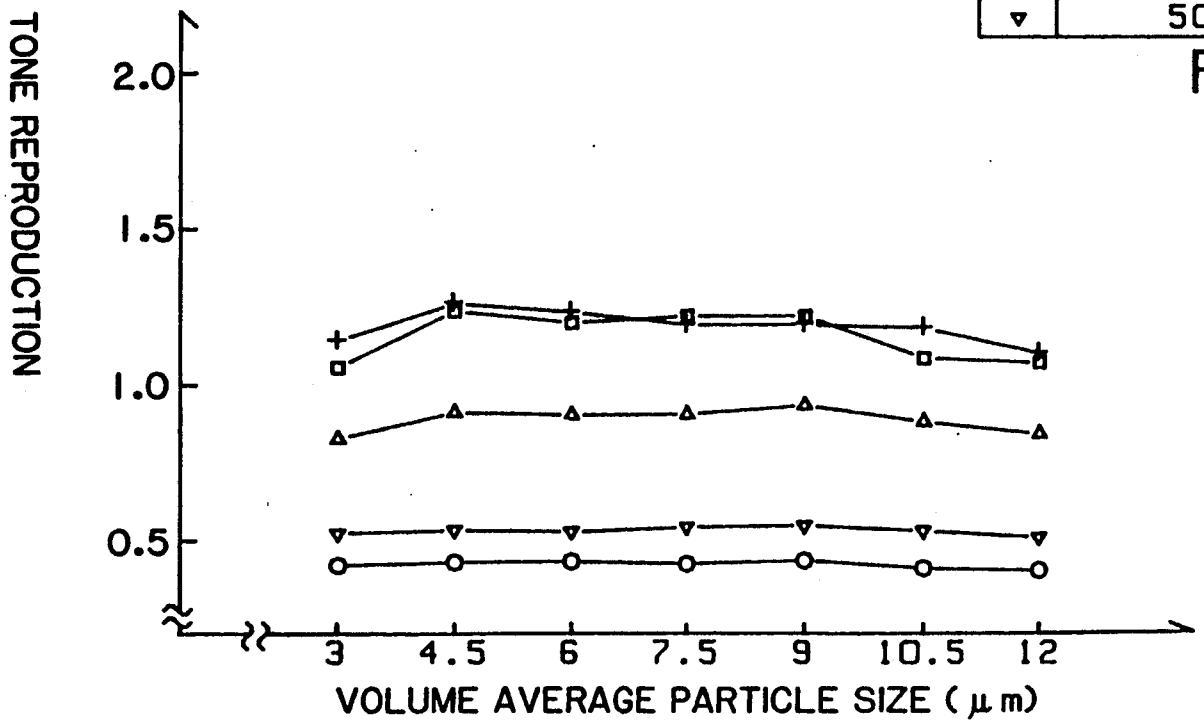
Figures 62A, 62B:
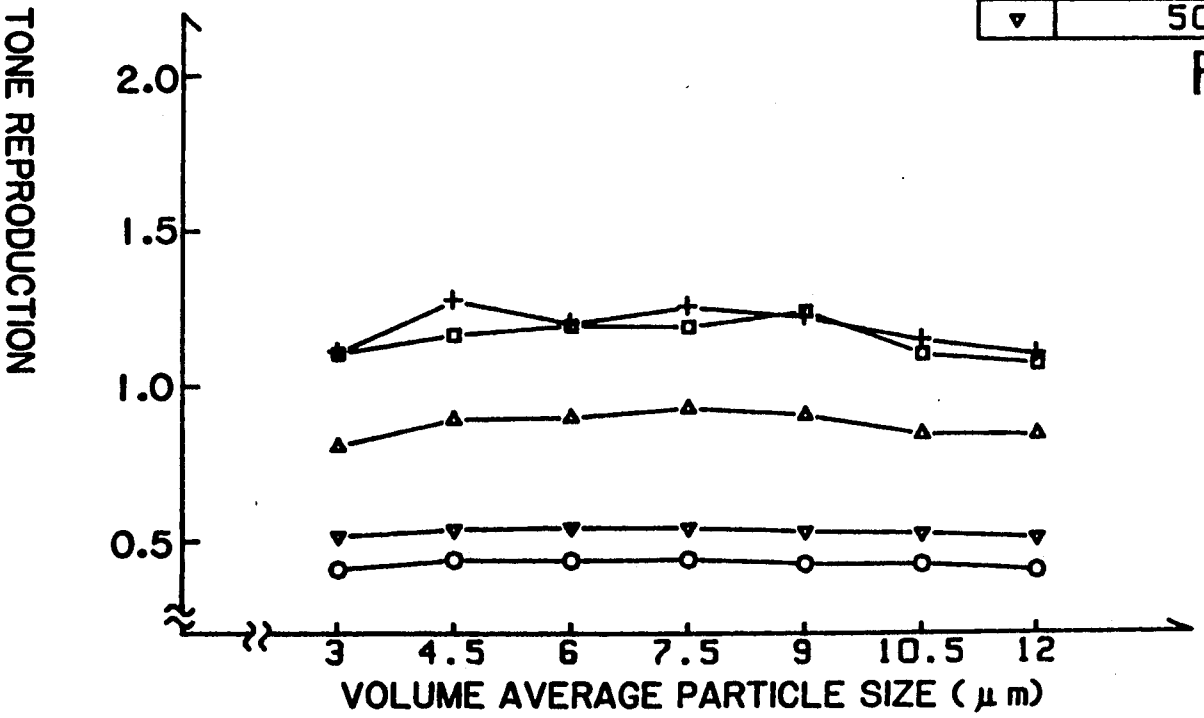
Figures 63A, 63B:
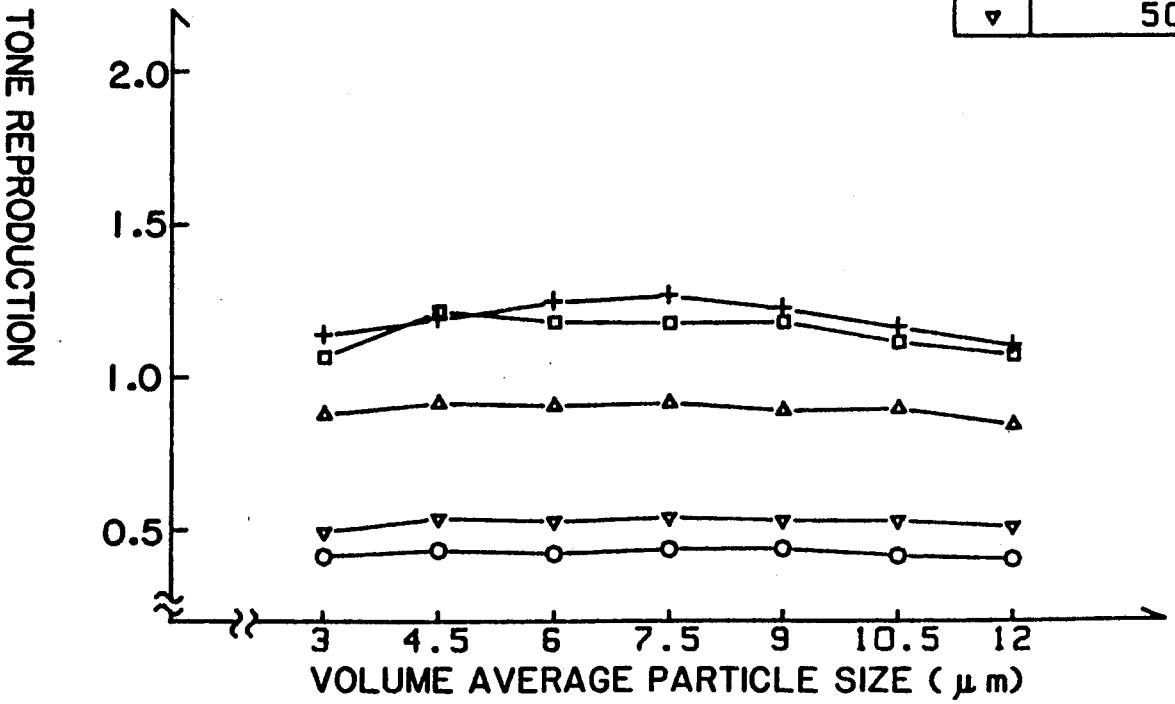

The evaluated results obtained were collectively shown in FIGS. 23a to 36b (with respect to the resolution) and also in FIGS. 50a and 63b (with respect to the tone reproduction).

All the values plotted in each of FIGS. 23a to 36b and also in each of FIGS. 50a and 63b are relative values obtained when the value for the resolution and the value for the tone reproduction obtained in the above Comparative Example 1 when the fine particle insulating toner of about 12 μm in volume average particle size was used and the surface temperature of the comparative cylindrical light receiving member sample (Comparative Sample No. 1) was maintained at 25° C. respectively were respectively made 1.

Total Evaluation

Figures 10A, 10B:
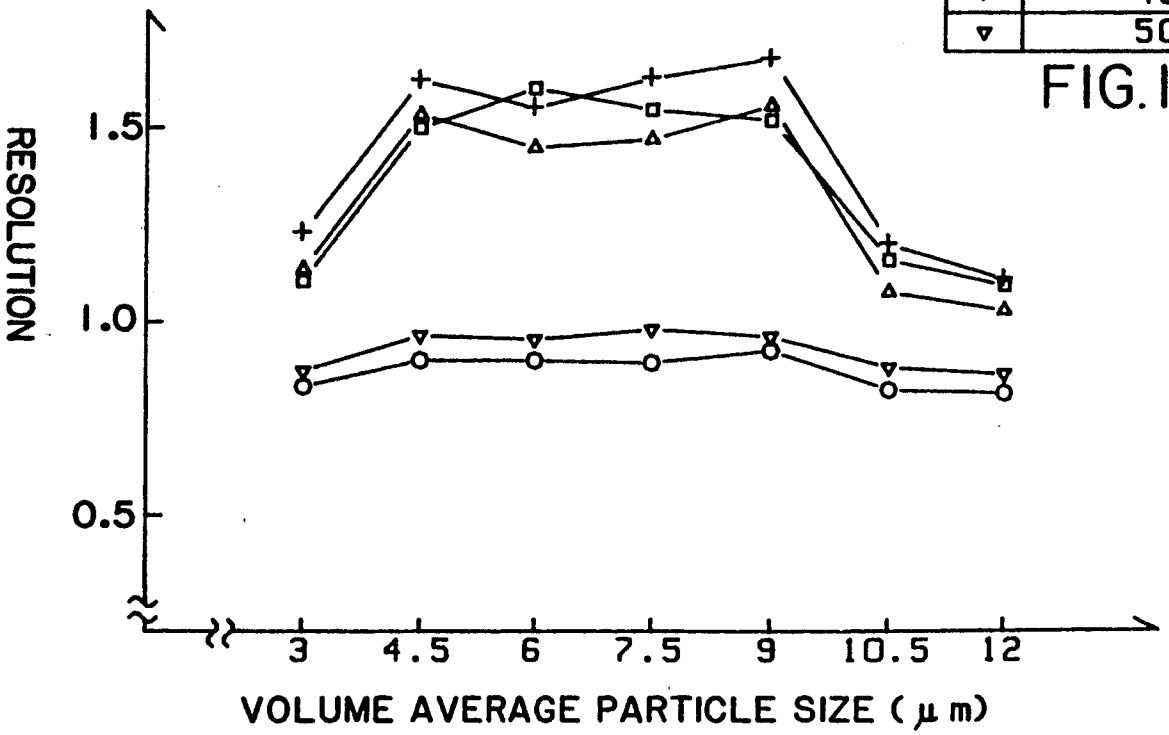
Figures 11A, 11B:
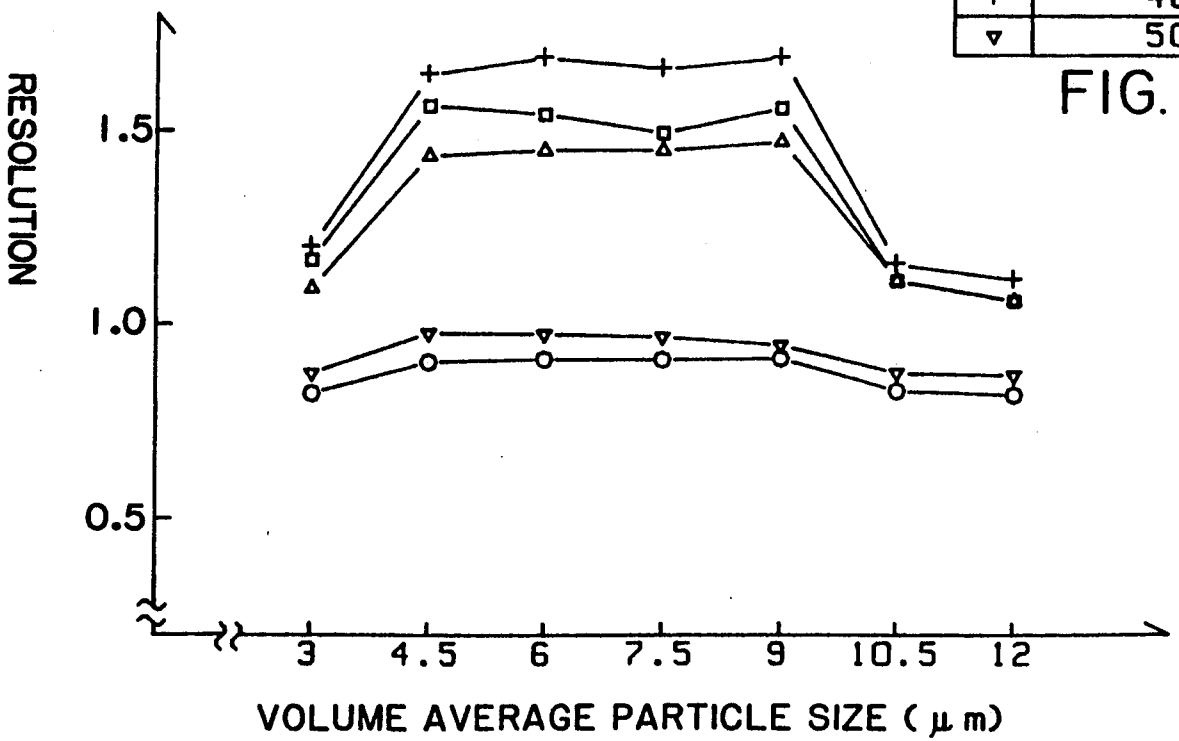
Figures 12A, 12B:
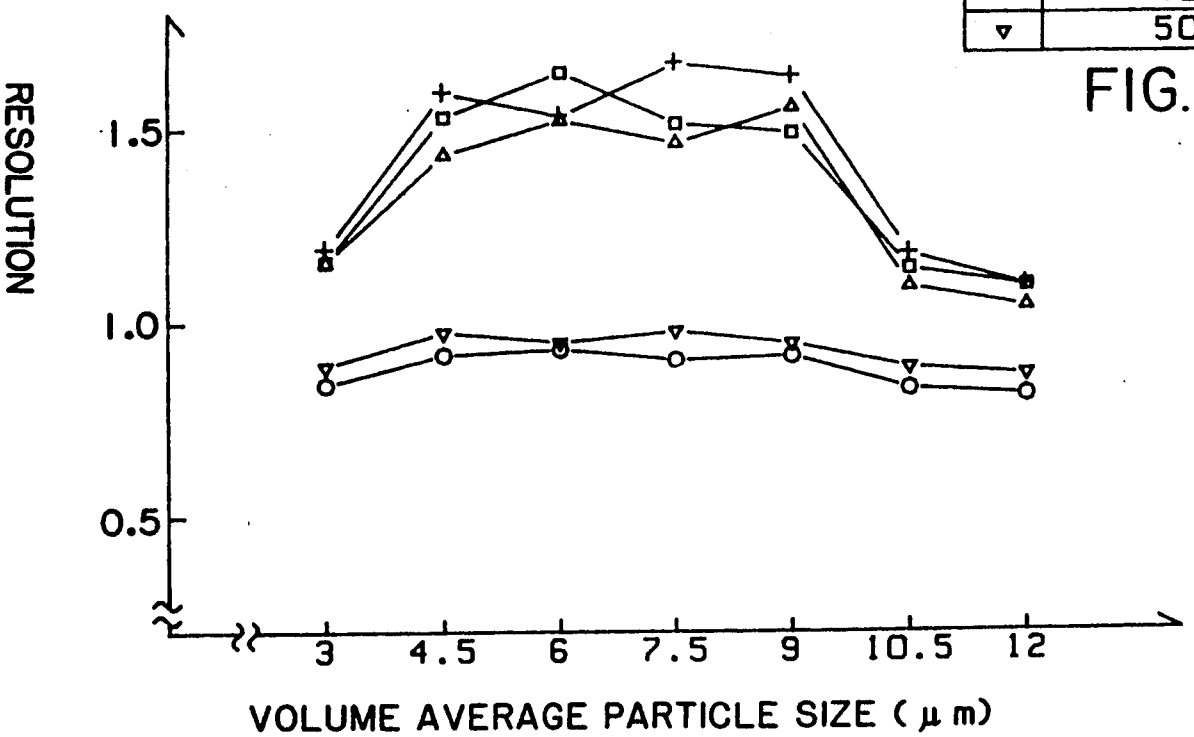
Figures 13A, 13B:
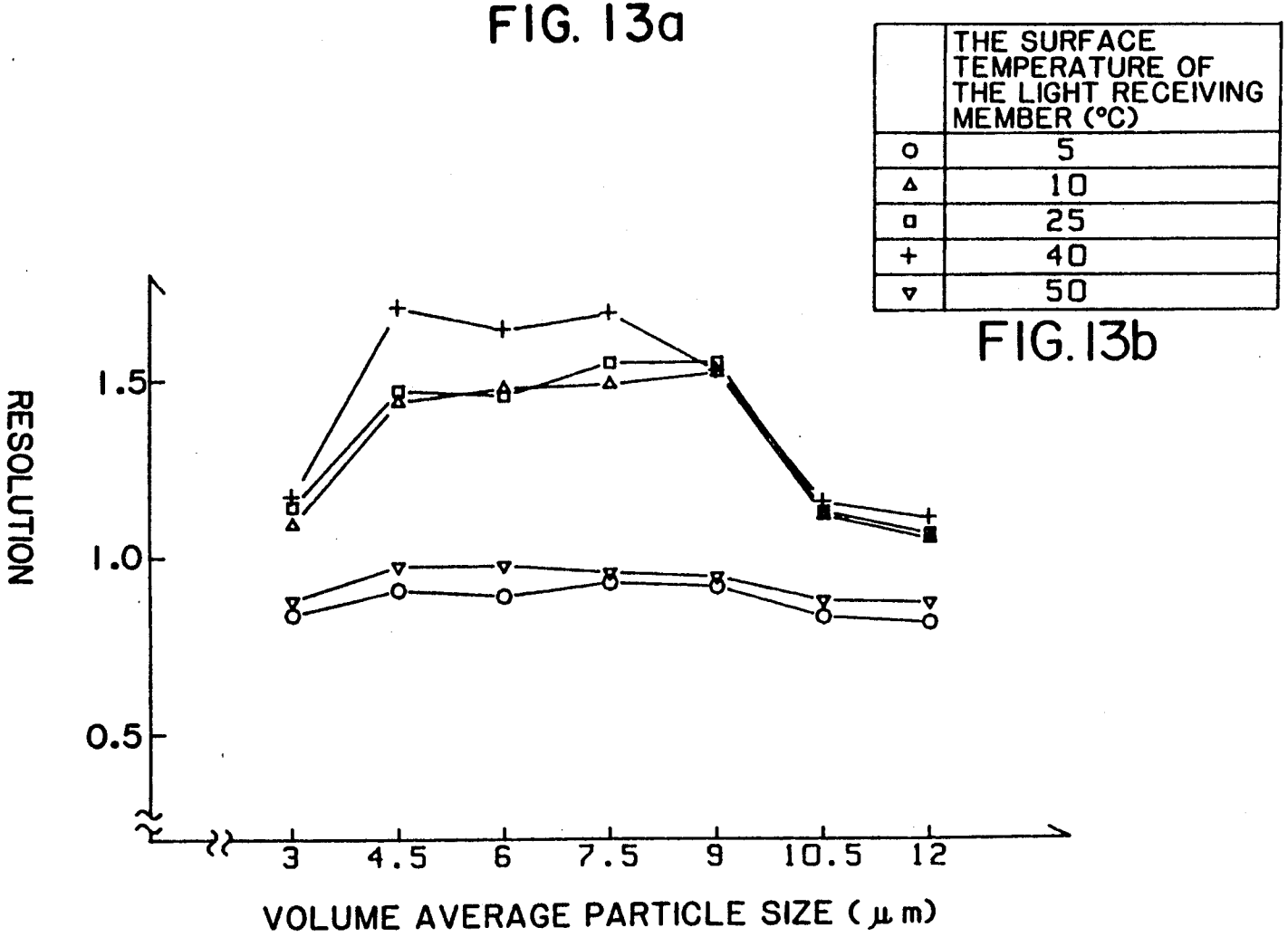
Figures 14A, 14B:
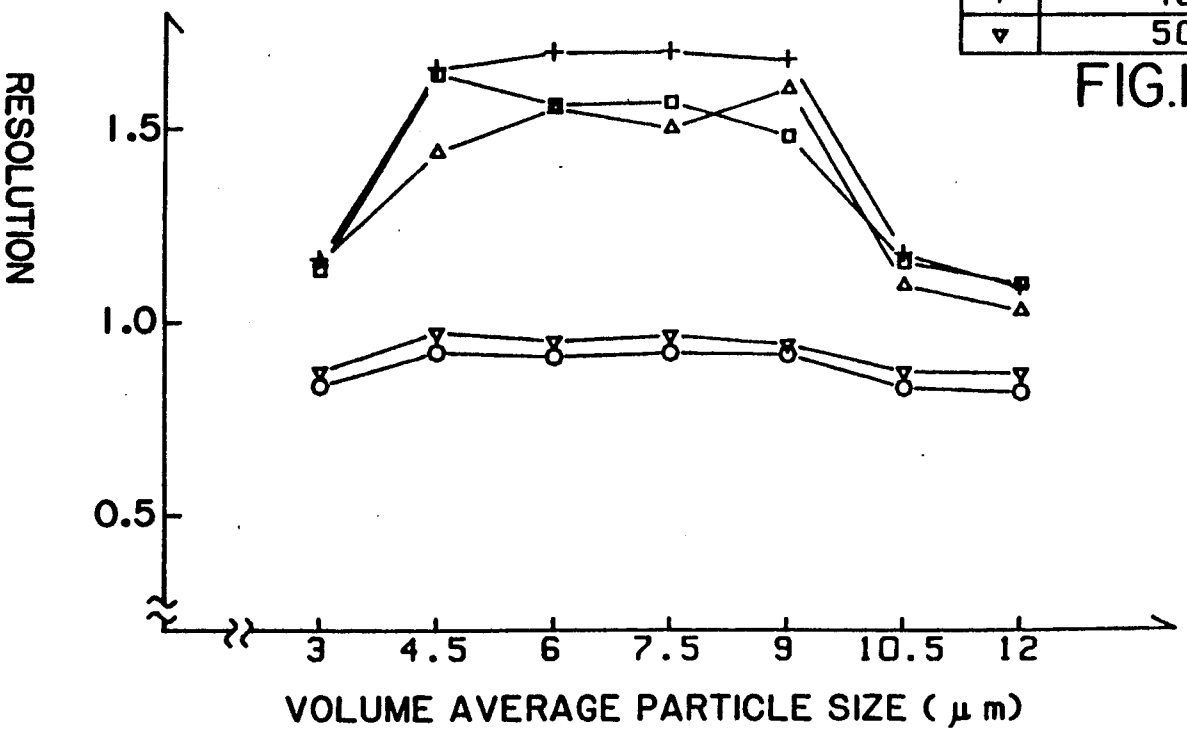
Figures 15A, 15B:
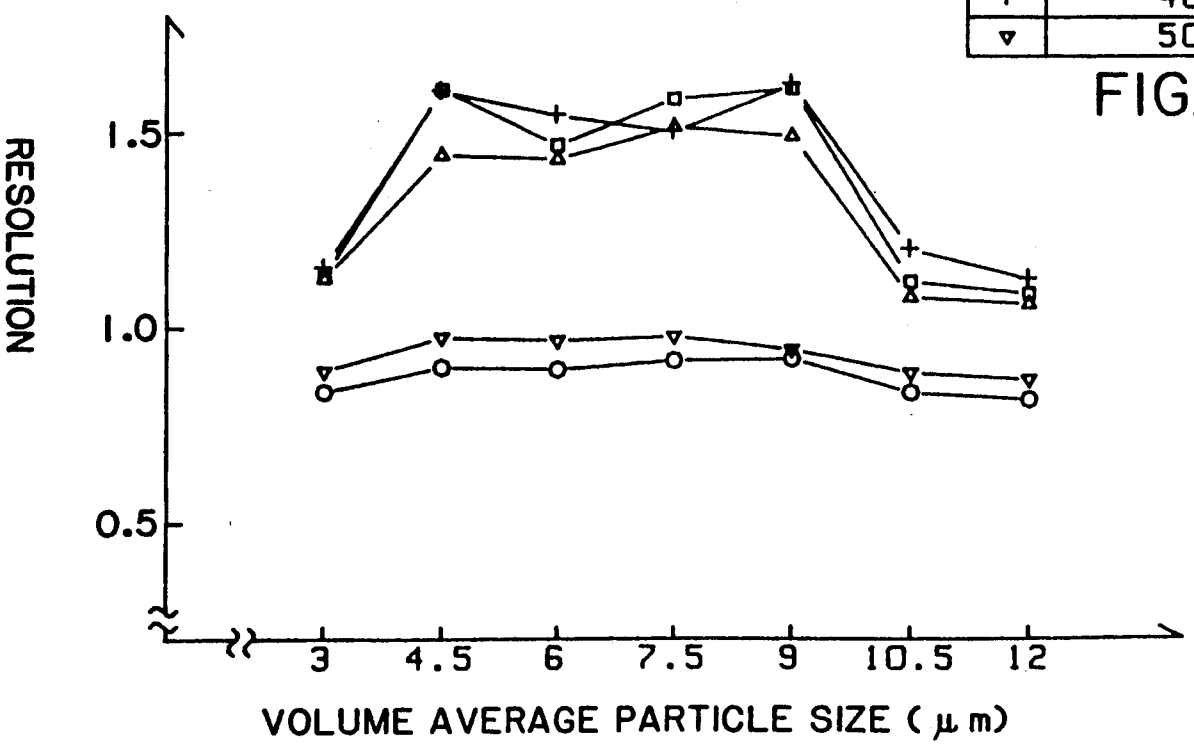
Figures 16A, 16B:
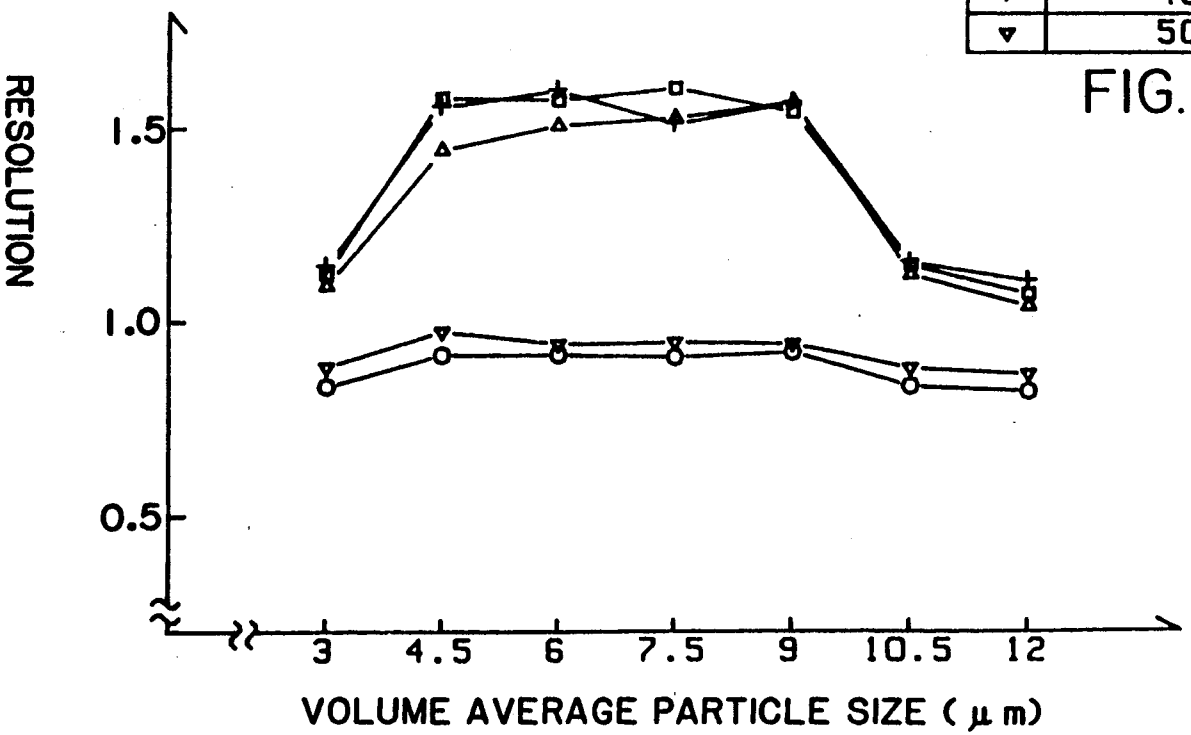
Figures 17A, 17B:
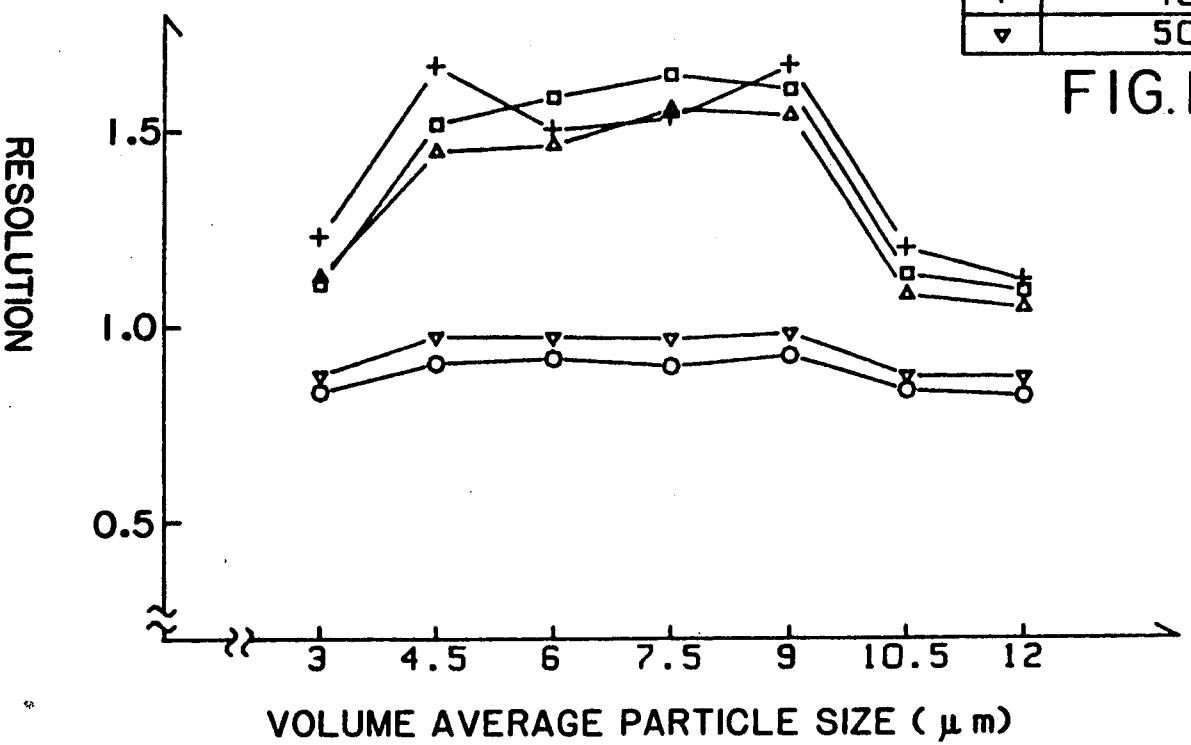
Figures 18A, 18B:
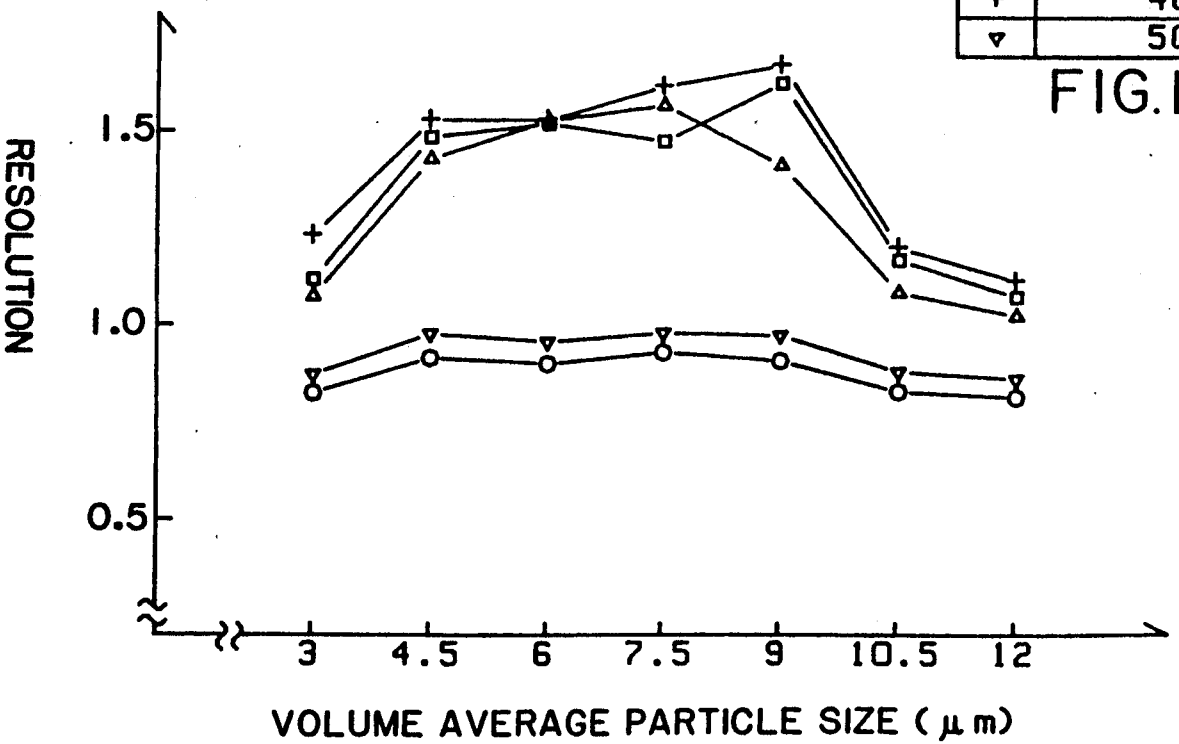
Figures 19A, 19B:
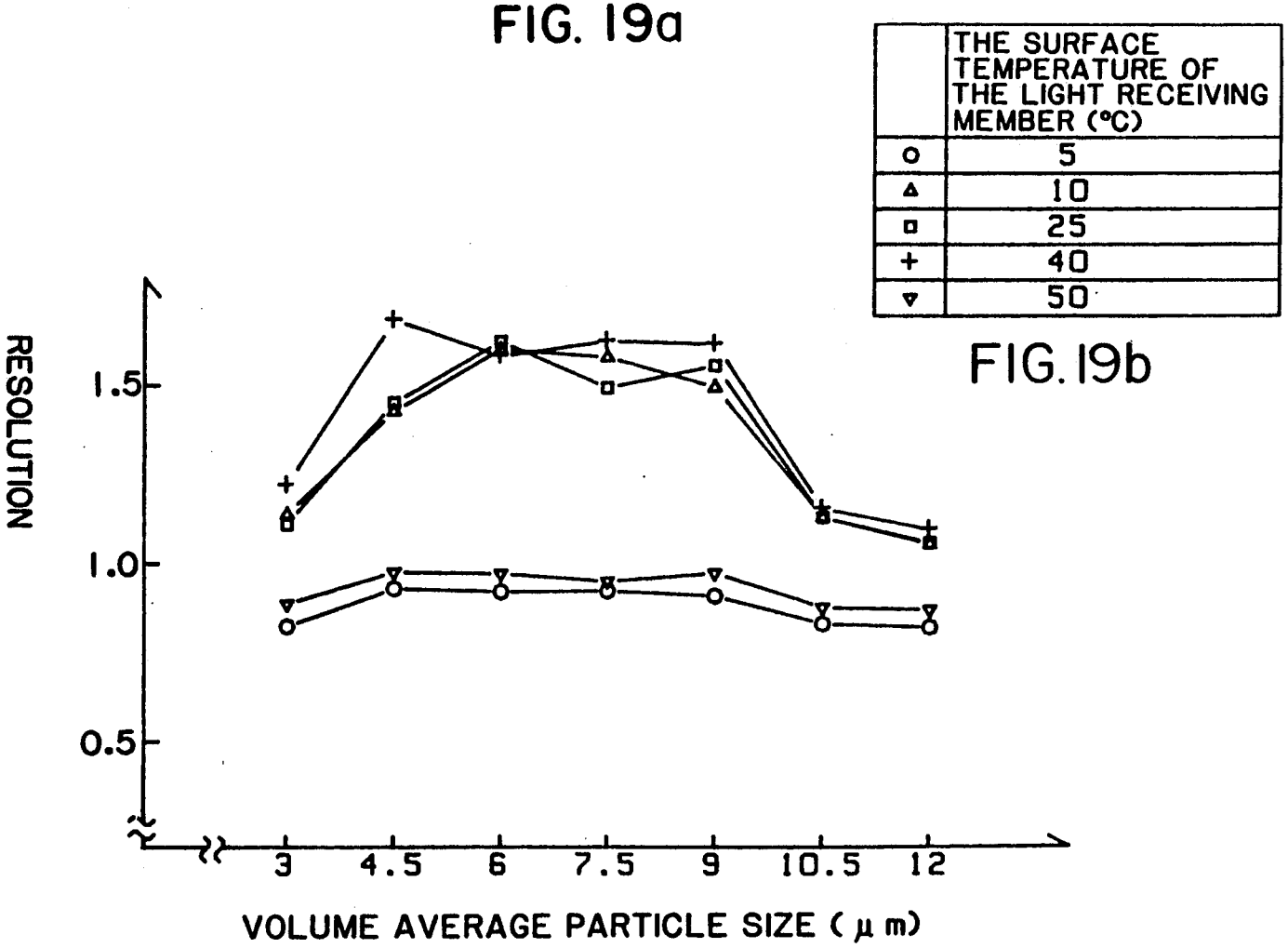
Figures 20A, 20B:
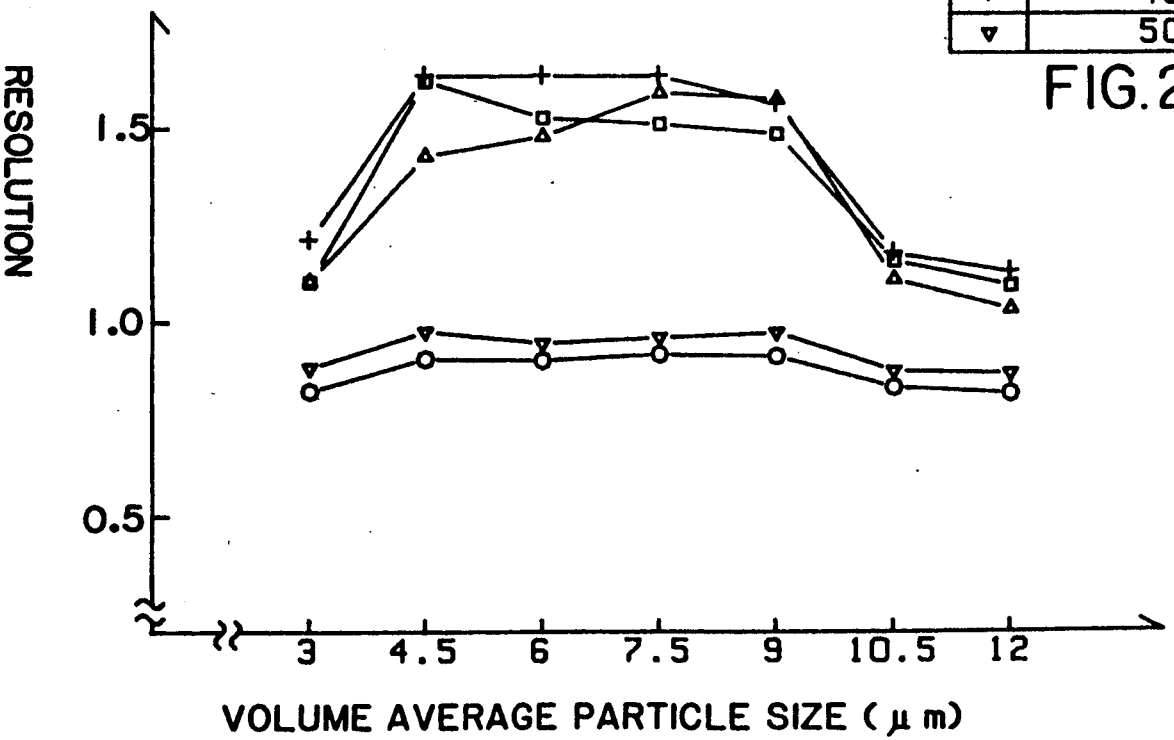
Figures 21A, 21B:
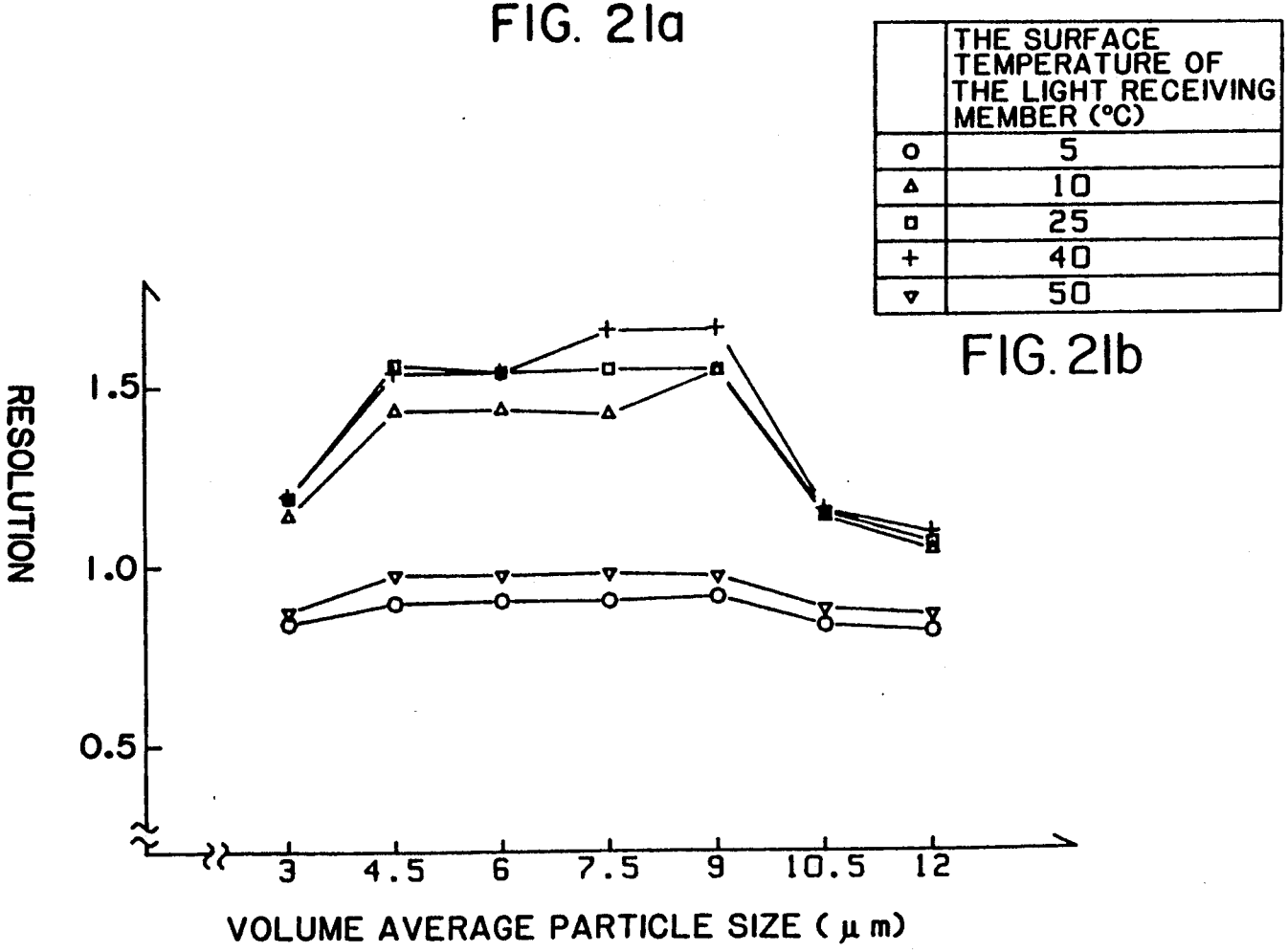

From the results shown in FIGS. 10a to 63b, it has been recognized that when the specific amorphous silicon light receiving member according to the present invention is used in combination with the specific fine particle insulating toner in the electrophotographic image-forming method, a high quality image excelling in both the resolution and the tone reproduction which is surpassing the image reproduced when the conventional amorphous silicon light receiving member is used can be stably and repeatedly reproduced. Particularly, it has been recognized that when the electrophotographic image-forming method is practiced by: using the specific amorphous silicon light receiving member according to the present invention, the developed image support layer of which being of 3000 to 10000 Å in thickness and of $10^{12}$ to $10^{16}\Omega$ cm in specific resistance; using the specific fine particle insulating toner of about 4.5 to about 9 μm in average volume particle size according to the present invention; and adjusting the surface temperature of said amorphous silicon light receiving member upon image formation to a temperature in the range of 10° to 40° C., an extremely high quality image excelling in both the resolution and the tone reproduction can be stably and repeatedly obtained.

EXPERIMENTS 2–4, COMPARATIVE EXPERIMENTS 3–5

The following Experiments 2–4 and Comparative Experiments 3–5 were conducted in order to observe the effects upon using the ozone removing filter in the electrophotographic image-forming method according to the present invention.

EXPERIMENT 2 AND COMPARATIVE EXPERIMENT 3

(Experiment 2)

There was prepared a honeycomb structured ozone-removing filter of the type shown in FIG. 6 by forming a honeycomb structure of 50 mm (width)×50 mm (length)×10 mm (depth) containing a plurality of cells made of a 20 μm thick aluminum sheet, each of said cells comprising a hexagonal cell having a side of 1.25 mm and of 10 mm in depth which is formed by pressing an equilateral hexagonal cylinder having a 1.25 mm side and a depth of 10 mm to one second for the distance between the two opposed sides, and dipping it in a dispersion containing 70 parts of a $CuO_2.MnO_2$ catalyst in 30 parts of acrylic binder resin to thereby coat the surface of each of the cells with the catalyst.

Comparative Experiment 3

There was prepared a honeycomb structured ozone-removing filter of the type shown in FIG. 6 by repeating the procedures of Experiment 2, except for using an activated carbon instead of the $CuO_2.MnO_2$ catalyst

EVALUATION

Each of the above two ozone-removing filters was examined by generating ozone with the use of a commercially available ozone-generating device and passing the ozone through the filter at a flow velocity of 3 m/sec. and at a flow velocity of 4.5 m/sec. while varying the temperature of the filter by the electric ribbon heater 62. In each case, the content of ozone in the air to have been passed was measured at the entrance and at the exit by a EG-2001 ozone content measuring device (product of EBARA Jitsugyo Kabushiki Kaisha).

The ratio between the two measured values was calculated to obtain an ozone removing efficiency, which was expressed by a percentage. The results obtained were collectively shown in FIG. 64.

Figure 64:
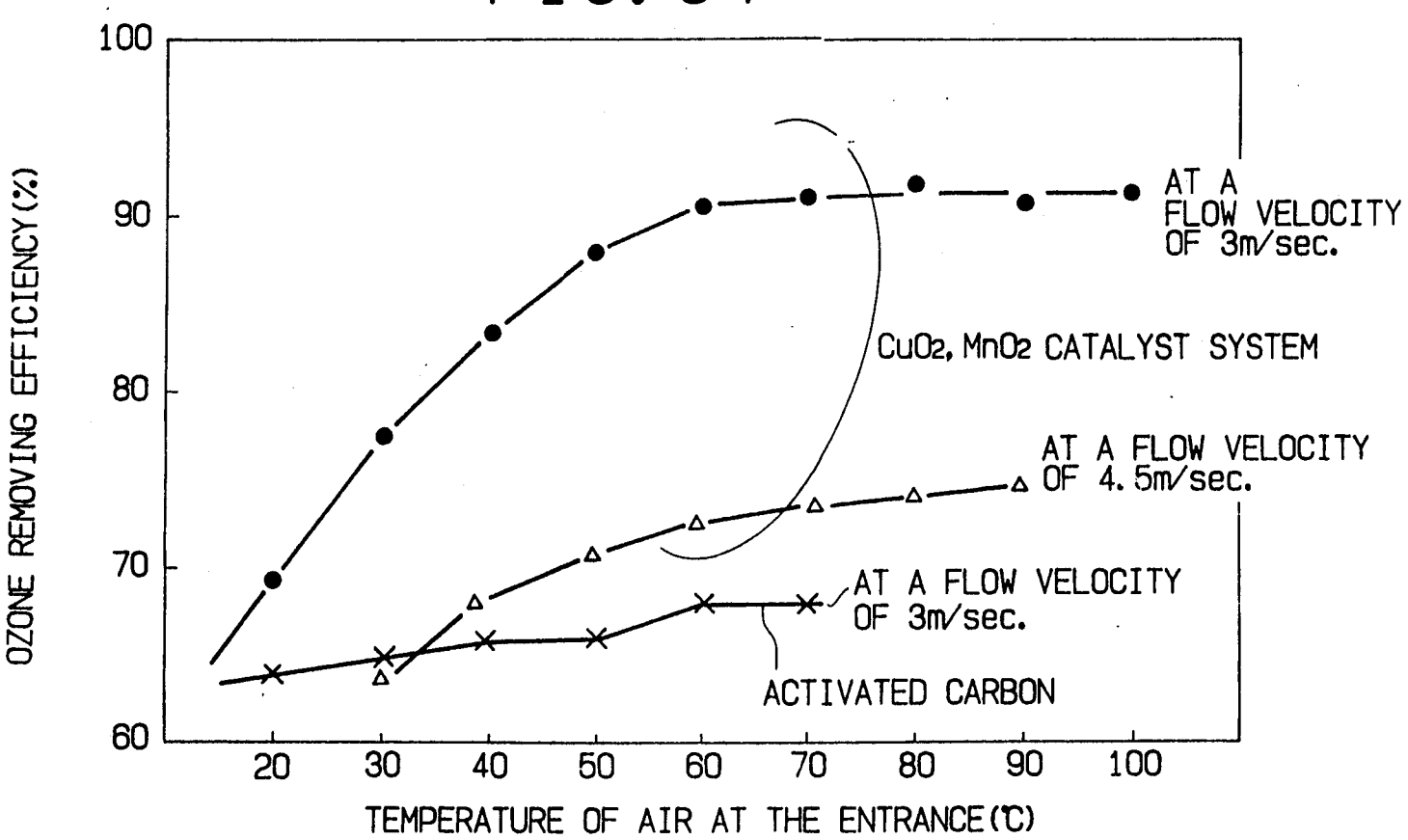
FIG. 64 show graphs with respect to the results obtained as a result of measuring the ozone-removing efficiencies of various ozone-removing filters in the Experiments which will be later described.

From the results shown in FIG. 64, it has been recognized that in the case of the activated carbon ozone removing filter, the ozone removing efficiency is 68% at most with a low flow velocity of 3 m/sec., however in the case of the metal catalyst ozone removing filter, the ozone removing efficiency reaches near 90% when the filter is maintained even at a low temperature of about 50° C.

Further, in the case of the metal catalyst ozone removing filter, even when the flow velocity is heightened to 4.5 m/sec., the ozone removing efficiency of more than 70% can be attained by maintaining the temperature of the filter at a temperature of more than 50° C.

As for the ozone removing efficiency for the activated carbon ozone removing filter when it was examined at a flow velocity of 4.5 m/sec., it was not shown in FIG. 64 since it was less than 60%.

EXPERIMENT 3

There were prepared two kinds of honeycomb structured ozone removing filters respectively of the type shown in FIG. 6 by repeating the procedures of Experiment 2 except for using a $TiO_2$ catalyst and a $SiO_2$ catalyst respectively in stead of the $CuO_2.MnO_2$ catalyst.

Each of the resultant ozone removing filters was examined in the same manner as in Experiment 2. As a result, it has been found that each of the resultant ozone removing filters provides a satisfactory ozone removing efficiency of 85 to 95% even at a low flow velocity of 3 m/sec. when the filter is maintained at a temperature of more than 50° C.

EXPERIMENT 4 AND COMPARATIVE EXPERIMENT 4

There were provided the cylindrical amorphous silicon light receiving member of Sample No. 1 prepared in Experiment 1 (hereinafter referred to as "Drum Sample A") and the cylindrical amorphous silicon light receiving member of Comparative Sample No. 1 prepared in Comparative Example 1 (hereinafter referred to as "Drum Sample B").

Then, there was provided the same fine particle insulating toner of about 6 μm in volume average particle size as used in Experiment 3.

Additionally, there were provided two kinds of honey-comb structured ozone removing filters respectively of the type shown in FIG. 6 which are shown in Table 5 (hereinafter referred to as "Filter Sample A" and "Filter Sample B" respectively).

Further, there were provided two of the same electrophotographic copying machines as used in Example 1. Filter Sample A was installed behind the main charger of one of the electrophotographic copying machines. Filter Sample B was installed behind the main charger of the remaining copying machine.

Each of the two Drum Samples A and B was set to each of the two copying machines of which development mechanism being charged with the foregoing toner and image formation was conducted by using a Canon Test Sheet NA-7 as the test original to thereby reproduce images. Evaluation on the resultant images was conducted by eyes. In this evaluation, reproduced images obtained at the beginning stage and images obtained when the copying machine was switched off after 10,000 A-4 size copies being reproduced, left as it was for 5 hours at 32.5° C. and under environmental condition of 85% humidity then was switched on, were evaluated.

The evaluated results obtained were collectively shown in Table 6.

As Table 6 illustrates, it is understood that excellent initial images can be obtained in any case but there are found significant differences among the images obtained after the copying machine has been left for a certain period of time after being switched off when 10,000 copies have been reproduced. And it is understood that only in the case of the image-forming method according to the present invention wherein Drum Sample A and Filter Sample A are used in combination, a extremely high quality image can be stably and repeatedly obtained.

From these facts, it has been confirmed that the image-forming method according to the present invention wherein a specific amorphous silicon light receiving member having the configuration shown in FIG. 1, a metal catalyst ozone removing filter and a fine particle insulating toner having a specific volume average particle size are used in combination makes it possible to stably and repeatedly provide an extremely high quality image even under severe environmental condition.

COMPARATIVE EXAMPLE 5

The procedures of Experiment 4 were repeated by using the same Drum Sample A as used in Experiment 4, except that Filter Sample B shown in Table 5 was modified so as to provide the same ozone removing efficiency as Filter Sample A shown in Table 5 by increasing the volume of the filter and the amount of the activated carbon, and the ozone removing filter thus prepared was used.

As a result, it has been found that excellent reproduced images can be obtained at the beginning stage but the images obtained after the copying machine has been left for a certain period of time after being switched off since when 10,000 copies having been reproduced are accompanied with minute unfocused images.

DESCRIPTION OF THE PREFERRED EMBODIMENTS

This invention will be described more specifically while referring to Examples, but the invention is not intended to limit the scope only to these examples.

EXAMPLE 1

The cylindrical light receiving member of Sample No. 5 prepared in Experiment 1 was set to a commercially available CANON NP-7550 Electrophotographic Copying Machine which has basically the same constitution as that shown in FIG. 2 wherein the development mechanism being charged with the fine particle insulating toner of about 6 μm in volume average particle size, which was obtained in Toner Production Example 2. The electrophotographic image-forming method was carried out under normal environmental conditions (at 23° C., at a humidity of 60%) by using a CANON Test Sheet NA-7 for use in image evaluation which contains two complicated minute Chinese characters of 2 mm in size as the original in accordance with the foregoing image-forming procedures using the electrophotographic copying system of FIG. 2, to thereby reproduce images of those original Chinese characters.

As a result of evaluating the resultant images, it has been found that they are excellent in resolution and tone reproduction without accompaniment of any uneven image density and of any unfocused image and they are equivalent to the original characters of the test sheet.

Then, the above electrophotographic image-forming process was continuously repeated to provide 500,000 copies. The images reproduced on the last copy were evaluated. As a result, it has been found that they are equivalent to those obtained at the initial stage and are still equivalent to the original characters of the test sheet.

EXAMPLE 2

The procedures for the electrophotographic image-forming method of Example 1 were repeated, except that the cylindrical light receiving member which was prepared in accordance with the foregoing layer forming method using the RF plasma CVD apparatus shown in FIG. 5 under the film forming conditions shown in Table 7 was used and the fine particle insulating toner of about 6 μm in volume average particle size which was obtained in Toner Production Example 3 was used, to thereby reproduce images of the original Chinese characters.

As a result of evaluating the resultant images, it has been found that they are excellent in resolution and tone reproduction without accompaniment of any uneven image density and of any unfocused image and they are equivalent to the original characters of the test sheet.

Then, the above electrophotographic image-forming process was continuously repeated to provide 500,000 copies. The images reproduced on the last copy were evaluated. As a result, it has been found that they are equivalent to those obtained at the initial stage and are still equivalent to the original characters of the test sheet.

EXAMPLE 3

The procedures for the electrophotographic image-forming method of Example 1 were repeated, except that the honeycomb structured ozone removing filter prepared in Experiment 2 was installed behind the main charger of the electrophotographic copying machine and said ozone removing filter was maintained at 50° C., to thereby reproduce images of the original Chinese characters.

As a result of evaluating the resultant images, it has been found that they are extremely excellent in resolution and tone reproduction without accompaniment of any uneven image density and of any unfocused image and they are apparently equivalent to the original characters of the test sheet.

TABLE 1

| | gas used and its flow rate (sccm) | | discharging power (W) | inner pressure (Torr) | substrate temperature (°C.) |
|---|---|---|---|---|---|
| charge injection inhibition layer | $SiH_4$ | 100 | 150 | 0.5 | 250 |
| | $H_2$ | 500 | | | |
| | $PH_3/SiH_4$ | 500 ppm | | | |
| photoconductive layer | $SiH_4$ | 300 | 500 | 0.5 | 250 |
| | $H_2$ | 500 | | | |
| | $B_2H_6/SiH_4$ | 0.1 ppm | | | |
| latent image support layer | $SiH_4$ | 100 | 300 | 0.3 | 250 |
| | $CH_4$ | 100 | | | |
| | $B_2H_6/SiH_4$ | 500 ppm | | | |
| developed image support layer | film-forming conditions are shown in Table 2 | | | | |

TABLE 2

Film-forming Conditions of the Developed Image Support Layer common conditions

| flow rate of $SiH_4$ | discharging power | inner pressure | substrate temperature |
|---|---|---|---|
| 50 sccm | 50 W | 0.3 Torr | 250° C. |

changed conditions

| flow rate of $CH_4$ (sccm) | specific resistance of the developed image support layer (Ω · cm) | layer thickness of the developed image support layer (Å) 3000 | 6000 | 10000 |
|---|---|---|---|---|
| 100 | $1.5 \times 10^{12}$ | Sample No. 1 | Sample No. 2 | Sample No. 3 |
| 300 | $7.2 \times 10^{13}$ | Sample No. 4 | Sample No. 5 | Sample No. 6 |
| 500 | $1.2 \times 10^{15}$ | Sample No. 7 | Sample No. 8 | Sample No. 9 |
| 2000 | $8.7 \times 10^{15}$ | Sample No. 10 | Sample No. 11 | Sample No. 12 |

TABLE 3

| | gas used and its flow rate (sccm) | | discharging power (W) | inner pressure (Torr) | substrate temperature (°C.) |
|---|---|---|---|---|---|
| charge injection inhibition layer | $SiH_4$ | 100 | 150 | 0.5 | 250 |
| | $H_2$ | 500 | | | |
| | $PH_3/SiH_4$ | 500 ppm | | | |
| photoconductive layer | $SiH_4$ | 300 | 500 | 0.5 | 250 |
| | $H_2$ | 500 | | | |
| | $B_2H_6/SiH_4$ | 0.1 ppm | | | |
| surface protective layer | $SiH_4$ | 100 | 100 | 0.5 | 250 |
| | $CH_4$ | 100 | | | |
| | $B_2H_6/SiH_4$ | 500 ppm | | | |

TABLE 4

Film-forming Conditions of the Developed Image Support Layer common conditions

TABLE 4-continued

| Film-forming Conditions of the Developed Image Support Layer | | | |
|---|---|---|---|
| flow rate of $SiH_4$ | discharging power | inner pressure | substrate temperature |
| 50 sccm | 50 W | 0.3 Torr | 250° C. |

| | | changed conditions | | | | |
|---|---|---|---|---|---|---|
| | | layer thickness of the developed image support layer (Å) | | | | |
| flow rate of $CH_4$ (sccm) | specific resistance of the developed image support layer (Ω · cm) | 1000 | 3000 | 6000 | 10000 | 15000 |
| 50 | $4.6 \times 10^{11}$ | | Comparative Sample No. 2 | Comparative Sample No. 3 | Comparative Sample No. 4 | |
| 100 | $1.5 \times 10^{12}$ | Comparative Sample No. 5 | | | | Comparative Sample No. 6 |
| 300 | $7.2 \times 10^{13}$ | Comparative Sample No. 7 | | | | Comparative Sample No. 8 |
| 500 | $1.2 \times 10^{15}$ | Comparative Sample No. 9 | | | | Comparative Sample No. 10 |
| 2000 | $8.7 \times 10^{15}$ | Comparative Sample No. 11 | | | | Comparative Sample No. 12 |
| 700 | $1.8 \times 10^{16}$ | | Comparative Sample No. 13 | Comparative Sample No. 14 | Comparative Sample No. 15 | |

TABLE 5

| | Filter Sample A | Filter Sample B |
|---|---|---|
| honeycomb structured filter body | the constituent material: aluminum sheet of 30 μm in thickness cell size: 4 mm compressed ratio: ¼ | same as in the case of Filter Sample A |
| size of the filter body | length: 300 mm width: 30 mm thickness: 15 mm | same as in the case of Filter Sample A |
| catalyst used | $CuO_2.MnO_2$ | activated carbon |

TABLE 5-continued

| | Filter Sample A | Filter Sample B |
|---|---|---|
| the temperature at which the filter is maintained | 50° C. | 50° C. |

TABLE 6

| | | initial images | images obtained after 10,000 shots and left for 5 hours |
|---|---|---|---|
| Drum Sample A | Filter Sample A | high quality images extremely excelling in both resolution and tone reproduction were obtained | high quality images extremely excelling in both resolution and tone reproduction which are equivalent to the initial images were obtained |
| | Filter Sample B | | practically unacceptable images accompanied by minute unfocused images which can be distinguished by eyes were obtained |
| Drum Sample B | Filter Sample A | practically acceptable quality images being good in resolution were obtained | |
| | Filter Sample B | | unbecoming images accompanied by a plurality of apparent unfocused images were obtained |

TABLE 7

| | gas used and its flow rate (sccm) | | discharging power (W) | inner pressure (Torr) | substrate temperature (°C.) |
|---|---|---|---|---|---|
| charge injection inhibition layer | $SiH_4$ | 100 | 150 | 0.5 | 250 |
| | $H_2$ | 500 | | | |
| | $PH_3/SiH_4$ | 500 ppm | | | |
| photoconductive layer | $SiH_4$ | 300 | 500 | 0.5 | 250 |
| | $H_2$ | 500 | | | |
| | $B_2H_6/SiH_4$ | 0.1 ppm | | | |
| latent image support layer | $SiH_4$ | 100 | 300 | 0.3 | 250 |
| | $CH_4$ | 600 | | | |
| | $B_2H_6/SiH_4$ | 300 ppm | | | |
| developed image support layer | $SiH_4$ | 100 | 100 | 0.5 | 250 |
| | $CH_4$ | 500 | | | |

What is claimed is:

1. An electrophotographic process comprising the steps of:

(a) maintaining a surface of a light receiving member at a temperature from 10° to 40° C., said light receiving member for use in electrophotography comprising a substrate and a light receiving multilayer, said light receiving multilayer comprising (i) a photoconductive layer comprising an amorphous material containing silicon atoms as a matrix and at least one kind of atoms selected from the group consisting of hydrogen atoms and halogen atoms; (ii) a latent image supporting layer comprising an amorphous material containing silicon atom as a matrix, carbon atoms, atoms of an element belonging to Group III of the Periodic Table and at least one kind of atoms selected from the group consisting of hydrogen atoms and halogen atoms; and (iii) a developed image supporting layer comprising an amorphous material containing silicon atoms as a matrix, carbon atoms and at least one kind of atoms selected from the group consisting of hydrogen atoms and halogen atoms;

(b) charging said light receiving member;

(c) exposing said light receiving member to form a latent image;

(d) developing said latent image employing a fine particle insulating toner comprising a colorant and a binder, said toner having a volume average particle size from 4.5 to 9 microns to thereby form a developed toner image on said light receiving member; and (e) transferring said developed toner image formed on said light receiving member to a transfer sheet.

2. The electrophotographic image-forming method according to claim 1, wherein said developed image-supporting layer has a thickness of 3000 to 10000 Å.

3. The electrophotographic image-forming method according to claim 1, wherein said developed image-supporting layer has a specific resistance of $10^{12}$ to $10^{16}$ Ω.cm.

4. The electrophotographic image-forming method according to claim 1, wherein said light receiving layer further comprises a charge injection inhibition layer disposed between said substrate and said photoconductive layer.

5. The electrophotographic image-forming method according to claim 1, wherein said light receiving layer further comprises a long wavelength absorptive layer between said substrate and said photoconductive layer.

6. The electrophotographic image-forming method according to claim 5, wherein a long wavelength absorptive layer is disposed between said substrate and said charge injection inhibition layer.

7. An electrophotographic process for forming full color pictorial copied images comprising the steps of:

(a) maintaining a surface of a light receiving member at a temperature from 10° to 40° C., said light receiving member for use in electrophotography comprising a substrate and a light receiving multilayer, said light receiving multilayer comprising (i) a photoconductive layer comprising an amorphous material containing silicon atoms as a matrix and at least one kind of atoms selected from the group consisting of hydrogen atoms and halogen atoms; (ii) a latent image supporting layer comprising an amorphous material containing silicon atom as a matrix, carbon atoms, atoms of an element belonging to Group III of the Periodic Table and at least one kind of atoms selected from the group consisting of hydrogen atoms and halogen atoms; and (iii) a developed image supporting layer comprising an amorphous material consisting silicon atoms as a matrix, carbon atoms and at least one kind of atoms selected from the group consisting of hydrogen atoms and halogen atoms;

(b) charging said light receiving member;

(c) exposing said light receiving member to form a latent image;

(d) developing said latent image employing a plurality of fine particle insulating toners of different colors, each said toner comprising a fine particle insulating toner comprising a colorant and a binder, each said toner having a volume average particle size from 4.5 to 9 microns to thereby form a developed toner image on said light receiving member; and (e) transferring said developed toner image formed on said light receiving member to a transfer sheet.

8. The electrophotographic image-forming method according to claim 7, wherein said developed image supporting layer has a thickness of 3000 to 10000 Å.

9. The electrophotographic image-forming method according to claim 7, wherein said third layer has a specific resistance of $10^{12}$ to $10^{16}$ Ω.cm.

10. The electrophotographic image-forming method according to claim 7, wherein said light receiving layer further comprises a charge injection inhibition layer disposed between said substrate and said photoconductive layer.

11. The electrophotographic image-forming method according to claim 7, wherein said light receiving layer further comprises a long wavelength absorptive layer between said substrate and said photoconductive layer.

12. The electrophotographic image-forming method according to claim 11, wherein a long wavelength absorptive layer is disposed between said substrate and said charge injection inhibition layer.

13. The electrophotographic image-forming method according to claim 7, wherein said metal oxide catalyst comprises one or more members selected from the group consisting of oxides of Cu, Mn, Ti and Si.

* * * * *

UNITED STATES PATENT AND TRADEMARK OFFICE

CERTIFICATE OF CORRECTION

PATENT NO. : 5,087,542

DATED : February 11, 1992

INVENTOR(S) : KOJI YAMAZAKI, ET AL.

It is certified that error appears in the above-identified patent and that said Letters Patent is hereby corrected as shown below:

COLUMN 2

Line 43, "enough" should be deleted.
Line 56, "chinese" should read --Chinese--.
Line 57, "can not" should read --cannot--.
Line 67, "humid" should read --humidity--.

COLUMN 3

Line 5, "what" should read --that--.
Line 14, "folds" should read --fold-- and "over" should read --than--.
Line 25, "machine" should read --machines--.
Line 49, "chinese" should read --Chinese--.

COLUMN 4

Line 60, "image-formation" should read --image formation--.

COLUMN 5

Line 35, "show" should read --shows--.

COLUMN 6

Line 11, "$10^{16}$Å.cm," should read --$10^{16}$Ω.cm,--.
Line 26, "member," should read --member and--.

COLUMN 9

Line 15, "OF-CVD" should read --FO-CVD--.
Line 25, "OF-CVD" should read --FO-CVD--.

UNITED STATES PATENT AND TRADEMARK OFFICE

CERTIFICATE OF CORRECTION

PATENT NO. : 5,087,542

DATED : February 11, 1992

INVENTOR(S) : KOJI YAMAZAKI, ET AL.

It is certified that error appears in the above-identified patent and that said Letters Patent is hereby corrected as shown below:

COLUMN 11

Line 6, "chamber 512" should read --chamber 501--.
Line 26, "upon" should be deleted.
Line 66, "renc-vinyl" should read --rene-vinyl--.

COLUMN 12

Line 24, "a" should read --an--.

COLUMN 13

Line 38, "resulting" should read --resulting liquid--.
Line 39, "method," should read --methods,--.

COLUMN 14

Line 28, "of" should be deleted.
Line 42, "part" should read --parts--.

COLUMN 16

Line 29, "moulder." should read --molder.--.
Line 42, "heney-" should read --honey- --.
Line 61, "is" should be deleted.

COLUMN 17

Line 5, "a" should read --an--.

UNITED STATES PATENT AND TRADEMARK OFFICE

CERTIFICATE OF CORRECTION

PATENT NO. : 5,087,542

DATED : February 11, 1992

INVENTOR(S) : KOJI YAMAZAKI, ET AL.

It is certified that error appears in the above-identified patent and that said Letters Patent is hereby corrected as shown below:

COLUMN 18

Line 3, "Tonor" should read --Toner--.
Line 40, "makes" should read --becomes--.
Line 66, "37a 48b." should read --37a to 48b.--.
Line 67, "10 to 21" should read --10a to 21b--.

COLUMN 19

Line 31, "22a and" should read --22a and 22b--.
Line 46, "50a and 63b" should read --50a to 63b--.
Line 49, "50a and 63b" should read --50a to 63b--.

COLUMN 20

Line 6, "$10^{16}\Omega$ cm" should read --$10^{16}\Omega$.cm--.
Line 46, "catalyst" should read --catalyst.--.

COLUMN 21

Line 19, "in stead" should read --instead--.
Line 41, "honey-comb" should read --honeycomb--.

COLUMN 22

Line 6, "a" should read --an--.
Line 32, "since" should be deleted and "having" should read --have--.

COLUMN 27

Line 11, "atom" should read --atoms--.
Line 33, "image-" should read --image--.
Line 36, "image-" should read --image--.

UNITED STATES PATENT AND TRADEMARK OFFICE

CERTIFICATE OF CORRECTION

PATENT NO. : 5,087,542

DATED : February 11, 1992

INVENTOR(S) : KOJI YAMAZAKI, ET AL.

It is certified that error appears in the above-identified patent and that said Letters Patent is hereby corrected as shown below:

COLUMN 28

Line 9, "atom" should read --atoms--.
Line 15, "consisting" should read --containing--.
Line 36, "third" should read --developed image supporting--.

Signed and Sealed this

Sixth Day of July, 1993

*Attest:*

Michael K. Kirk

MICHAEL K. KIRK

*Attesting Officer*

*Acting Commissioner of Patents and Trademarks*